US006828088B2

(12) United States Patent
Oikawa

(10) Patent No.: US 6,828,088 B2
(45) Date of Patent: Dec. 7, 2004

(54) SILVER HALIDE PHOTOGRAPHIC LIGHT-SENSITIVE MATERIAL

(75) Inventor: Tokuju Oikawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/303,913

(22) Filed: Nov. 26, 2002

(65) Prior Publication Data

US 2004/0048207 A1 Mar. 11, 2004

(30) Foreign Application Priority Data

Nov. 27, 2001 (JP) ..... 2001-360862

(51) Int. Cl.[7] ..... G03C 1/08; G03C 7/26; G03C 7/32

(52) U.S. Cl. ..... 430/567; 430/599; 430/605; 430/264; 430/570; 430/581; 430/582; 430/583; 430/584; 430/585

(58) Field of Search ..... 430/567, 599, 430/604–605, 570, 581–585, 264

(56) References Cited

U.S. PATENT DOCUMENTS 4,937,180 A * 6/1990 Marchetti et al. ..... 430/567
5,985,508 A 11/1999 Ito et al.
6,610,467 B2 * 8/2003 Asami et al. ..... 430/569
6,645,691 B1 * 11/2003 Yasuda ..... 430/264
2003/0211431 A1 * 11/2003 Yasuda ..... 430/605

FOREIGN PATENT DOCUMENTS

EP 0 803 765 A1 10/1997
JP 04 306642 A 10/1992

* cited by examiner

*Primary Examiner*—Geraldine Letscher
(74) *Attorney, Agent, or Firm*—Birch, Stewart, Kolasch & Birch, LLP

(57) ABSTRACT

Disclosed is a silver halide photographic light-sensitive material comprising at least one silver halide emulsion layer on a support, wherein 40 mol % or more of silver halide contained in the silver halide emulsion layer is silver bromide and the silver halide contains $1\times10^{-6}$ mole or more per mole of silver of a metal complex containing one or more cyanide ligands, and the silver halide photographic light-sensitive material has a characteristic curve drawn in orthogonal coordinates of logarithm of light exposure (x-axis) and optical density (y-axis) using equal unit lengths for the both axes, on which gamma is 4.0 or more for the optical density range of 0.1–1.5. There is provided a silver halide photographic light-sensitive material showing high contrast and high sensitivity.

20 Claims, 1 Drawing Sheet

SILVER HALIDE PHOTOGRAPHIC LIGHT-SENSITIVE MATERIAL

TECHNICAL FIELD

The present invention relates to a silver halide photographic light-sensitive material. In particular, the present invention relates to an ultrahigh contrast negative type photographic light-sensitive material suitable as a silver halide photographic light-sensitive material used for a photomechanical process.

RELATED ART

In photomechanical processes used in the field of graphic arts, used is a method in which photographic images of continuous tone are converted into so-called dot images in which variable image density is represented by sizes of dot areas, and such images are combined with photographed images of characters or line originals to produce printing plates. For silver halide photographic light-sensitive materials used for such a purpose, ultrahigh contrast photographic characteristic enabling clear distinction between image portions and non-image portions has been required in order to obtain favorable reproducibility of characters, line originals and dot images.

As a system responding to such a requirement, there has been known the so-called lithographic development method in which a silver halide light-sensitive material comprising silver chlorobromide is processed with a hydroquinone developer having an extremely low effective concentration of sulfite ions to form images of high contrast. However, in this method, the developer is extremely unstable against oxidation by air since the sulfite ion concentration in the developer is extremely low, and therefore a lot of developer must be replenished in order to stably maintain the developer activity.

As image forming systems in which the instability of the image formation according to the lithographic development method is eliminated and light-sensitive materials are processed with a developer showing good storage stability to obtain ultrahigh contrast photographic characteristic, there can be mentioned those described in U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836, 5,650,746 and so forth. These are systems in which a silver halide photographic light-sensitive material of surface latent image type containing a hydrazine derivative is processed with a developer containing hydropuinone/metol or hydroquinone/phenidone as main developing agents and 0.15 mol/l or more of sulfite preservative and having pH of 11.0–12.3 to form ultrahigh contrast negative images having a gamma of 10 or higher. According to these systems, photographic characteristics of ultrahigh contrast and high sensitivity can be obtained, and because sulfite can be added to the developer at a high concentration, stability of the developer to air oxidation is markedly improved compared with conventional lithographic developers.

In order to form sufficiently ultrahigh contrast images with use of a hydrazine derivative, it is necessary to perform processing with a developer having pH of 11 or higher, usually 11.5 or higher. Although it becomes possible to increase the stability of the developer by use of a sulfite preservative at a high concentration, it is necessary to use such a developer of high pH as described above in order to obtain ultrahigh contrast photographic images, and the developer is still likely to suffer from air oxidation and instable even with the presence of the preservative. Therefore, various attempts have been made in order to realize ultrahigh images with a lower pH to further improve stability of the developer.

For example, U.S. Pat. No. 4,269,929 (Japanese Patent Laid-open Publication (Kokai, henceforth referred to as "JP-A") No. 61-267759), U.S. Pat. No. 4,737,452 (JP-A-60-179734), U.S. Pat. Nos. 5,104,769, 4,798,780, JP-A-1-179939, JP-A-1-179940, U.S. Pat. Nos. 4,998,604, 4,994,365 and JP-A-8-272023 disclose methods of using a highly active hydrazine derivative and a nucleation accelerator in order to obtain ultrahigh images by using a developer having pH of less than 11.0.

However, silver halide photographic light-sensitive materials used for such image-forming systems have problems concerning processing stability, for example, due to exhaustion of processing solutions, activities of hydrazine compound and nucleation accelerator vary and thus sensitivity fluctuates. As means for improving processing stability, use of an emulsion providing a higher contrast can be mentioned. However, it causes a problem that use of an emulsion providing a higher contrast causes reduction of sensitivity. Therefore, it has been desired to develop a technique for obtaining higher sensitivity with superior processing stability.

Considering these problems of the conventional techniques, an object of the present invention is to provide a silver halide photographic light-sensitive material that provides high contrast and high sensitivity.

SUMMARY OF THE INVENTION

As a result of various researches of the inventors of the present invention, they found that a superior silver halide photographic light-sensitive material could provided by using a particular silver halide emulsion to provide a gamma exceeding a certain level, and thus accomplished the present invention.

That is, the present invention provides a silver halide photographic light-sensitive material comprising at least one silver halide emulsion layer on a support, wherein 40 mol % or more, preferably 45–75 mol % of silver halide contained in the silver halide emulsion layer is silver bromide and the silver halide contains $1\times10^{-6}$ mole or more, preferably $5\times10^{-6}$ mole to $5\times10^{-3}$ mole per mole of silver of a metal complex containing one or more cyanide ligands, and the silver halide photographic light-sensitive material has a characteristic curve drawn in orthogonal coordinates of logarithm of light exposure (x-axis) and optical density (y-axis) using equal unit lengths for the both axes, on which gamma is 4.0 or more for the optical density range of 0.1–1.5.

In the silver halide photographic light-sensitive material of the present invention, the metal complex containing one or more cyanide ligands exists in the inside of silver halide crystals, and preferably 99 mol % or less, more preferably 95 mol % or less, of the total amount of silver contained in the silver halide crystals is contained in the inside of the crystals. Further, the silver halide crystals preferably have an aspect ratio (diameter as circle/thickness) of 2 or less.

At least one of silver halide emulsion layers constituting the silver halide photographic light-sensitive material of the present invention preferably contains at least one spectral sensitization dye represented by the following formula (I), (II), (III), (IV), (V), (VIa) or (VIb).

Formula (I)

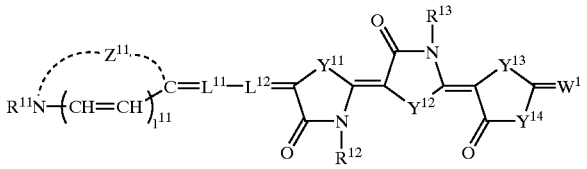

$(M^1)_{n11}$

In the formula, $Y^{11}$, $Y^{12}$, $Y^{13}$ and $Y^{14}$ each independently represent $=N(R^1)$, an oxygen atom, a sulfur atom, a selenium atom or a tellurium atom, provided that either one of $Y^{13}$ and $Y^{14}$ is $=N(R^1)$, and $Y^{11}$, $Y^{12}$ and $Y^{13}$ or $Y^{11}$, $Y^{12}$ and $Y^{14}$ do not simultaneously represent a sulfur atom. $R^{11}$ represents an aliphatic group having a water-solubilizable group and 8 or less carbon atoms, and $R^1$, $R^{12}$ and $R^{13}$ each independently represent an aliphatic group, an aryl group or a heterocyclic group. However, at least two of $R^1$, $R^{12}$ and $R^{13}$ have a water-solubilizable group. $Z^{11}$ represents a nonmetallic atom group required to form a 5- or 6-membered nitrogen-containing heterocyclic ring, and the 5- or 6-membered nitrogen-containing heterocyclic ring formed with $Z^{11}$ may have a condensed ring. $W^1$ represents an oxygen atom, a sulfur atom, $=N(R^1)$ or $=C(E^{11})(E^{12})$. $E^{11}$ and $E^{12}$ each independently represent an electron-withdrawing group. These may bond to each other to form a keto ring or an acidic heterocyclic ring. $L^{11}$ and $L^{12}$ each independently represent a substituted or unsubstituted methine group, and $l^{11}$ represents 0 or 1. $M^1$ represents an ion required to offset the charge of the molecule. $n^{11}$ represents a number required to neutralize the total charge of the molecule. However, when an intramolecular salt is formed, $n^{11}$ is 0.

Formula (II)

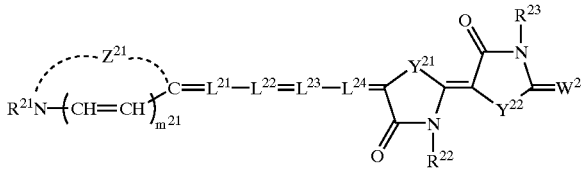

$(M^2)_{n21}$

In the formula, $Z^{21}$ represents a nonmetallic atom group required to form a 5- or 6-membered nitrogen-containing heterocyclic ring, and the 5- or 6-membered nitrogen-containing heterocyclic ring formed with $Z^{21}$ may have a condensed ring. $Y^{21}$ and $Y^{22}$ each independently represent $=N(R^2)$, an oxygen atom, a sulfur atom, a selenium atom or a tellurium atom. $W^2$ represents $=N$ (Ar), an oxygen atom, a sulfur atom or $=C$ $(E^{21})(E^{22})$. $E^{21}$ and $E^{22}$ each independently represent an electron-withdrawing group or a nonmetallic atom group for forming an acidic heterocyclic ring when $E^{21}$ and $E^{22}$ bond to each other, and Ar represents an aromatic group or an aromatic heterocyclic group. $R^{21}$ represents an aliphatic group having 8 or less carbon atoms and a water-solubilizable group, and $R^2$, $R^{22}$ and $R^{23}$ each independently represent an aliphatic group, an aryl group or a heterocyclic group. However, at least two of $R^2$, $R^{22}$ and $R^{23}$ have a water-solubilizable group. $L^{21}$, $L^{22}$, $L^{23}$ and $L^{24}$ each independently represent a substituted or unsubstituted methine group, and $m^{21}$ represents 0 or 1. $M^2$ represents an ion required to offset the charge of the molecule. $n^{21}$ represents a number required to neutralize the total charge of the molecule. However, when an intramolecular salt is formed, $n^{21}$ is 0.

Formula (III)

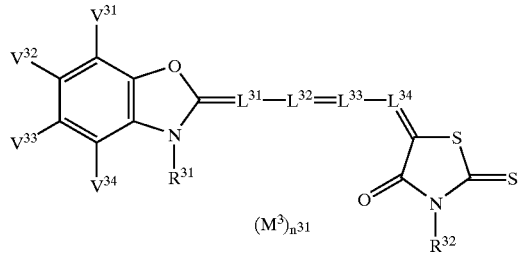

$(M^3)_{n31}$

In the formula, $R^{31}$ and $R^{32}$ each independently represent an alkyl group. However, at least one alkyl group has a water-soluble group. $V^{31}$, $V^{32}$, $V^{33}$ and $V^{34}$ represent a hydrogen atom or a monovalent substituent. However, the sum of the molecular weight of these substituents ($V^{31}$, $V^{32}$, $V^{33}$ and $V^{34}$) is 50 or less. $L^{31}$, $L^{32}$, $L^{33}$ and $L^{34}$ each independently represent a substituted or unsubstituted methine group. $M^3$ represents an ion required to offset the charge of the molecule. $n^{31}$ represents a number required to neutralize the total charge of the molecule. However, when an intramolecular salt is formed, $n^{31}$ is 0.

Formula (IV)

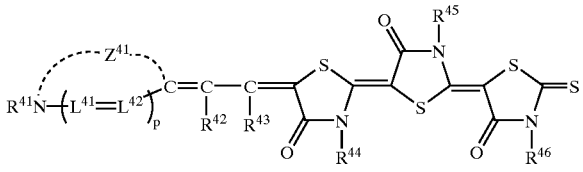

$(M^4)_{n41}$

In the formula, $R^{41}$ represents an alkyl group, an alkenyl group or an aryl group, $R^{42}$ and $R^{43}$ each independently represent a hydrogen atom, an alkyl group, an alkenyl group or an aryl group, and $R^{44}$, $R^{45}$ and $R^{46}$ each independently represent an alkyl group, an alkenyl group, an aryl group or a hydrogen atom. $L^{41}$ and $L^{42}$ each independently represent a substituted or unsubstituted methine group, and p represents 0 or 1. $Z^{41}$ represents an atomic group required to complete a 5- or 6-membered heterocyclic ring, and the 5- or 6-membered heterocyclic group formed with $Z^{41}$ may have a condensed ring. $M^4$ represents an ion required to offset the charge of the molecule. $n^{41}$ represents a number required to neutralize the total charge of the molecule. However, when an intramolecular salt is formed, $n^{41}$ is 0. The spectral sensitization dye represented by the formula (IV) has at least three water-solubilizable groups.

Formula (V)

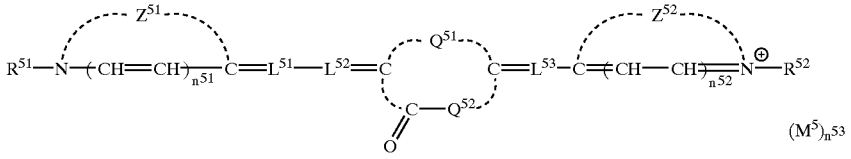

In the formula, $Z^{51}$ and $Z^{52}$ each independently represent a nonmetallic atom group required to form a 5- or 6-membered nitrogen-containing heterocyclic ring, and the 5- or 6-membered nitrogen-containing heterocyclic ring formed with $Z^{51}$ or $Z^{52}$ may have a condensed ring. $R^{51}$ and $R^{52}$ each independently represent an alkyl group, a substituted alkyl group or an aryl group. $Q^{51}$ and $Q^{52}$ represent a nonmetallic atom group required to together form a thiazolidinone ring or an imidazolidinone ring. $L^{51}$, $L^{52}$ and $L^{53}$ each independently represent a methine group or a substituted methine group. $n^{51}$ and $n^{52}$ each independently represent 0 or 1. $M^5$ represents an ion required to offset the charge of the molecule. $n^{53}$ represents a number required to neutralize the total charge of the molecule. However, when an intramolecular salt is formed, $n^{53}$ is 0.

Formula (VIa)

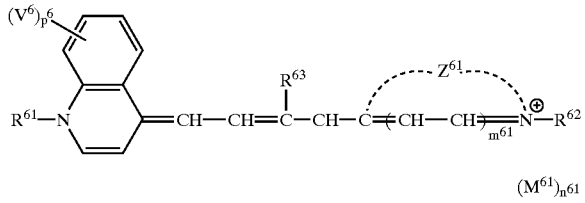

In the formula, $R^{61}$ and $R^{62}$ each independently represent an alkyl group. $R^{63}$ represents a hydrogen atom, a lower alkyl group, a lower alkoxy group, a phenyl group, a benzyl group or a phenethyl group. $V^6$ represents a hydrogen atom, a lower alkyl group, an alkoxy group, a halogen atom or a substituted alkyl group, and $p^6$ represents 1 or 2. $Z^{61}$ represents a group required to form a 5- or 6-membered nitrogen-containing heterocyclic ring, and the 5- or 6-membered nitrogen-containing heterocyclic ring formed with $Z^{61}$ may have a condensed ring. $m^{61}$ represents 0 or 1. $M^{61}$ represents an ion required to offset the charge of the molecule. $n^{61}$ represents a number required to neutralize the total charge of the molecule. However, when an intramolecular salt is formed, $n^{61}$ is 0.

Formula (VIb)

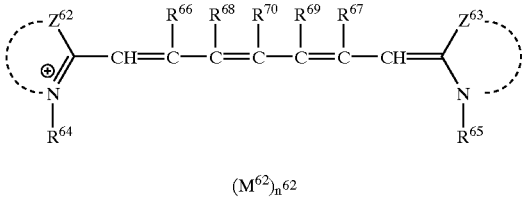

In the formula, $R^{64}$ and $R^{65}$ each independently represent an alkyl group. $R^{66}$ and $R^{67}$ each independently represent a hydrogen atom, a lower alkyl group, a lower alkoxy group, a phenyl group, a benzyl group or a phenethyl group. $R^{68}$ and $R^{69}$ each represent a hydrogen atom. $R^{68}$ and $R^{69}$ may bond to each other to form an alkylene group. $R^{70}$ represents a hydrogen atom, a lower alkyl group, a lower alkoxy group, a phenyl group, a benzyl group or —N($W^{61}$) ($W^{62}$) [$W^{61}$ and $W^{62}$ each independently represent an alkyl group or an aryl group, or $W^{61}$ and $W^{62}$ may bond to each other to form a 5- or 6-membered nitrogen-containing heterocyclic ring]. Further, $R^{66}$ and $R^{70}$ or $R^{67}$ and $R^{70}$ may bond to each other, respectively, to form an alkylene group. $Z^{62}$ and $Z^{63}$ each independently represent a nonmetallic atom group required to form a 5- or 6-membered nitrogen-containing heterocyclic ring, and the 5-or 6-membered nitrogen-containing heterocyclic ring formed with $Z^{62}$ or $Z^{63}$ may have a condensed ring. $M^{62}$ represents an ion required to offset the charge of the molecule. $n^{62}$ represents a number required to neutralize the total charge of the molecule. However, when an intramolecular salt is formed, $n^{62}$ is 0.

The silver halide photographic light-sensitive material of the present invention preferably contains a hydrazine derivative. Further, the silver halide photographic light-sensitive material preferably has a membrane surface pH of 6.0 or less for the emulsion layer side. The silver halide photographic light-sensitive material of the present invention can be processed with a developer prepared by using a solid processing agent.

According to the present invention, there can be provided a high contrast silver halide photographic light-sensitive material showing high sensitivity and superior processing stability.

BEST MODE FOR CARRYING OUT THE INVENTION

Figure 1:
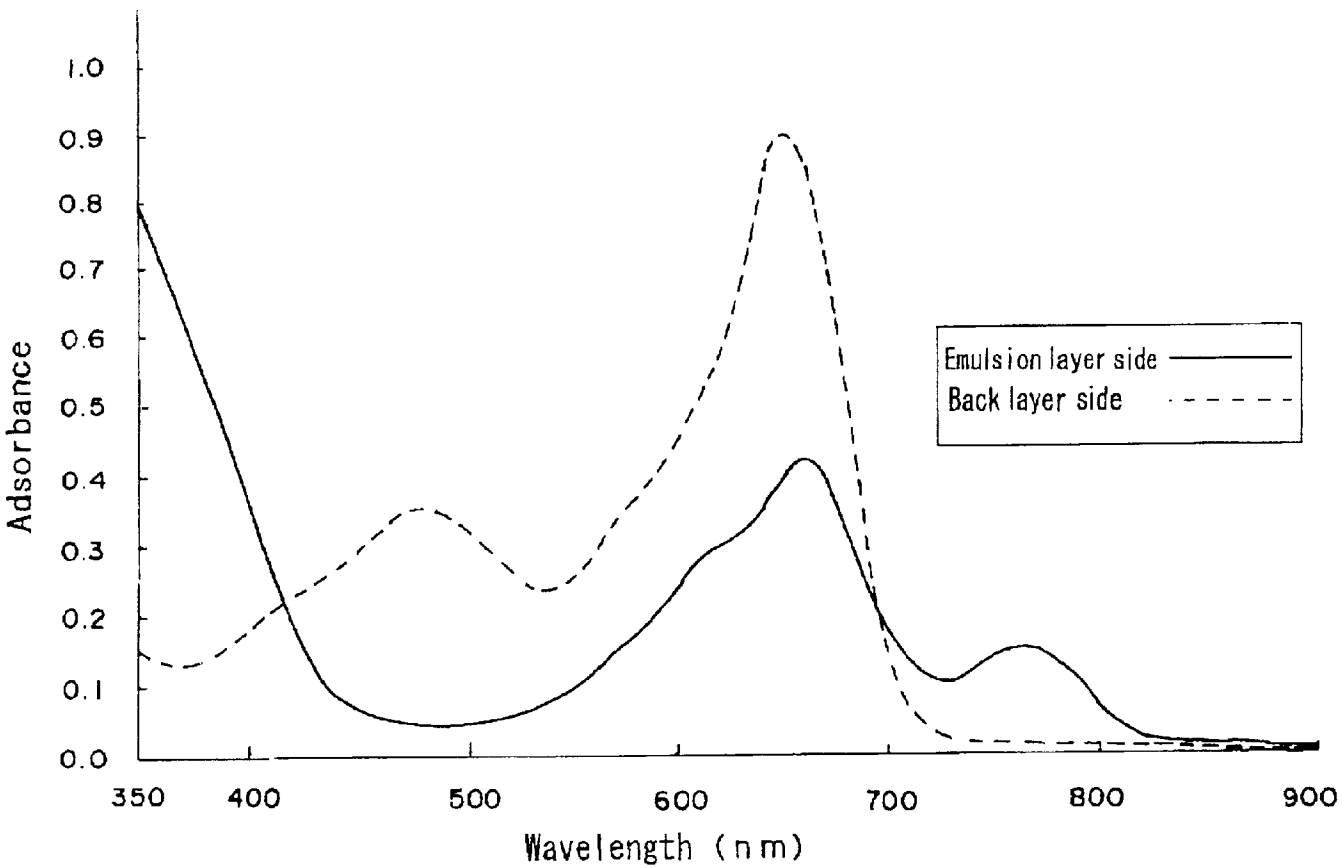
FIG. 1 shows absorption spectra for emulsion layer side and back layer side of a silver halide photographic light-sensitive material according to an embodiment of the present invention. The longitudinal axis represents absorbance (graduated in 0.1), and the transverse axis represents wavelength of from 350 nm to 900 nm. The solid line represents the absorption spectrum of the emulsion layer side, and the broken line represents the absorption spectrum of the back layer side.

The silver halide photographic light-sensitive material of the present invention will be explained in detail hereafter. In the present specification, ranges indicated with "-" mean ranges including the numerical values before and after "-" as the minimum and maximum values, respectively.

As the silver halide of the silver halide emulsion used for the silver halide photographic light-sensitive material of the present invention, 40 mol % or more of silver halide contained in the silver halide emulsion layer is silver bromide. In particular, 45–75 mol % of silver halide contained in the silver halide emulsion layer is silver bromide. Specifically, silver chlorobromide or silver chloroiodobromide containing silver bromide in an amount of 45 mol % or more is preferably used. Further, silver chlorobromide or silver chloroiodobromide containing silver bromide in an amount of 45–75 mol % is more preferably used. While the form of silver halide grain may be any of cubic, tetradecahedral, octahedral, irregular and tabular forms, a form having an aspect ratio (diameter as circle/thickness) of 2 or less is preferred, and a cubic form is most preferred. The silver halide preferably has a mean grain size of 0.1–0.7 $\mu$m, more preferably 0.1–0.5 $\mu$m, and preferably has a narrow grain size distribution in terms of a variation coefficient, which is represented as {(Standard deviation of grain size)/(mean grain size)}×100, of preferably 15% or less, more preferably 10% or less.

The silver halide grains may have uniform or different phases for the inside and the surface layer. Further, they may have a localized layer having a different halogen composition inside the grains or as surface layers of the grains.

The photographic emulsion used for the present invention can be prepared by using the methods described in P. Glafkides, Chimie et Physique Photographique, Paul Montel (1967); G. F. Duffin, Photographic Emulsion Chemistry, The Focal Press (1966); V. L. Zelikman et al., Making and Coating Photographic Emulsion, The Focal Press (1964) and so forth.

That is, any of an acidic process and a neutral process may be used. In addition, a soluble silver salt may be reacted with a soluble halogen salt by any of the single jet method, double jet method and a combination thereof. A method of forming grains in the presence of excessive silver ions (so-called reverse mixing method) may also be used.

As one type of the double jet method, a method of maintaining the pAg constant in the liquid phase where silver halide is produced, that is, the so-called controlled double jet method, may also be used. Further, it is preferable to form grains using the so-called silver halide solvent such as ammonia, thioether or tetra-substituted thiourea. More preferred as the silver halide solvent is a tetra-substituted thiourea compound, and it is described in JP-A-53-82408 and JP-A-55-77737. Preferred examples of the thiourea compound include tetramethylthiourea and 1,3-dimethyl-2-imidazolidmethione. While the amount of the silver halide solvent to be added may vary depending on the kind of the compound used, the desired grain size and halide composition of silver halide, it is preferably in the range of from $10^{-5}$ to $10^{-2}$ mol per mol of silver halide.

According to the controlled double jet method or the method of forming grains using a silver halide solvent, a silver halide emulsion comprising regular crystal form grains and having a narrow grain size distribution can be easily prepared, and these methods are useful for preparing the silver halide emulsion used for the present invention.

In order to achieve a uniform grain size, it is preferable to rapidly grow grains within the range of not exceeding the critical saturation degree by using a method of changing the addition rate of silver nitrate or alkali halide according to the grain growth rate as described in British Patent No. 1,535,016, (Japanese Patent Publication (Kokoku, henceforth referred to as "JP-B") No. 48-36890 and JP-B-52-16364, or a method of changing the concentration of the aqueous solution as described in U.S. Pat. No. 4,242,445 and JP-A-55-158124.

The silver halide emulsion used for the present invention contains $1\times10^{-6}$ mole or more per mole of silver of a metal complex containing one or more cyanide ligands in the silver halide. The silver halide contains preferably $5\times10^{-6}$ mole to $1\times10^{-2}$ mole, more preferably $5\times10^{-6}$ mole to $5\times10^{-3}$ mole, per mole of silver of a metal complex containing one or more cyanide ligands.

The metal complex containing one or more cyanide ligands used for the present invention is added in the form of a water-soluble complex salt. Particularly preferred examples thereof include hexacoordinate complexes represented by the following formula:

$$[M(CN)_{n1}L_{6-n1}]^{-}$$

In the formula, M represents a metal belonging Groups V to VIII, and Ru, Re, Os and Fe are particularly preferred. L represents a ligand other than cyanide, and preferred are a halide ligand, a nitrosyl ligand, a thionitrosyl ligand and so forth. n1 represents 1–6, and n represents 0, 1, 2, 3 or 4. n1 is preferably 6. In the complexes, the counter ion is not critical, and an ammonium or an alkali metal ion is usually used.

Specific examples of the complex used for the present invention are mentioned below. However, the complexes that can be used by the present invention are not limited to these.

| | |
|---|---|
| $[Re(NO)(CN)_5]^{2-}$ | $[Re(O)_2(CN)_4]^{3-}$ |
| $[Os(NO)(CN)_5]^{2-}$ | $[Os(CN)_6]^{4-}$ |
| $[Os(O)_2(CN)_4]^{4-}$ | |
| $[Ru(CN)_6]^{4-}$ | $[Fe(CN)_6]^{4-}$ |

Although the metal complex used for the present invention may exist anywhere in the silver halide grains, it preferably exists in the inside of silver halide crystals. Preferably 99 mol % or less, more preferably 95 mol % or less, further preferably 0–95 mol %, of silver of each silver halide crystal exists in the inside of the silver halide crystal. To attain this characteristic, the photosensitive silver halide grains are preferably formed with multiple layers as described in the examples mentioned later.

The silver halide emulsion used for the present invention preferably contains a rhodium compound, an iridium compound, a rhenium compound, a ruthenium compound, an osmium compound or the like in order to attain high contrast and low fog, in addition to the metal complex containing one or more cyanide ligands.

As the rhodium compound used for the present invention, a water-soluble rhodium compound can be used. Examples thereof include rhodium(III) halide compounds and rhodium complex salts having a halogen, amine, oxalato, aquo or the like as a ligand, such as hexachlororhodium(III) complex salt, pentachloroaquorhodium complex salt, tetrachlorodiaquorhodium complex salt, hexabromorhodium(III) complex salt, hexaaminerhodium(III) complex salt and trioxalatorhodium(III) complex salt. The rhodium compound is dissolved in water or an appropriate solvent prior to use, and a method commonly used for stabilizing the rhodium compound solution, that is a method of adding an aqueous solution of hydrogen halide (e.g., hydrochloric acid, hydrobromic acid or hydrofluoric acid) or an alkali halide (e.g., KCl, NaCl, KBr or NaBr), may be used. In place of using a water-soluble rhodium, separate silver halide grains that have been previously doped with rhodium may be added and dissolved at the time of preparation of silver halide.

The rhenium, ruthenium or osmium compound used for the present invention is added in the form of a water-soluble complex salt described in JP-A-63-2042, JP-A-1-285941, JP-A-2-20852, JP-A-2-20855 and so forth. Particularly preferred examples are hexacoordinate complex salts represented by the following formula:

$$[ML_6]^{n-}$$

In the formula, M represents Ru, Re or Os, L represents a ligand, and n represents 0, 1, 2, 3 or 4. In this case, the counter ion plays no important role and an ammonium or alkali metal may be used. Preferred examples of the ligand include a halide ligand, a nitrosyl ligand, a thionitrosyl ligand and so forth. Specific examples of the complex that can be used for the present invention are shown below. However, the scope of the present invention is not limited to these examples.

| | |
|---|---|
| $[ReCl_6]^{3-}$ | $[ReBr_6]^{3-}$ |
| $[ReCl_5(NO)]^{2-}$ | $[Re(NS)Br_5]^{2-}$ |
| $[RuCl_6]^{3-}$ | $[RuCl_4(H_2O)_2]^{1-}$ |
| $[RuCl_5(NO)]^{2-}$ | $[RuBr_5(NS)]^{2-}$ |
| $[Ru(CO)_3Cl_3]^{2-}$ | $[Ru(CO)Cl_5]^{2-}$ |
| $[Ru(CO)Br_5]^{2-}$ | $[OsCl_6]^{3-}$ |
| $[OsCl_5(NO)]^{2-}$ | $[Os(NS)Br_5]^{2-}$ |

The amount of these compounds is preferably from $1\times10^{-9}$ to $1\times10^{-5}$ mol, particularly preferably from $1\times10^{-8}$ to $1\times10^{-6}$ mol, per mole of silver halide.

The iridium compounds used in the present invention include hexachloroiridium, hexabromoiridium, hexaammineiridium, pentachloronitrosyliridium and so forth.

The silver halide emulsion used for the present invention is preferably subjected to chemical sensitization. The chemical sensitization may be performed by using a known method such as sulfur sensitization, selenium sensitization, tellurium sensitization, noble metal sensitization or the like. These sensitization methods may be used each alone or in any combination. When these sensitization methods are used in combination, preferable combinations include sulfur and gold sensitizations, sulfur, selenium and gold sensitizations, sulfur, tellurium and gold sensitizations and so forth.

The sulfur sensitization used in the present invention is usually performed by adding a sulfur sensitizer and stirring the emulsion at a high temperature of 40° C. or above for a predetermined time. The sulfur sensitizer may be a known compound, and examples thereof include, in addition to sulfur compounds contained in gelatin, various sulfur compounds such as thiosulfates, thioureas, thiazoles and rhodanines, among which thiosulfates and thioureas are preferred. As the thiourea compounds, the specifically tetrasubstituted thiourea compounds described in U.S. Pat. No. 4,810,626 are particularly preferred. Although the amount of the sulfur sensitizer to be added varies depending on various conditions such as pH, temperature and grain size of silver halide at the time of chemical ripening, it is preferably from $10^{-7}$ to $10^{-2}$ mol, more preferably from $10^{-5}$ to $10^{-3}$ mol, per mol of silver halide.

The selenium sensitizer used for the present invention may be a known selenium compound. That is, the selenium sensitization is usually performed by adding a labile and/or non-labile selenium compound and stirring the emulsion at a high temperature of 40° C. or above for a predetermined time. Examples of the labile selenium compound include those described in JP-B-44-15748, JP-B-43-13489, JP-A-4-109240 and JP-A-4-324855. Among these, particularly preferred are those compounds represented by formulas (VIII) and (IX) of JP-A-4-324855.

The tellurium sensitizer that can be used for the present invention is a compound capable of producing silver telluride, presumably serving as a sensitization nucleus, on the surface or inside of silver halide grains. The rate of the formation of silver telluride in a silver halide emulsion can be examined according to the method described in JP-A-5-313284.

Specifically, there can be used the compounds described in U.S. Pat. Nos. 1,623,499, 3,320,069 and 3,772,031; British Patent Nos. 235,211, 1,121,496, 1,295,462 and 1,396,696; Canadian Patent No. 800,958; JP-A-4-204640, JP-A-4-271341, JP-A-4-333043, JP-A-5-303157; J. Chem. Soc. Chem. Commun., 635 (1980); ibid., 1102 (1979); ibid., 645 (1979); J. Chem. Soc. Perkin. Trans., 1, 2191 (1980); S. Patai (compiler), The Chemistry of Organic Selenium and Tellurium Compounds, Vol. 1 (1986); and ibid., Vol. 2 (1987). The compounds represented by the formulas (II), (III) and (IV) mentioned in JP-A-4-324855 are particularly preferred.

The amount of the selenium or tellurium sensitizer used for the present invention varies depending on silver halide grains used, chemical ripening conditions and so forth. However, it is generally from about $10^{-8}$ to about $10^{-2}$ mol, preferably from about $10^{-7}$ to about $10^{-3}$ mol, per mol of silver halide. The conditions for chemical sensitization in the present invention are not particularly restricted. However, in general, pH is 5–8, pAg is 6–11, preferably 7–10 and temperature is 40–95° C., preferably 45–85° C.

Noble metal sensitizers that can be used for the present invention include gold, platinum, palladium and iridium, and gold sensitization is particularly preferred. Specific examples of the gold sensitizers used for the present invention include chloroauric acid, potassium chloroaurate, potassium aurithiocyanate, gold sulfide and so forth, which can be used in an amount of about $10^{-7}$ to about $10^{-2}$ mol per mol of silver halide.

As for the silver halide emulsion used for the present invention, production or physical ripening process for the silver halide grains may be performed in the presence of a cadmium salt, sulfite, lead salt, thallium salt or the like.

In the present invention, reduction sensitization may be used. Examples of the reduction sensitizer include a stannous salt, amine, formamidinesulfinic acid, silane compound and so forth.

To the silver halide emulsion of the present invention, a thiosulfonic acid compound may be added according to the method described in European Unexamined Patent Publication EP293917A.

In the silver halide photographic light-sensitive material of the present invention, one to three kinds of silver halide emulsions are preferably used. When two or more kinds of emulsions are used in combination, those having different average grain sizes, those having different halogen compositions, those containing metal complexes of different kinds in different amounts, those having different crystal habits, those subjected to chemical sensitizations with different conditions or those having different sensitivities are preferably used in combination. In order to obtain high contrast, it is especially preferable to coat an emulsion having higher sensitivity as it becomes closer to a support as described in JP-A-6-324426.

At least one of silver halide emulsion layers constituting the silver halide photographic light-sensitive material of the present invention preferably contains at least one spectral sensitization dye represented by the following formula (I), (II), (III), (IV), (V), (VIa) or (VIb).

The compounds represented by the formula (I) used for the present invention will be explained. Examples of the water-solubilizable group of the aliphatic group having 8 or less carbon atoms and a water-solubilizable group, which is represented by $R^{11}$, include an acidic group such as a sulfo group, a carboxy group, a phosphono group, a sulfate group and a sulfino group. Examples of the aliphatic group having 8 or less carbon atoms include, for example, a branched or straight alkyl group (e.g., methyl, ethyl, n-propyl, n-pentyl, isobutyl etc.), an alkenyl group having 3–8 carbon atoms (e.g., 3-butenyl, 2-propenyl etc.) and an aralkyl group having 3–8 carbon atoms (e.g., benzyl, phenethyl etc.).

As for the groups represented by $R^1$ in $=N(R^1)$ represented by $Y^{11}$, $Y^{12}$, $Y^{13}$, $Y^{14}$ or $W^1$, $R^{12}$ or $R^{13}$, examples of the aliphatic group include, for example, a branched or straight alkyl group having 1–8 carbon atoms (e.g., methyl, ethyl, n-propyl, n-pentyl, isobutyl etc.), an alkenyl group having 3–8 carbon atoms (e.g., 3-butenyl, 2-propenyl etc.) and an aralkyl group having 3–8 carbon atoms (e.g., benzyl, phenethyl etc.), examples of the aryl group include, for example, a phenyl group, and examples of the heterocyclic group include, for example, a pyridyl group (2-, 4-), a pyrazyl group, a furyl group (2-), a thienyl group (2-), a sulfolanyl group, a tetrahydrofuryl group, a piperidinyl group, a pyrrole group, an imidazolyl group etc.

At least two of $R^{12}$, $R^{13}$ and $R^1$ have a water-solubilizable group. Examples of the water-solubilizable group of $R^{12}$, $R^{13}$ and $R^1$ include, for example, an acidic group such as a sulfo group, a carboxy group, a phosphono group, a sulfate group and a sulfino group.

Each of the groups of $R^{11}$, $R^{12}$, $R^{13}$ and $R^1$ may have another substituent. Examples of the substituent include a halogen atom (e.g., fluorine atom, chlorine atom, bromine atom etc.), an alkoxy group (e.g., methoxy group, ethoxy group etc.), an aryloxy group (e.g., phenoxy group, p-tolyloxy group etc.), a cyano group, a carbamoyl group (e.g., carbamoyl group, N-methylcarbamoyl group, N,N-tetramethylenecarbamoyl group etc.), a sulfamoyl groups (e.g., sulfamoyl group, N,N-3-oxapentamethyleneaminosulfonyl group etc.), a methanesulfonyl group, an alkoxycarbonyl groups (e.g., ethoxycarbonyl group, butoxycarbonyl group etc.), an aryl group (e.g., phenyl group, carboxyphenyl group etc.), an acyl group (e.g., acetyl group, benzoyl group etc.) and so forth.

Specific examples of the aliphatic group having a water-solubilizable group include carboxymethyl, sulfoethyl, sulfopropyl, sulfobutyl, sulfopentyl, 3-sulfobutyl, 6-sulfo-3-oxahexyl, ,-sulfopropoxycarbonylmethyl, ,-sulfopropylaminocarbonylmethyl, N-ethyl-N-sulfopropyl, 3-sulfinobutyl, 3-phosphonopropyl, 4-sulfo-3-butenyl, 2-carboxy-2-propenyl, o-sulfobenzyl, p-sulfophenethyl, p-carboxybenzyl and so forth, specific examples of the aryl group having a water-solubilizable group include p-sulfophenyl group, p-carboxyphenyl group and so forth, and specific examples of the heterocyclic group having a water-solubilizable group include 4-sulfothienyl group, 3-carboxypyridyl group and so forth.

$R^{11}$ is preferably an alkyl group substituted with a sulfo group, and it is preferred that at least two of $R^{12}$, $R^{13}$ and $R^1$ should be carboxymethyl groups.

Examples of the 5- or 6-membered nitrogen-containing heterocyclic ring and 5- or 6-membered nitrogen-containing heterocyclic ring having a condensed ring, which are formed with $Z^{11}$, include basic heterocyclic rings forming cyanine dyes. Examples of these heterocyclic rings include, for example, an oxazole ring (oxazole, benzoxazole, naphthooxazole etc.), a thiazole ring (e.g., thiazolidine, thiazole, benzothiazole, naphthothiazole etc.), an imidazole ring (e.g., imidazole, benzimidazole, naphthoimidazole etc.), a selenazole ring (e.g. selenazole, benzoselenazole, naphthoselenazole etc.), a tellurazole ring (e.g., tellurazole, benzotellurazole, naphthotellurazole etc.), a pyridine ring (e.g., pyridine, quinoline etc.) and a pyrrole ring (e.g., pyrrole, indole, indolenine etc.).

These heterocyclic rings may have a substituent at an arbitrary position, and examples of the substituent include, for example, a halogen atom (fluorine atom, chlorine atom, bromine atom, iodine atom), a trifluoromethyl group, an alkoxy group (e.g., an unsubstituted alkoxy group such as methoxy, ethoxy and butoxy, a substituted alkoxy group such as 2-methoxyethoxy and benzyloxy etc.), a hydroxy group, a cyano group, an aryloxy group (e.g., a substituted or unsubstituted aryloxy group such as phenoxy and tolyloxy), an aryl group (e.g., a substituted or unsubstituted aryl group such as phenyl, p-chlorophenyl, p-tolyl and p-methoxyphenyl), a stilyl group, a heterocyclic group (e.g., furyl, thienyl etc.), a carbamoyl group (e.g., carbamoyl, N-ethylcarbamoyl etc.), a sulfamoyl group (e.g., sulfamoyl, N,N-dimethylsulfamoyl etc.), an acylamino group (e.g., acetylamino, propionylamino, benzoylamino etc.), an acyl group (e.g., acetyl, benzoyl etc.), an alkoxycarbonyl group (e.g., ethoxycarbonyl etc.), a sulfonamido group (e.g., methanesulfonylamido, benzenesulfonamido etc.), a sulfonyl group (e.g., methanesulfonyl, p-toluenesulfonyl etc.), a carboxy group, an alkyl group (e.g., an arbitrary alkyl group such as methyl, ethyl and isopropyl).

Examples of the substituent on a carbon atom of the methine group represented by $L^{11}$ or $L^{12}$ include, for example, a lower alkyl group (e.g., methyl, ethyl etc.), a phenyl group (e.g., phenyl, carboxyphenyl etc.), an alkoxy group (e.g., methoxy, ethoxy etc.), an aryloxy group as (e.g., phenoxy, carboxyphenoxy etc.), an aralkyl group (e.g., benzyl etc.), a fluorine atom, a heterocyclic group (e.g., pyridyl, pyrrolyl, tetrahydrophenyl, thienyl, furyl, pentahydrooxazinyl etc.) and so forth.

Use of a dye in which any one of carbon atoms of the methine group has a substituent provides favorable effects. That is, high spectral sensitivity can be generally obtained, the dye has a property that it is readily breached in a processing bath, and staining by residual color is reduced.

The electron-withdrawing group represented by $E^{11}$ or $E^{12}$ in $=C(E^{11})(E^{12})$ represented by $W^1$ is selected from groups showing a Hammett's ,p value of 0.3 or more. Specific examples thereof include a cyano group, a carbamoyl group (e.g., carbamoyl, morpholinocarbamoyl, N-methylcarbamoyl etc.), an alkoxycarbonyl group (e.g., methoxycarbonyl, ethoxycarbonyl etc.), a sulfamoyl group (e.g., sulfamoyl, morpholinosulfonyl, N,N-dimethylsulfamoyl etc.), an acyl group (e.g., acetyl, benzoyl etc.), a sulfonyl group (e.g., methanesulfonyl, ethanesulfonyl, benzenesulfonyl, toluenesulfonyl etc.) and so forth.

The Hammett's ,p value is a constant of substituent obtained by Hammett et al. from effect of the substituent on hydrolysis of benzoic acid ester and is described in detail in Journal of Organic Chemistry, vol. 23, 420–427 (1958); Jikken Kagaku Koza (Lecture of Experimental Chemistry), vol. 14 (Maruzen Shuppan); Physical Organic Chemistry (McGraw Hill Book, 1940); Drug Design vol. VII (Academic Press, New York, 1976); Yakubutsu no Kozo Kassei Sokan (Structural Activity Correlation of Drugs) (Nankodo, 1979) and so forth.

Examples of the keto ring or acidic heterocyclic ring formed with $E^{11}$ and $E^{12}$ bonding to each other in $=C(E^{11})(E^{12})$ include, for example, rings represented by the following formulas:

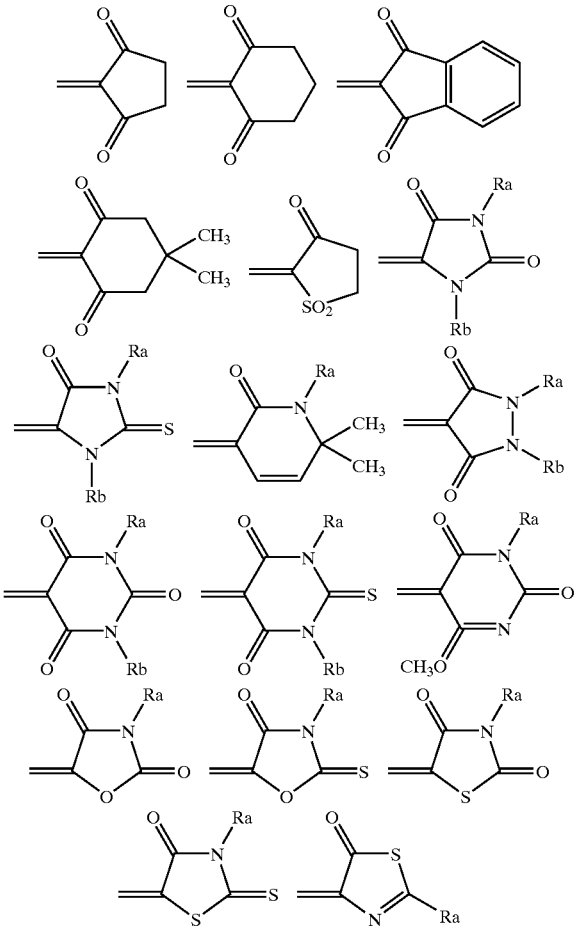

In the formula, Ra and Rb each represent a lower alkyl group, an aryl group or a heterocyclic group. Examples of the lower alkyl group include, for example, a substituted or unsubstituted lower alkyl group such as methyl, ethyl, propyl, 2-hydroxyethyl, 2-methoxyethyl, trifluoroethyl, allyl, carboxymethyl, carboxyethyl, 2-sulfoethyl and benzyl, examples of the aryl group include, for example, a phenyl group, and examples of the heterocyclic group include, for example, a pyridyl group (2-, 4-), a pyrazyl group, a furyl group (2-), a thienyl group (2-), a sulfolanyl group, a tetrahydrofuryl group, a piperidinyl group, a pyrrole group, an imidazolyl group and so forth.

$M^1$ represents an ion required to offset the charge of the molecule. Specific examples of cation include, for example, a proton, an organic ammonium ion (e.g., triethylammonium ion, triethanolammonium ion etc.) and an inorganic cation (e.g., cations of lithium, sodium, calcium etc.), and examples of acidic anion include, for example, a halogen ion (e.g., chloride ion, bromide ion, iodide ion etc.), p-toluenesulfonate ion, perchlorate ion, boron tetrafluoride ion and so forth.

$n^{11}$ is a number required to neutralize the total charge of the molecule with $M^1$. When the dye molecule forms an intramolecular salt, the charge of the molecule does not need to be offset and thus $n^{11}$ is 0.

Among the spectral sensitization dyes represented by the formula (I), spectral sensitization dyes represented by the following formula (Ia) are preferred.

Formula (Ia)

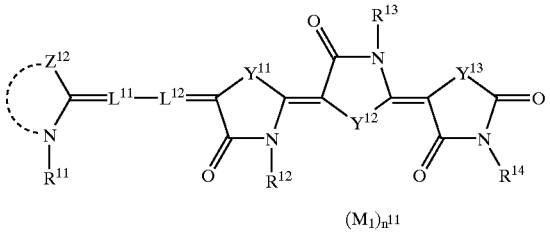

In the formula, $Y^{11}$, $Y^{12}$, $Y^{13}$, $R^{11}$, $R^{12}$, $R^{13}$, $L^{11}$, $L^{12}$, $M^1$ and $n^{11}$ have the same meanings as $Y^{11}$, $Y^{12}$, $Y^{13}$, $R^{11}$, $R^{12}$, $R^{13}$, $L^{11}$, $L^{12}$, $M^1$ and $n^{11}$ in the formula (I), respectively. $R^{14}$ represents an aliphatic group, an aryl group or a heterocyclic group. However, at least three of $R^1$, $R^{12}$, $R^{13}$ and $R^{14}$ have a water-solubilizable group. $Z^{12}$ represents a nonmetallic atom group required to form a 5- or 6-membered nitrogen-containing heterocyclic ring. The 5- or 6-membered nitrogen-containing heterocyclic ring formed with of $Z^{12}$ may have a condensed ring.

Specific examples of the spectral sensitization dyes represented by the formula (I) are mentioned below. However, the spectral sensitization dyes represented by the formula (I) that can be used by the present invention are not limited to these.

I-1

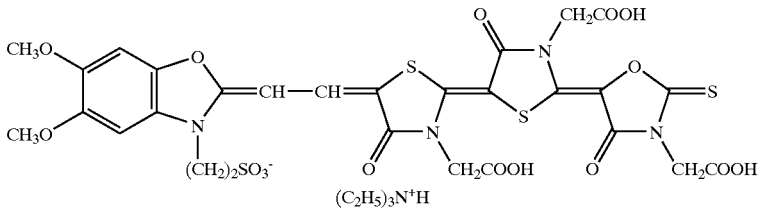

I-2

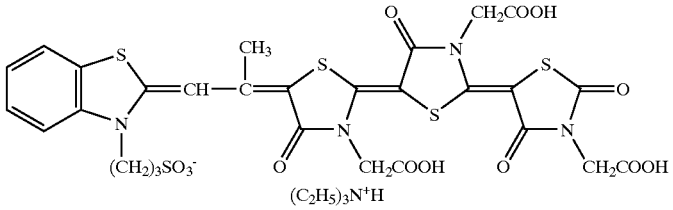

-continued
I-3
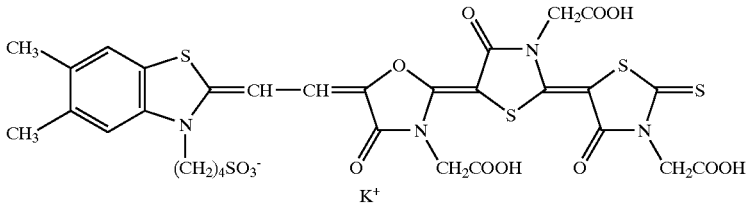
I-4
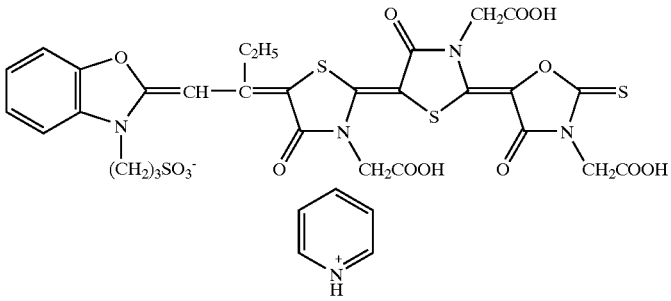
I-5
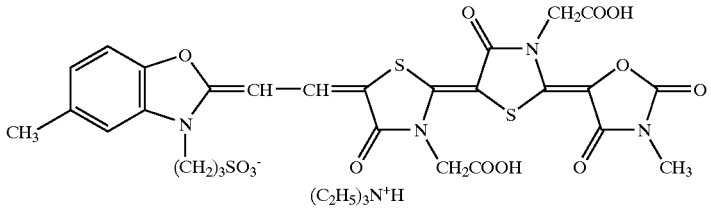
I-6
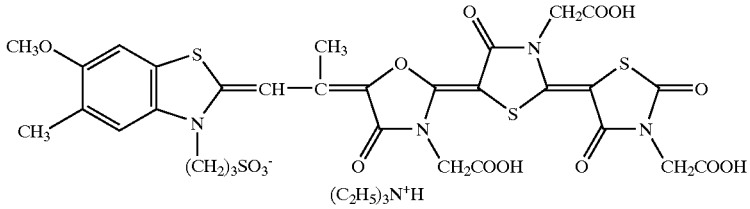
I-7
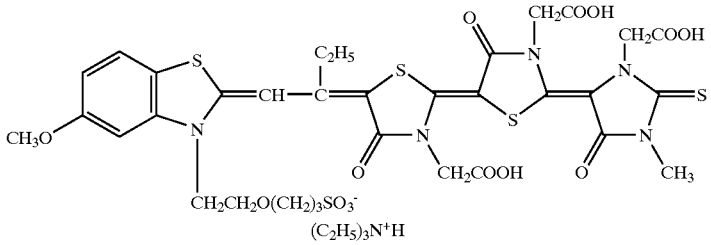
I-8
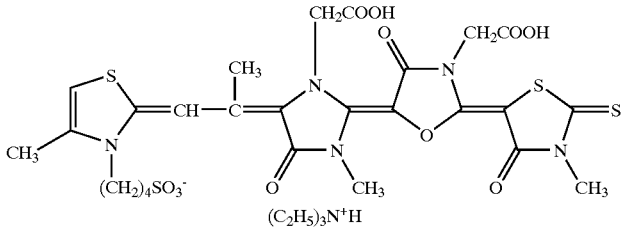

-continued
I-9
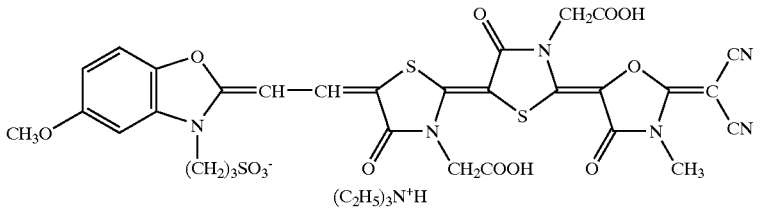
$(C_2H_5)_3N^+H$
I-10
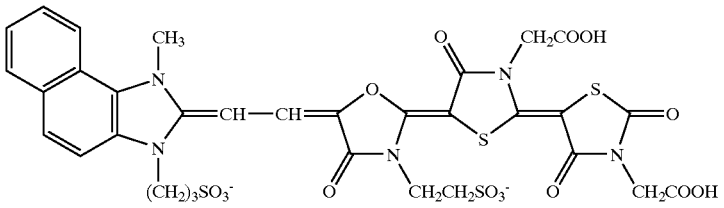
$2[(C_2H_5)_3N^+H]$
I-11
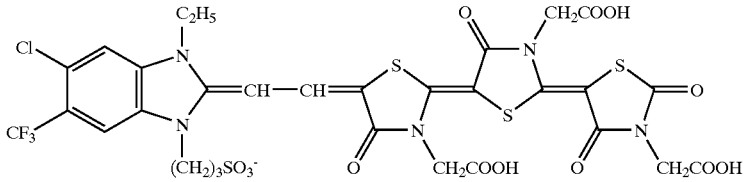
$(C_2H_5)_3N^+H$
I-12
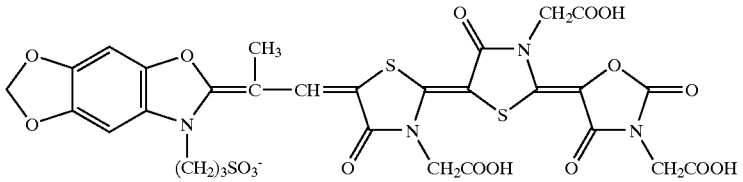
$(C_2H_5)_3N^+H$
I-13
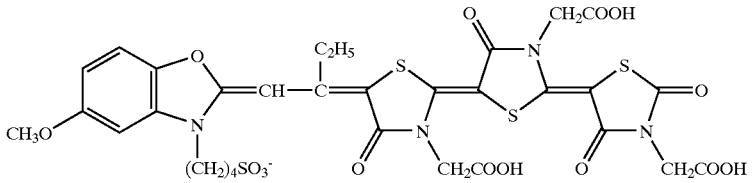
$(C_2H_5)_3N^+H$
I-14
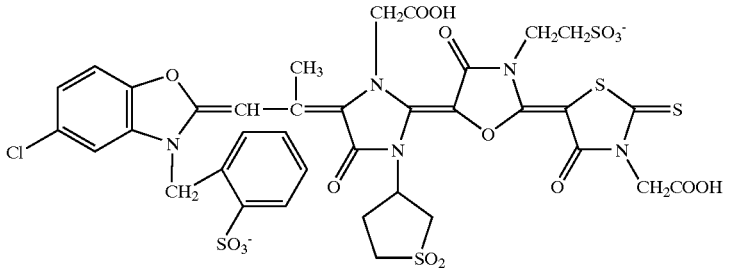
$2[(C_2H_5)_3N^+H]$
I-15
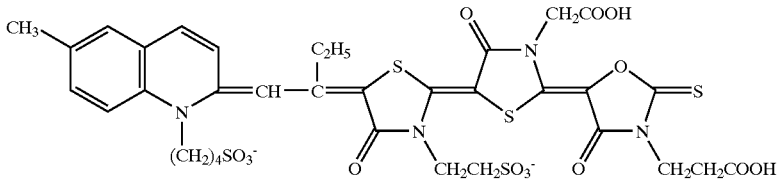
$2[(C_2H_5)_3N^+H]$ -continued
I-16
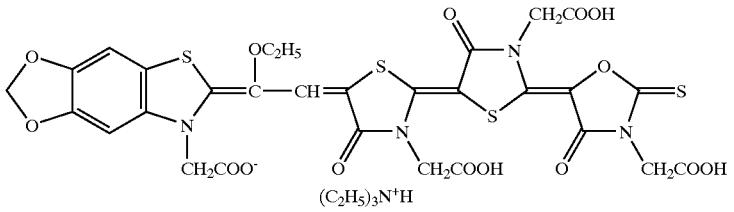
I-17
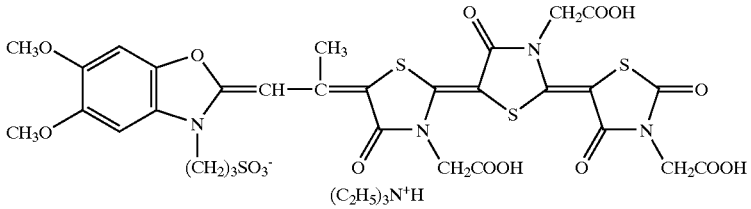
I-18
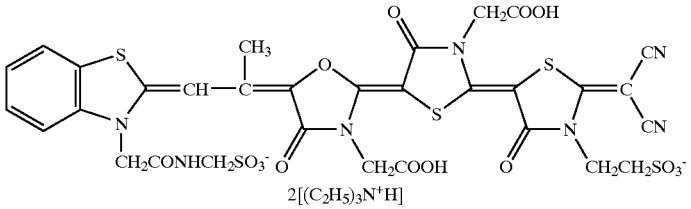
I-19
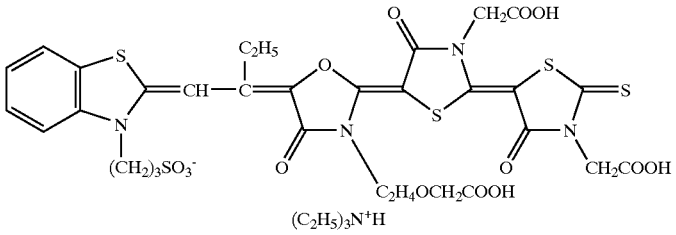
I-20
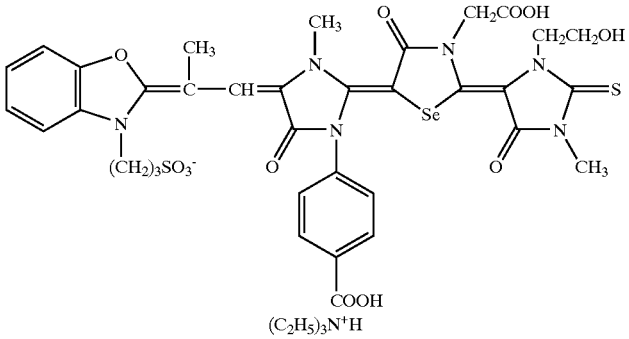
I-21
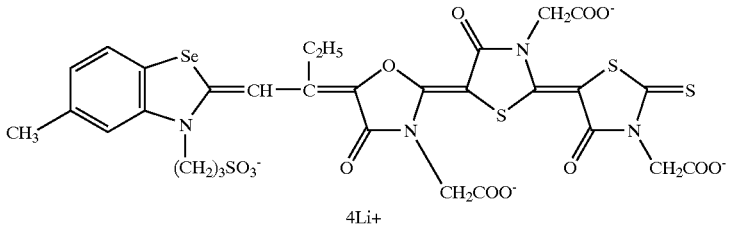

-continued
I-22
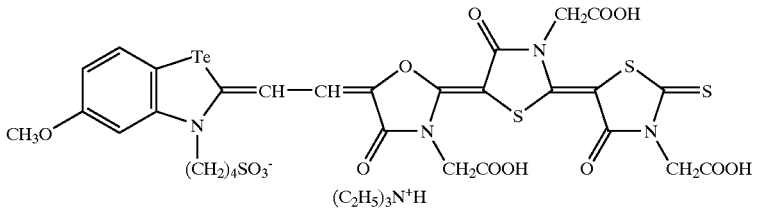
I-23
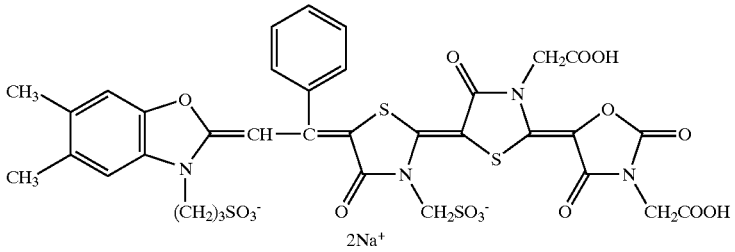
I-24
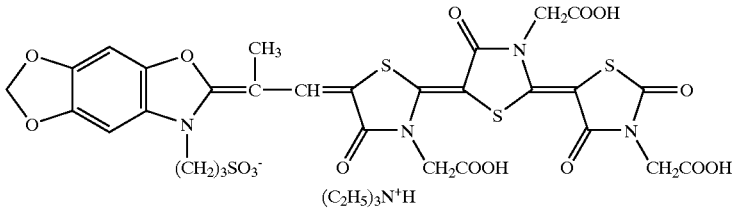
I-25
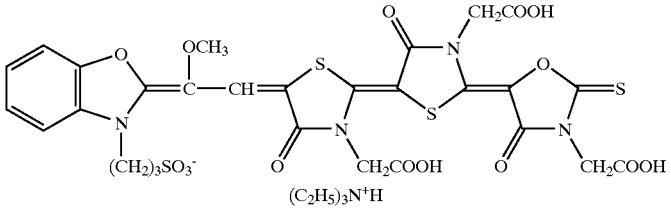
I-26
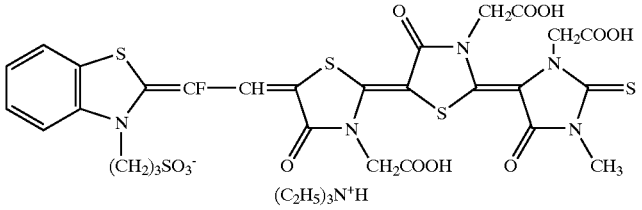
I-27
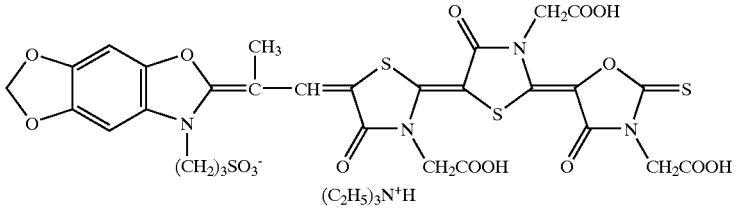
I-28
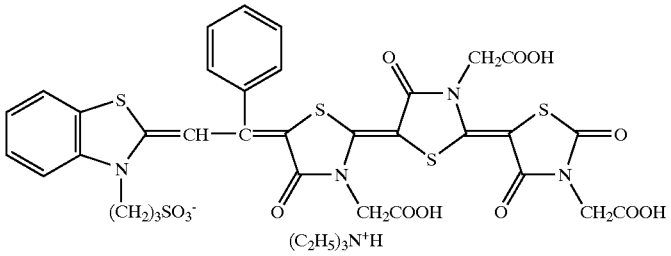

-continued

I-29

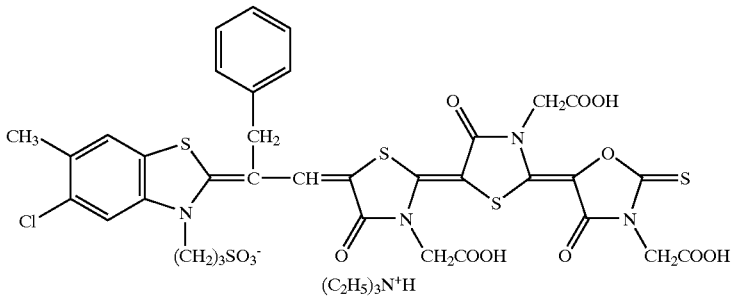

The compounds represented by the formula (II) used for the present invention will be explained hereafter. Examples of the water-solubilizable group of the aliphatic group having 8 or less carbon atoms and a water-solubilizable group, which is represented by $R^{21}$, include an acidic group such as a sulfo group, a carboxy group, a phosphono group, a sulfate group and a sulfino group. Examples of the aliphatic group having 8 or less carbon atoms include, for example, a branched or straight alkyl group (e.g., methyl, ethyl, n-propyl, n-pentyl, isobutyl etc.), an alkenyl group having 3–8 carbon atoms (e.g., 3-butenyl, 2-propenyl etc.) and an aralkyl group having 3–8 carbon atoms (e.g., benzyl, phenethyl etc.).

As for the group represented by $R^2$ in $=N(R^2)$ represented by $Y^{21}$ or $Y^{22}$, $R^{22}$ or $R^{23}$, examples of the aliphatic group include, for example, a branched or straight alkyl group having 1–8 carbon atoms (e.g., methyl, ethyl, n-propyl, n-pentyl, isobutyl etc.), an alkenyl group having 3–8 carbon atoms (e.g., 3-butenyl, 2-propenyl etc.) and an aralkyl group having 3–8 carbon atoms (e.g., benzyl, phenethyl etc.), examples of the aryl group include, for example, a phenyl group, and examples of the a heterocyclic group include, for example, a pyridyl group (2-, 4-), a pyrazyl group, a furyl group (2-), a thienyl group (2-), a sulfolanyl group, a tetrahydrofuryl group, a piperidinyl group, a pyrrole group, an imidazolyl group etc.

At least two of $R^{22}$, $R^{23}$ and $R^2$ have a water-solubilizable group. Examples of the water-solubilizable group of $R^{22}$, $R^{23}$ and $R^2$ include, for example, an acidic group such as a sulfo group, a carboxy group, a phosphono group, a sulfate group and a sulfino group.

Each of the groups of $R^{21}$, $R^{22}$, $R^{23}$ and $R^2$ may have another substituent. Examples of the substituent include a halogen atom (e.g., fluorine atom, chlorine atom, bromine atom etc.), an alkoxy group (e.g., methoxy group, ethoxy group etc.), an aryloxy group (e.g., phenoxy group, p-tolyloxy group etc.), a cyano group, a carbamoyl group (e.g., carbamoyl group, N-methylcarbamoyl group, N,N-tetramethylenecarbamoyl group etc.), a sulfamoyl group (e.g., sulfamoyl group, N,N-3-oxapentamethyleneaminosulfonyl group etc.), a methanesulfonyl group, an alkoxycarbonyl group (e.g., ethoxycarbonyl group, butoxycarbonyl group etc.), an aryl group (e.g., phenyl group, carboxyphenyl group etc.), an acyl group (e.g., acetyl group, benzoyl group etc.) and so forth.

Specific examples of the aliphatic group having a water-solubilizable group include carboxymethyl, sulfoethyl, sulfopropyl, sulfobutyl, sulfopentyl, 3-sulfobutyl, 6-sulfo-3-oxahexyl, ,-sulfopropoxycarbonylmethyl, ,-sulfopropylaminocarbonylmethyl, N-ethyl-N-sulfopropyl, 3-sulfinobutyl, 3-phosphonopropyl, 4-sulfo-3-butenyl, 2-carboxy-2-propenyl, o-sulfobenzyl, p-sulfophenethyl, p-carboxybenzyl and so forth, specific examples of the aryl group having a water-solubilizable group include p-sulfophenyl group, p-carboxyphenyl group and so forth, and specific examples of the heterocyclic group having a water-solubilizable group include 4-sulfothienyl group, 3-carboxypyridyl group and so forth.

$R^{21}$ is preferably an alkyl group substituted with a sulfo group, and it is preferred that at least two of $R^{22}$, $R^{23}$ and $R^2$ should be carboxymethyl groups.

Examples of the 5- or 6-membered nitrogen-containing heterocyclic ring and 5- or 6-membered nitrogen-containing heterocyclic ring having a condensed ring, which are formed with $Z^{21}$, include basic heterocyclic rings forming cyanine dyes. Examples of these heterocyclic rings include, for example, an oxazole ring (oxazole, benzoxazole, naphthooxazole etc.), a thiazole ring (e.g., thiazolidine, thiazole, benzothiazole, naphthothiazole etc.), an imidazole ring (e.g., imidazole, benzimidazole, naphthoimidazole etc.), a selenazole ring (e.g. selenazole, benzoselenazole, naphthoselenazole etc.), a tellurazole ring (e.g., tellurazole, benzotellurazole, naphthotellurazole etc.), a pyridine ring (e.g., pyridine, quinoline etc.) and a pyrrole ring (e.g., pyrrole, indole, indolenine etc.).

These heterocyclic rings may have a substituent at an arbitrary position, and examples of the substituent include, for example, a halogen atom (fluorine atom, chlorine atom, bromine atom, iodine atom), a trifluoromethyl group, an alkoxy group (e.g., an unsubstituted alkoxy group such as methoxy, ethoxy and butoxy, a substituted alkoxy group such as 2-methoxyethoxy and benzyloxy), a hydroxy group, a cyano group, an aryloxy group (e.g., a substituted or unsubstituted aryloxy group such as phenoxy and tolyloxy), an aryl group (e.g., a substituted or unsubstituted aryl group such as phenyl, p-chlorophenyl, p-tolyl and p-methoxyphenyl), a stilyl group, a heterocyclic group (e.g., furyl, thienyl etc.), a carbamoyl group (e.g., carbamoyl, N-ethylcarbamoyl etc.), a sulfamoyl group (e.g., sulfamoyl, N,N-dimethylsulfamoyl etc.), an acylamino group (e.g., acetylamino, propionylamino, benzoylamino etc.), an acyl group (e.g., acetyl, benzoyl etc.), an alkoxycarbonyl group (e.g., ethoxycarbonyl etc.), a sulfonamido group (e.g., methanesulfonylamido, benzenesulfonamido etc.), a sulfonyl group (e.g., methanesulfonyl, p-toluenesulfonyl etc.), a carboxy group, an alkyl group (e.g., an arbitrary alkyl group such as methyl, ethyl and isopropyl).

Examples of the substituent on a carbon atom of the methine group represented by $L^{21}$, $L^{22}$, $L^{23}$ or $L^{24}$ include, for example, a lower alkyl group (e.g., methyl, ethyl etc.), a phenyl group (e.g., phenyl, carboxyphenyl etc.), an alkoxy group (e.g., methoxy, ethoxy etc.), an aryloxy group (e.g., phenoxy, carboxyphenoxy etc.), an aralkyl group (e.g., benzyl etc.), a fluorine atom, a heterocyclic group (e.g., pyridyl, pyrrolyl, tetrahydrophenyl, thienyl, furyl, pentahydrooxazinyl etc.) and so forth.

Examples of the aromatic group or aromatic heterocyclic group represented by Ar in =N(Ar) represented by $W^2$ include, for example, a phenyl group, a pyridyl group (2-, 4-), a pyrazyl group, a furyl group (2-), a thienyl group (2-), a pyrrole group, an imidazolyl group and so forth.

The electron-withdrawing group represented by $E^{21}$ or $E^{22}$ in =C ($E^{21}$)($E^{22}$) represented by $W^2$ is selected from groups showing a Hammett's ,p value of 0.3 or more. Specific examples thereof include a cyano group, a carbamoyl group (e.g., carbamoyl, morpholinocarbamoyl, N-methylcarbamoyl etc.), an alkoxycarbonyl group (e.g., methoxycarbonyl, ethoxycarbonyl etc.), a sulfamoyl group (e.g., sulfamoyl, morpholinosulfonyl, N,N-dimethylsulfamoyl etc.), an acyl group (e.g., acetyl, benzoyl etc.), a sulfonyl group (e.g., methanesulfonyl, ethanesulfonyl, benzenesulfonyl, toluenesulfonyl etc.) and so forth.

The Hammett's ,p value is a constant of substituent obtained by Hammett's et al. from effect of the, substituent on hydrolysis of benzoic acid ester and is describe in detail in Journal of Organic Chemistry, vol. 23, 420–427 (1958); Jikken Kagaku Koza (Lecture of Experimental Chemistry), vol. 14 (Maruzen Shuppan); Physical Organic Chemistry (McGraw Hill Book, 1940); Drug Design vol. VII (Academic Press, New York, 1976); Yakubutsu no Kozo Kassei Sokan (Structural Activity Correlation of Drugs) (Nankodo, 1979) and so forth.

Examples of the keto ring or acidic heterocyclic ring formed with $E^{21}$ and $E^{22}$ bonding to each other in =C($E^{21}$)($E^{22}$) include, for example, rings represented by the following formulas:

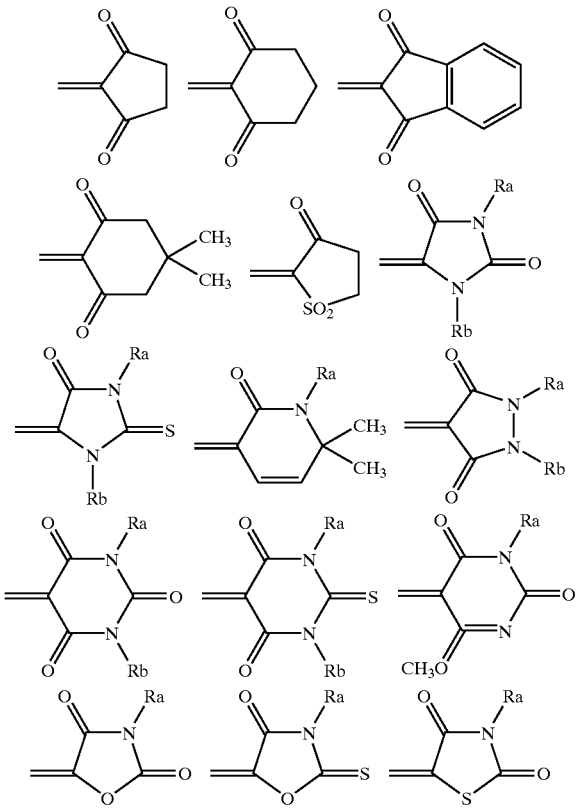

-continued

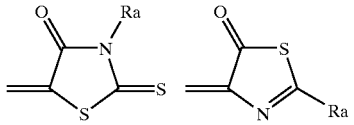

In the formula, Ra and Rb each represent a lower alkyl group, an aryl group or a heterocyclic group. Examples of the lower alkyl group include, for example, substituted or unsubstituted lower alkyl group such as methyl, ethyl, propyl, 2-hydroxyethyl, 2-methoxyethyl, trifluoroethyl, allyl, carboxymethyl, carboxyethyl, 2-sulfoethyl and benzyl, examples of the aryl group include, for example, a phenyl group, and examples of the heterocyclic group include, for example, a pyridyl group (2-, 4-), a pyrazyl group, a furyl group (2-), a thienyl group (2-), a sulfolanyl group, a tetrahydrofuryl group, a piperidinyl group, a pyrrole group, an imidazolyl group and so forth.

$M^2$ represents an ion required to offset the charge of the molecule. Specific examples of cation include, for example, a proton, an organic ammonium ion (e.g., triethylammonium ion, triethanolammonium ion etc.) and an inorganic cation (e.g., cations of lithium, sodium, calcium etc.), and examples of acidic anion include, for example, a halogen ion (e.g., chloride ion, bromide ion, iodide ion etc.), p-toluenesulfonate ion, perchlorate ion, boron tetrafluoride ion and so forth.

$n^{21}$ is a number required to neutralize the total charge of the molecule with $M^2$. When the dye molecule forms an intramolecular salt, the charge of the molecule does not need to be offset and thus $n^{21}$ is 0.

Among the spectral sensitization dyes represented by the formula (II), spectral sensitization dyes represented by the following formula (IIa) are preferred.

Formula (IIa)

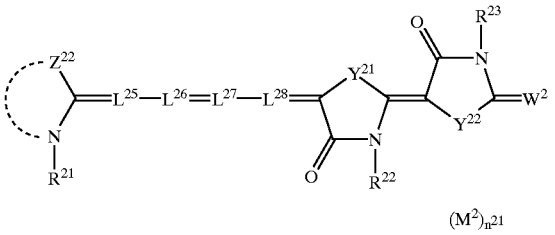

In the formula, $Y^{21}$, $Y^{22}$, $R^{21}$, $R^{22}$, $R^{23}$, $M^2$ and $n^{21}$ have the same meanings as $Y^{21}$, $Y^{22}$, $R^{21}$, $R^{22}$, $R^{23}$, $M^2$ and $n^{21}$ in the formula (II), respectively. $Z^{22}$ represents a nonmetallic atom group required to form a 5- or 6-membered nitrogen-containing heterocyclic ring. The 5- or 6-membered nitrogen-containing heterocyclic ring formed with $Z^{22}$ may have a condensed ring. $L^{25}$, $L^{26}$, $L^{27}$ and $L^{28}$ each independently represent a substituted or unsubstituted methine group, and at least one of $L^{25}$, $L^{26}$, $L^{27}$ and $L^{28}$ has a substituent.

In the formula (IIa), examples of the substituent on a carbon atom of the methine group represented by $L^{25}$, $L^{26}$, $L^{27}$ and $L^{28}$ include, for example, a lower alkyl group (e.g., methyl, ethyl etc.), a phenyl group (e.g., phenyl, carboxyphenyl etc.), an alkoxy group (e.g., methoxy, ethoxy etc.), an aryloxy group as (e.g., phenoxy, carboxyphenoxy etc.), an aralkyl group (e.g., benzyl etc.), a fluorine atom, a heterocyclic group (e.g., pyridyl, pyrrolyl, tetrahydrophenyl, thienyl, furyl, pentahydrooxazinyl etc.) and so forth.

Examples of the 5- or 6-membered nitrogen-containing heterocyclic ring and 5- or 6-membered nitrogen-containing heterocyclic ring having a condensed ring formed with $Z^{22}$ are similar to the examples of the 5- or 6-membered nitrogen-containing heterocyclic ring and 5- or 6-membered nitrogen-containing heterocyclic ring having a condensed ring formed with $Z^{21}$ in the formula (II).

Specific examples of the spectral sensitization dyes represented by the formula (II) are mentioned below. However, the spectral sensitization dyes represented by the formula (II) that can be used by the present invention are not limited to these.

II-1

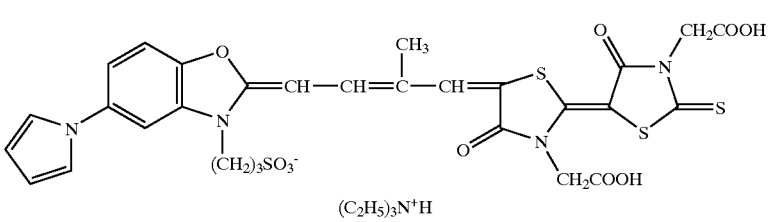

II-2

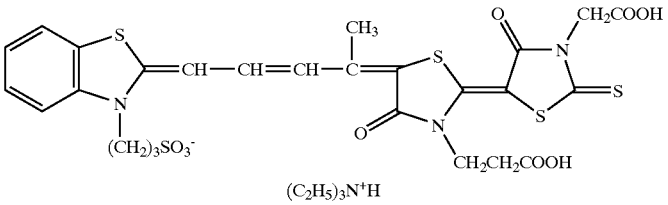

II-3

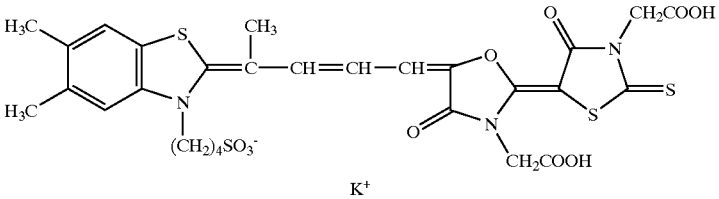

II-4

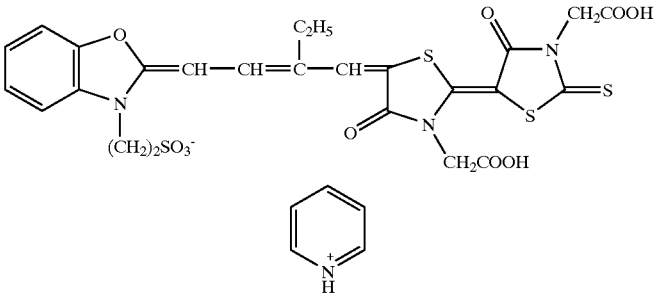

II-5

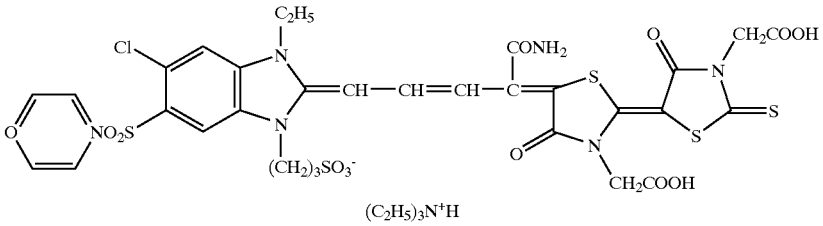

II-6

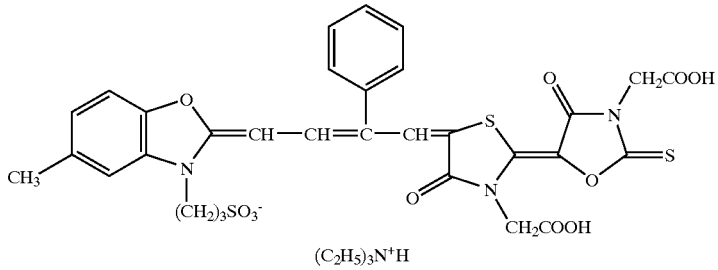

-continued
II-7
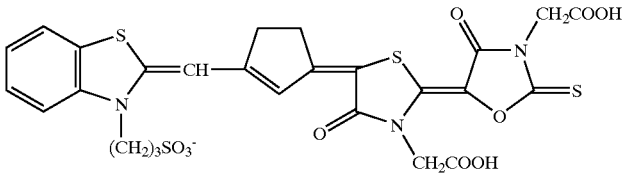
$(C_2H_5)_3N^+H$
II-8
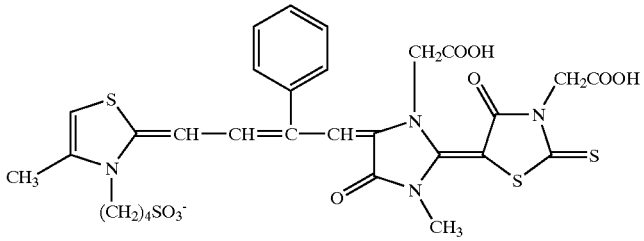
$(C_2H_5)_3N^+H$
II-9
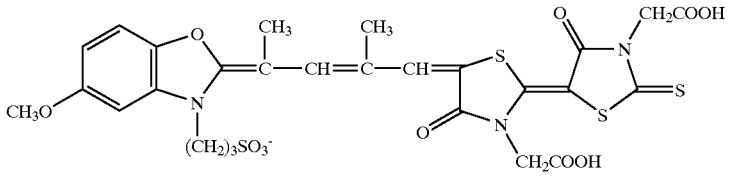
$(C_2H_5)_3N^+H$
II-10
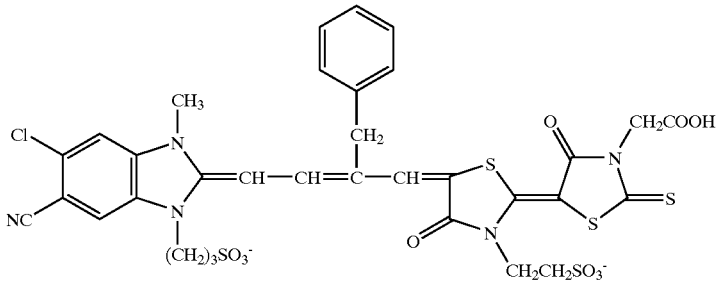
$2[(C_2H_5)_3N^+H]$
II-11
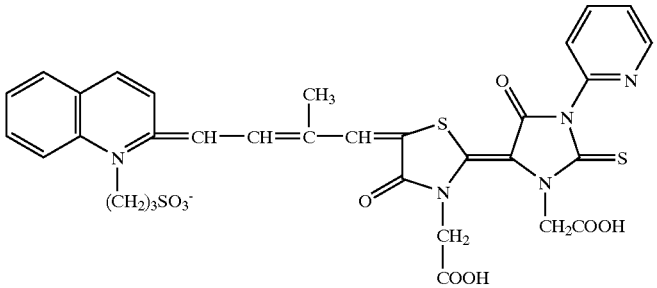
$(C_2H_5)_3N^+H$
II-12
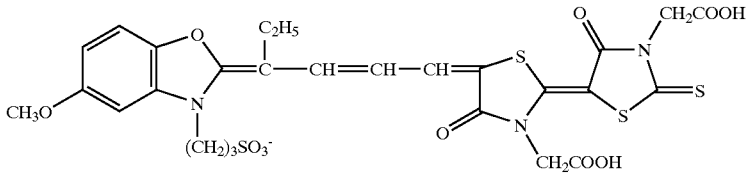
$(C_2H_5)_3N^+H$ -continued
II-13
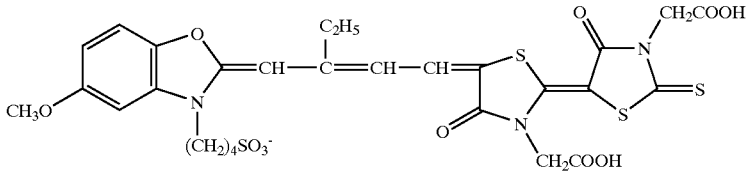
$(C_2H_5)_3N^+H$
II-14
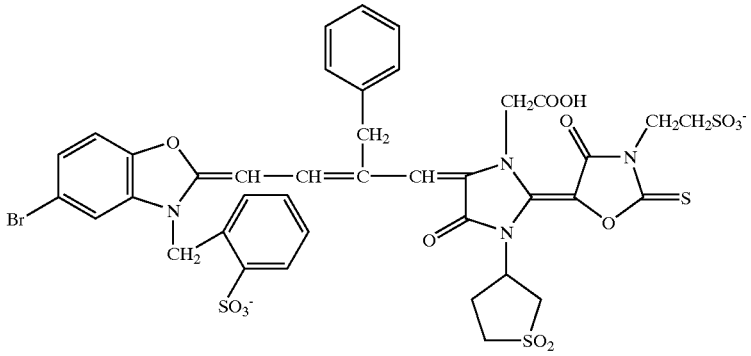
$2[(C_2H_5)_3N^+H]$
II-15
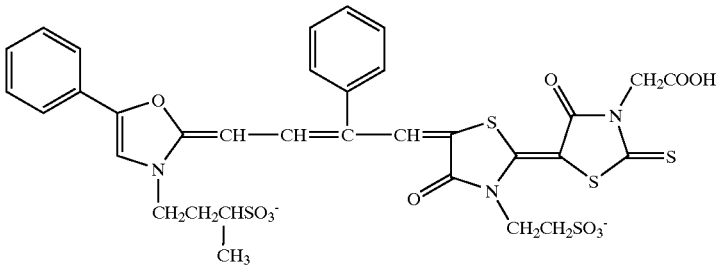
$2[(C_2H_5)_3N^+H]$
II-16
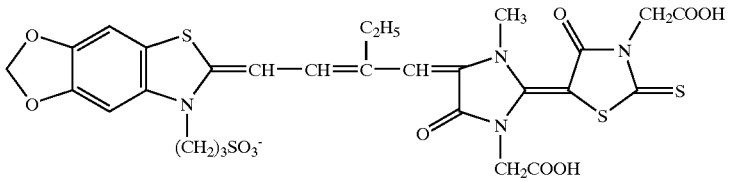
$(C_2H_5)_3N^+H$
II-17
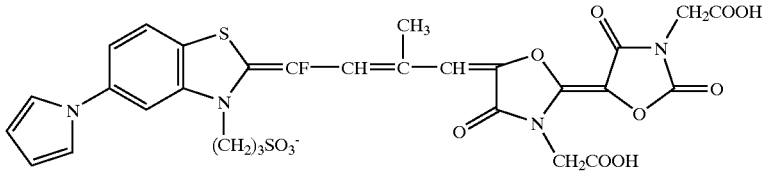
$(C_2H_5)_3N^+H$
II-18
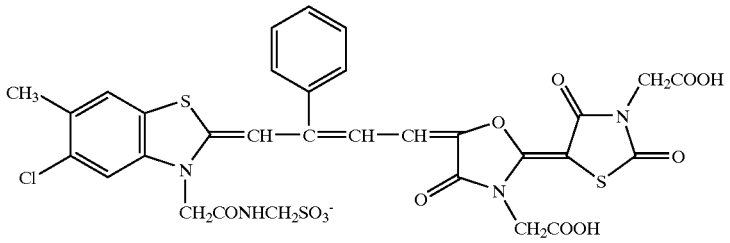
$(C_2H_5)_3N^+H$ -continued
II-19
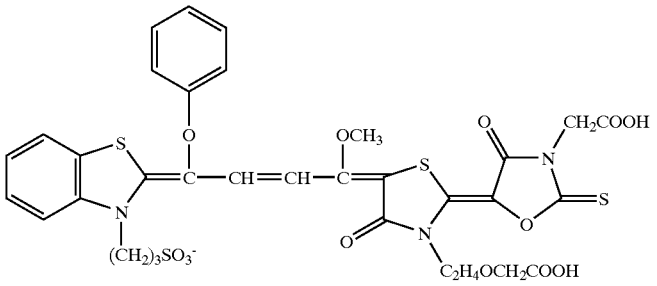
$(C_2H_5)_3N^+H$
II-20
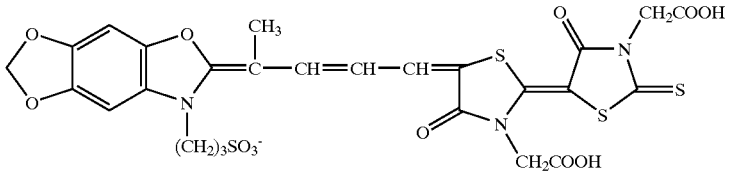
$(C_2H_5)_3N^+H$
II-21
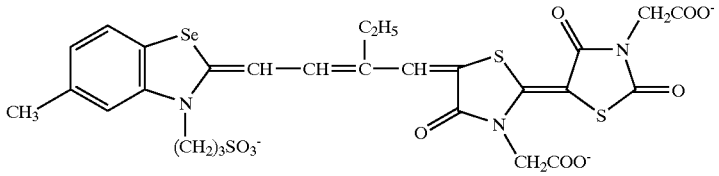
$3Li^+$
II-22
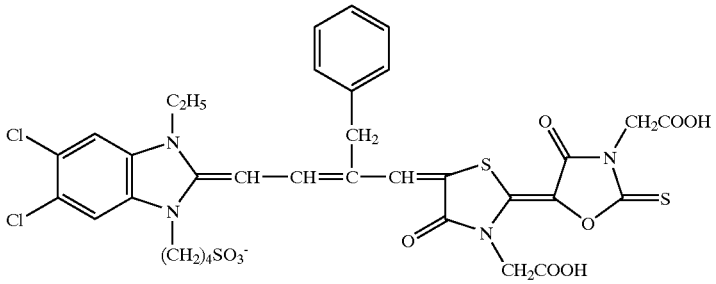
$(C_2H_5)_3N^+H$
II-23
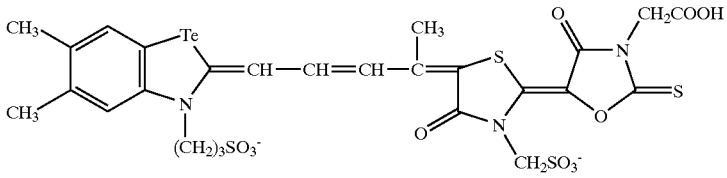
$2\ Na^+$
II-24
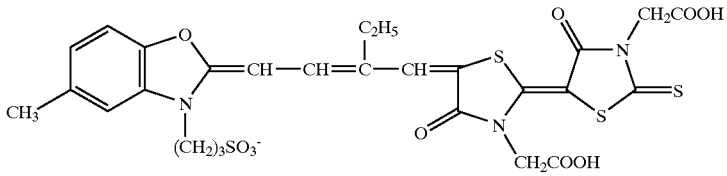
$(C_2H_5)_3N^+H$ -continued

II-25

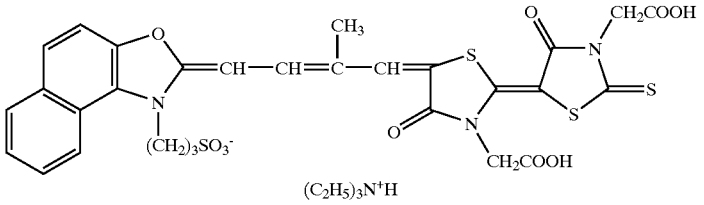

II-26

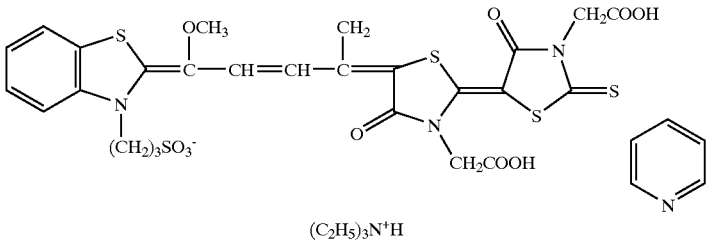

II-27

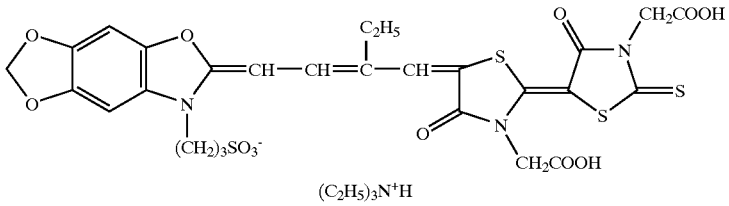

II-28

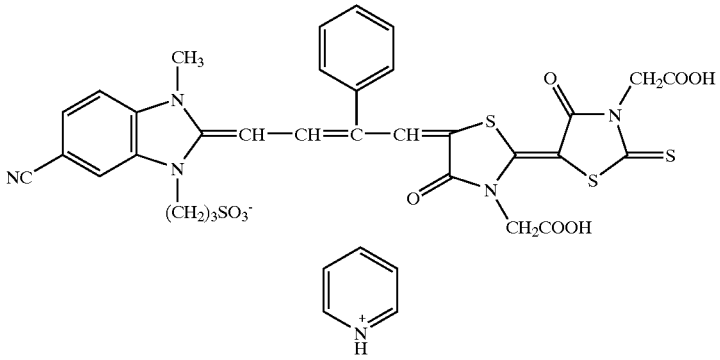

II-29

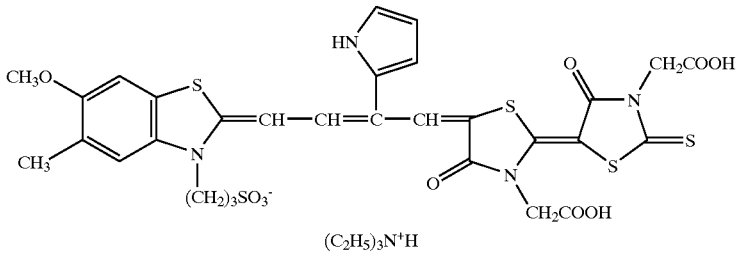

The aforementioned compounds can be readily synthesized by referring to known methods described in F. M. Hamer, Cyanine Dyes and Related Compounds, Interscience Publishers, 1964; J.C.S., 1954, 1490–1501; U.S. Pat. Nos. 2,454,629, 2,493,748, British Patent No. 489,335, EP730, 008A and so forth.

As for specific synthesis examples, Preparation Examples 1 and 2 mentioned later can be referred to. The exemplary compounds other than the compounds synthesized in Preparation Examples 1 and 2 can be synthesized in a manner similar to those described in the preparation examples.

The compounds represented by the formula (III) used for the present invention will be explained hereafter. $R^{31}$ and $R^{32}$ represent an alkyl group. However, at least one of the alkyl groups has a water-soluble group. The water-soluble group is a group for imparting water solubility to the compound, and the water-soluble group preferably has such water solubility that at least 0.5 g of the compound should be dissolved in 1 L of water at room temperature. Specific examples of $R^{31}$ and $R^{32}$ include the following groups. Among these, alkyl groups having an acidic group are preferred.

$$—Q^{31}—COOM^{31}, \qquad —Q^{31}—SO_3M^{31},$$

-continued $$-Q^{31}-\overset{O}{\overset{\|}{C}}NHSO_2R^{33},\qquad -Q^{31}-PO_3M^{31},$$

$$-Q^{31}-N(R^{33})_2,\qquad -Q^{31}-\overset{+}{N}(R^{33})_3$$

In the formula, $Q^{31}$ represents an alkylene group, an arylene group or an alkenylene group. $M^{31}$ represents a hydrogen atom, an ammonium, an alkali metal (e.g., sodium, potassium), an alkaline earth metal (e.g., calcium) or an organic amine salt (e.g., triethylamine salt, 1,8-diazabicyclo [5.4.0]-7-undecene salt). $R^{33}$ represents an alkyl group or an aryl group. Preferred as $Q^{31}$ are an alkylene group (e.g., methylene group, ethylene group, propylene group, butylene group, pentylene group), an arylene group (e.g., phenylene group), an alkenylene group (e.g., propenylene group) and a group consisting of a combination of these.

These groups may further contain one or more groups selected from an amido group, an ester group, a sulfoamido group, a sulfonic acid ester group, a ureido group, a sulfonyl group, a sulfinyl group, a thioether group, an ether group, a carbonyl group and an amino group. Specific examples of $Q^{31}$ are mentioned below.

$$-(CH_2)_n-\quad n=1\sim5,\qquad -(CH_2)_2-\underset{CH_3}{\underset{|}{CH}}-,$$

$$-CH_2-C_6H_4-,\qquad -CH_2COO(CH_2)_2-,$$

$$-CH_2\overset{OH}{\overset{|}{C}}HCH_2-,\qquad -CH_2\overset{O}{\overset{\|}{C}}NH-(CH_2)_2-,$$

$$-(CH_2)_2-NH\overset{O}{\overset{\|}{C}}NH(CH_2)_2-$$

Other than the above, the bridging groups described in EP472,004A, pages 5–7 can be used. Particularly preferred are methylene group, ethylene group, propylene group and butylene group.

As for the groups represented by $R^{33}$, examples of the alkyl group include, for example, methyl group, ethyl group and hydroxyethyl group, and examples of the aryl group include, for example, phenyl group and 4-chlorophenyl group.

$R^{31}$ is preferably a sulfoalkyl group (e.g., 4-sulfobutyl group, 3-sulfobutyl group, 3-sulfopropyl group, 2-sulfoethyl group). $R^{32}$ is preferably a carboxyalkyl group (e.g., carboxymethyl group, 2-carboxyethyl group). $R^{31}$ is more preferably 2-sulfoethyl group, and $R^{32}$ is more preferably carboxymethyl group.

Although $V^{31}$, $V^{32}$, $V^{33}$ and $V^{34}$ may represent a hydrogen atom or any monovalent substituent, they preferably represent a hydrogen atom, an alkyl group (e.g., methyl group, ethyl group, propyl group), a substituted alkyl group (e.g., hydroxymethyl group), an alkoxy group (e.g., methoxy group, ethoxy group), a halogen atom (e.g., fluorine atom, chlorine atom), a hydroxy group, an acyl group (e.g., acetyl group), a carbamoyl group, a carboxy group or a cyano group, more preferably a hydrogen atom, an alkyl group (e.g., methyl group) or an alkoxy group (e.g., methoxy group), particularly preferably a hydrogen atom. The sum of molecular weight means a simple sum of the molecular weights of $V^{31}$, $V^{32}$, $V^{33}$ and $V^{34}$. For example, when $V^{31}$, $V^{32}$, $V^{33}$ and $V^{34}$ all represent a hydrogen atom, the sum is 4, and when $V^{31}$, $V^{32}$ and $V^{34}$ represent a hydrogen atom and $V^{33}$ represent a phenyl group, the sum is 77.

$L^{31}$, $L^{32}$, $L^{33}$ and $L^{34}$ represent a methine group or a substituted methine group {for example, a methine group substituted with a substituted or unsubstituted alkyl group (e.g., methyl group, ethyl group, n-propyl group, i-propyl group, cyclopropyl group, butyl group, 2-carboxyethyl group), a substituted or unsubstituted aryl group (e.g., phenyl group, naphthyl group, anthryl group, o-carboxyphenyl group), a heterocyclic group (e.g., pyridyl group, thienyl group, furano group, barbituric acid), a halogen atom (e.g., chlorine atom, bromine atom), an alkoxy group (e.g., methoxy group, ethoxy group), an amino group (e.g., N,N-diphenylamino group, N-methyl-N-phenylamino group, N-methylpiperazino group), an alkylthio group (e.g., methylthio group, ethylthio group) or the like}. They may form a ring with another methine group, or may form a ring with an auxochrome.

$L^{31}$, $L^{32}$ and $L^{34}$ preferably represent an unsubstituted methine group. $L^{33}$ preferably represents a methine group substituted with an unsubstituted alkyl group (e.g., methyl group, ethyl group), more preferably a methine group substituted with methyl group.

$M^3$ represents an ion required to offset the charge of the molecule. Specific examples of cation include, for example, a proton, an organic ammonium ion (e.g., triethylammonium ion, triethanolammonium ion etc.) and an inorganic cation (e.g., cations of lithium, sodium, calcium etc.), and examples of acidic anion include, for example, a halogen ion (e.g., chloride ion, bromide ion, iodide ion etc.), p-toluenesulfonate ion, perchlorate ion, boron tetrafluoride ion and so forth.

$n^{31}$ is a number required to neutralize the total charge of the molecule with $M^3$. When the dye molecule forms an intramolecular salt, the charge of the molecule does not need to be offset and thus $n^{31}$ is 0.

In the formula (III), particularly preferred combinations of substituents consist of hydrogen atoms as $V^{31}$, $V^{32}$, $V^{33}$ and $V^{34}$, a sulfoalkyl group or a salt thereof, preferably a sulfoethyl group or a salt thereof, as $R^{31}$, a carboxyalkyl group or a salt thereof, preferably a carboxymethyl group or a salt thereof, as $R^{32}$, methine groups as $L^{31}$, $L^{32}$ and $L^{34}$, and a methine group substituted with methyl group as $L^{33}$. Such compounds can be represented by the following formula (III-a)

Formula (III-a)

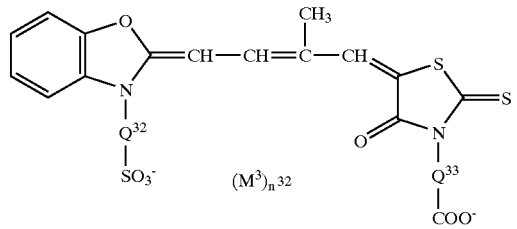

In the formula, $M^3$ has the same meaning as $M^3$ in the formula (III), and those mentioned as preferred examples of $M^3$ in the formula (III) are preferred. More preferred is a sodium ion. $n^{32}$ has the same meaning as $n^{31}$. $Q^{32}$ and $Q^{33}$ have the same meanings as $Q^{31}$, and they preferably represent an alkylene group (e.g., methylene group, ethylene group, propylene group, butylene group). $Q^{32}$ is more preferably an ethylene group, and $Q^{33}$ is particularly preferably a methylene group.

Typical examples of the compounds represented by the formula (III) are mentioned below. However, the compounds that can be used for the present invention are not limited to these examples.

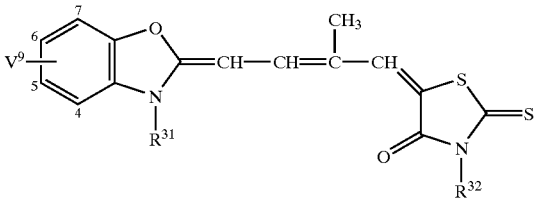

$M^{91}m^{91}$

| 化合物No. | $R^{31}$ | $R^{32}$ | $V^9$ | $M^{91}$ | $m^{91}$ |
|---|---|---|---|---|---|
| III-1 | $(CH_2)_2SO_3^-$ | $CH_2CO_2^-$ | H | $Na^+$ | 2 |
| III-2 | $(CH_2)_2SO_3^-$ | $CH_2CO_2^-$ | H | $K^+$ | 2 |
| III-3 | $(CH_2)_2SO_3^-$ | $CH_2CO_2^-$ | H | $(C_2H_5)_3N^+H$ | 2 |
| III-4 | $(CH_2)_4SO_3^-$ | $CH_2CO_2^-$ | H | $(C_2H_5)_3N^+H$ | 2 |
| III-5 | $(CH_2)_3SO_3^-$ | $CH_2CO_2^-$ | H | $(C_2H_5)_3N^+H$ | 2 |
| III-6 | $(CH_2)_2CH(CH_3)SO_3^-$ | $CH_2CO_2^-$ | H | $(C_2H_5)_3N^+H$ | 2 |
| III-7 | $(CH_2)_4SO_3^-$ | $CH_2CO_2^-$ | 5-$OCH_3$ | $(C_2H_5)_3N^+H$ | 2 |
| III-8 | $(CH_2)_4SO_3^-$ | $CH_2CO_2^-$ | 5-F | $Na^+$ | 2 |
| III-9 | $(CH_2)_2SO_3^-$ | $CH_2CO_2^-$ | 5-$CH_3$ | $Na^+$ | 2 |
| III-10 | $(CH_2)_2SO_3^-$ | $CH_2CO_2^-$ | 5,6-$(CH_2)_2$ | $Na^+$ | 2 |
| III-11 | $(CH_2)_4SO_3^-$ | $(CH_2)_2SO_3^-$ | H | $K^+$ | 2 |
| III-12 | $CH_2CO_2^-$ | $CH_2CO_2^-$ | H | $Na^+$ | 2 |
| III-13 | $CH_2CO_2^-$ | $(CH_2)_2SO_3^-$ | H | $Na^+$ | 2 |
| III-14 | $(CH_2)_3SO_3^-$ | $(CH_2)_2SO_3^-$ | H | $Na^+$ | 2 |
| III-15 | $(CH_2)_4SO_3^-$ | $(CH_2)_2OH$ | H | $K^+$ | 1 |
| III-16 | $(CH_2)_4SO_3^-$ | $(CH_2)_2CO_2^-$ | H | $K^+$ | 2 |
| III-17 | $(CH_2)_4SO_3^-$ | $(CH_2)_3CO_2^-$ | H | $K^+$ | 2 |
| III-18 | $(CH_2)_4SO_3^-$ | $(CH_2)_5CO_2^-$ | H | $K^+$ | 2 |
| III-19 | $(CH_2)_4SO_3^-$ | $(CH_2)_2NHC(=O)CH_3$ | H | K | 1 |

III-20

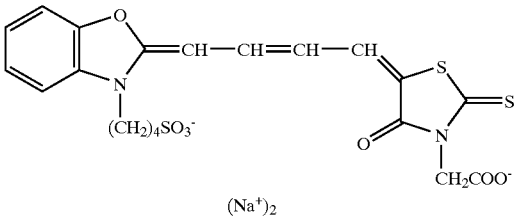

$(Na^+)_2$

III-21

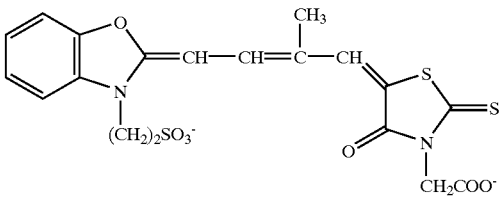

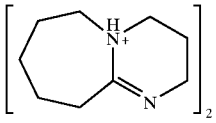

-continued
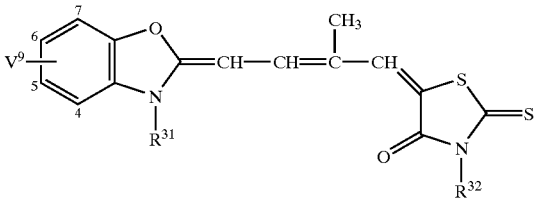
$M^{91}m^{91}$
| 化合物No. | $R^{31}$ | $R^{32}$ | $V^9$ | $M^{91}$ | $m^{91}$ |
|---|---|---|---|---|---|
| III-22 | 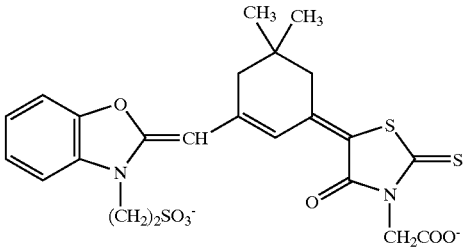 | | | $(Na^+)_2$ | |
| III-23 | 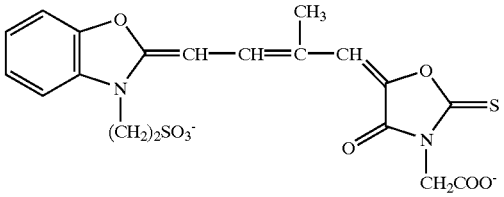 | | | $(Na^+)_2$ | |
| III-24 | 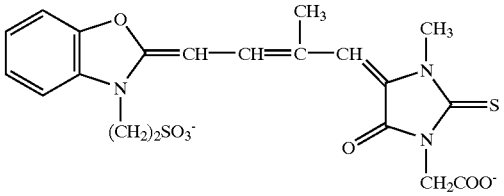 | | | $(Na^+)_2$ | |
| III-25 | 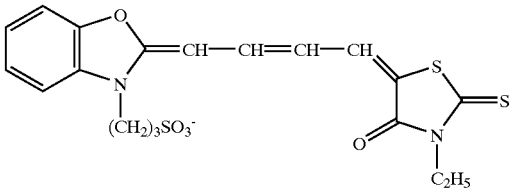 | | | $\overset{+}{H}N(C_2H_5)_3$ | |
| III-26 | 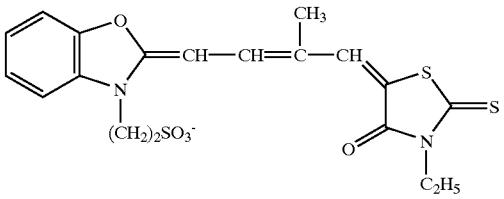 | | | $Na^+$ | |

-continued

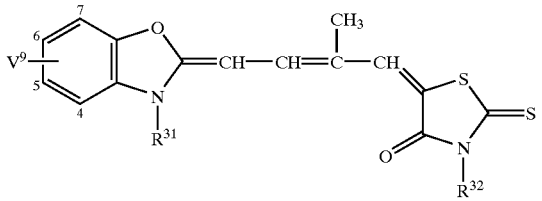

$M^{91}m^{91}$

| 化合物No. | $R^{31}$ | $R^{32}$ | $V^9$ | $M^{91}$ | $m^{91}$ |
|---|---|---|---|---|---|
| III-27 | 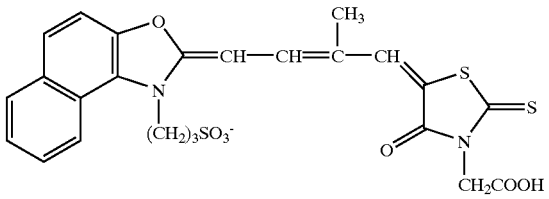 | | | | |

The compounds represented by the formula (III) can be synthesized by the methods described in M. Hamer, Heterocyclic Compounds Cyanine Dyes and Related Compounds, John Wiley & Sons Co., New York, London, 1964; D. M. Sturmer, Heterocyclic Compounds—Special topics in heterocyclic chemistry, Chapter 18, Section 14, pages 482–515, John Wiley & Sons, New York, London, 1977; Rodd'S Chemistry of Carbon Compounds, 2nd Ed., Vol. IV, Part B, Chapter 15, pages 369–422, 1977 and 2nd Ed., Vol. TV, Part B, Chapter 15, pages 267–296, 1985, Elsevier Science Publishing Company Inc., New York and so forth.

The compounds represented by the formula (IV) used for the present invention will be explained hereafter. In the formula (IV), $Z^{41}$ represents an atomic group required to complete a 5- or 6-membered heterocyclic ring, which may have a condensed ring, and the atomic group is preferably an atomic group for completing oxazole ring, benzoxazole ring, naphthooxazole ring, thiazole ring, benzothiazole ring, naphthothiazole ring, imidazole ring, benzimidazole ring, naphthoimidazole ring, pyridine ring, quinoline ring, 1,3,4-thiadiazole ring, thiazoline ring, selenazole ring, benzoselenazole ring, naphthoselenazole ring, benzotellurazole ring or naphthotellurazole ring.

The spectral sensitization dyes represented by the formula (IV) have at least three water-solubilizable groups, and they preferably have water-solubilizable groups at least on $R^{44}$, $R^{45}$ and $R^{46}$, more preferably one water-solubilizable group on each of $R^{44}$, $R^{45}$ and $R^{46}$. Further, they may have four or more water-solubilizable groups, and in such a case, it is preferred that at least three of $R^{41}$, $R^{44}$, $R^{45}$ and $R^{46}$ or all of the four each have a water-solubilizable group. Each group preferably has only one water-solubilizable group. However, the water-solubilizable group may not necessarily exist on a particular group, and for example, $R^{41}$, $R^{42}$ and $R^{43}$ may have one or more acidic substituents or salts thereof.

Among the spectral sensitization dyes represented by the formula (IV), spectral sensitization dyes represented by the following formula (IVa) are preferred.

Formula (IVa)

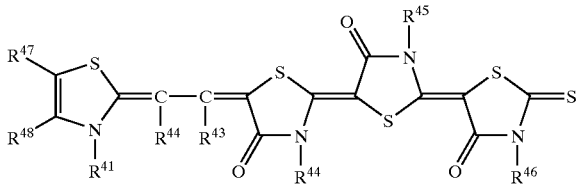

$(M^4)_{n41}$

In the formula, $R^{41}$, $R^{42}$, $R^{43}$, $R^{44}$, $R^{45}$, $R^{46}$, $M^4$ and $n^{41}$ have the same meanings as $R^{41}$, $R^{42}$, $R^{43}$, $R^{44}$, $R^{45}$, $R^{46}$, $M^4$ and $n^{41}$ in the formula (IV), respectively.

$R^{47}$ and $R^{48}$ each independently represent an alkyl group, an alkenyl group, an alkoxy group, an alkylthio group, an acyl group, an acyloxy group, an alkoxycarbonyl group, an alkylsulfonyl group, a carbamoyl group, a sulfamoyl group, an aryl group, an arylthio group, a hetero aromatic group, a hydrogen atom, a hydroxy group, a halogen atom, a carboxy group or a cyano group. $R^{41}$ and $R^{42}$ may together represent an atomic group required to form a benzene ring, a naphthalene ring or an anthracene ring.

$R^{41}$, $R^{42}$, $R^{43}$, $R^{44}$, $R^{45}$, $R^{46}$, $R^{47}$ and $R^{48}$ do not have another aromatic ring group as a substituent.

The spectral sensitization dyes represented by the formula (IVa) have at least three water-solubilizable groups.

As for the groups represented by $R^{47}$ or $R^{48}$ in the aforementioned formula (IVa), examples of the alkyl group include methyl group, ethyl group, propyl group and butyl group, examples of the alkenyl group include 3-butenyl group and 2-propenyl group, examples of the alkoxy group include methoxy group, ethoxy group, propyloxy group, and butoxy group, examples of the alkylthio group include methylthio group, ethylthio group, propylthio group and butylthio group, examples of the acyl group include methylcarbonyl group, ethylcarbonyl group, propylcarbonyl group and butylcarbonyl group, examples of the acyloxy group include methylcarbonyloxy group, ethylcarbonyloxy group, propylcarbonyloxy group and butylcarbonyloxy group, examples of the alkoxycarbonyl group include methyloxycarbonyl group, ethyloxycarbonyl group, propyloxycarbonyl group and butyloxycarbonyl group, examples of the alkylsulfonyl group include methylsulfonyl group, ethylsulfonyl group, propylsulfonyl group and butylsulfonyl group, examples of the carbamoyl group include methylcarbamoyl group, ethylcarbamoyl group, propylcarbamoyl group and butylcarbamoyl group, examples of the sulfamoyl group include methylsulfamoyl group, ethylsulfamoyl group, propylsulfamoyl group and butylsulfamoyl group, examples of the aryl group include phenyl group, examples of the arylthio group include phenylthio group, examples of the hetero aromatic group include pyridyl group, pyrrolyl group, tetrahydrophenyl group, thienyl group, furyl group and pentahydrooxazinyl group, and examples of the halogen atom include chlorine atom, fluorine atom, bromine atom and iodine atom. The aforementioned groups may further have a substituent.

The alkyl group and alkenyl group represented by $R^{41}$, $R^{42}$, $R^{43}$, $R^{44}$, $R^{45}$ or $R^{46}$ in the formula (IV) and the formula (IVa) may be an alkyl group and alkenyl group having 1–20 carbon atoms, respectively. Preferred alkyl group and alkenyl group are an alkyl group and alkenyl group having 1–10 carbon atoms, more preferred are an alkyl group and alkenyl group having 1–8 carbon atoms, and particularly preferred are an alkyl group and alkenyl group having 1–4 carbon atoms. These alkyl group and alkenyl group may be straight, branched or cyclic alkyl group and alkenyl group and may have a substituent such as a hydroxy group and a sulfo group. Specific examples of these alkyl group and alkenyl group include, for example, methyl group, ethyl group, propyl group, 2-hydroxyethyl group, 4-sulfobutyl group, 3-sulfopropyl group, 3-butenyl group and 2-propenyl group.

$R^{41}$, $R^{44}$, $R^{45}$ and $R^{46}$ preferably represent an alkyl group having 1–5 carbon atoms, and $R^{42}$ and $R^{43}$ preferably represent a hydrogen atom or an alkyl group having 1–5 carbon atoms. It is particularly preferred that $R^{42}$ represents a hydrogen atom and $R^{43}$ represents an unsubstituted alkyl group such as methyl group and ethyl group.

$M^4$ represents an ion required to offset the charge of the molecule. Specific examples of cation include, for example, a proton, an organic ammonium ion (e.g., triethylammonium ion, triethanolammonium ion etc.) and an inorganic cation (e.g., cations of lithium, sodium, calcium etc.), and examples of acidic anion include, for example, a halogen ion (e.g., chloride ion, bromide ion, iodide ion etc.), p-toluenesulfonate ion, perchlorate ion, boron tetrafluoride ion and so forth.

$n^{41}$ is a number required to neutralize the total charge of the molecule with $M^4$. When the dye molecule forms an intramolecular salt, the charge of the molecule does not need to be offset and thus $n^{41}$ is 0.

The spectral sensitization dyes represented by the formula (IV) or (IVa) have at least three water-solubilizable groups, and examples of the water-solubilizable groups include, for example, an acidic substituent or a salt thereof. Specific examples of the water-solubilizable groups include a carboxy group, a sulfo group, a phosphato group, a phosphono group, a sulfonamido group, a sulfamoyl group and an acylsulfonamido group (e.g., —$CH_2CONHSO_2CH_3$). In the formulas (IV) and (IVa), an ester that does not have an ionized or ionic proton does not fall within the scope of the water-solubilizable group.

Particularly preferred water-solubilizable groups are a carboxy group and a sulfo group (e.g., 3-sulfobutyl group, 4-sulfobutyl group, 3-sulfopropyl group, 2-sulfoethyl group, carboxymethyl group, carboxyethyl group, carboxypropyl group).

Specific examples of the substituent that the aforementioned substituents may have further include, for example, a halogen atom (e.g., chlorine atom, fluorine atom, bromine atom), an alkoxy group (especially an alkoxy group having 1–10 carbon atoms, such as methoxy group and ethoxy group), a substituted or unsubstituted alkyl group (especially an alkyl group having 1–10 carbon atoms, such as methyl group and trifluoromethyl group), an amido group or carbamoyl group (especially an amido group or carbamoyl group having 1–10 carbon atoms, more preferably 1–6 carbon atoms), an alkoxycarbonyl group (especially an alkoxycarbonyl group having 1–10 carbon atoms, more preferably an alkoxycarbonyl group having an alkyl group having 1–6 carbon atoms), a substituted or unsubstituted aryl group (especially a substituted or unsubstituted aryl group having 6–20 carbon atoms, more preferably 6–10 carbon atoms, such as phenyl group and 5-chlorophenyl group), a thioalkyl group (e.g., methylthio group, ethylthio group), a hydroxy group and an alkenyl group (especially an alkenyl group having 1–10 carbon atoms, more preferably 1–6 carbon atoms).

The spectral sensitization dyes represented by the formula (IV) provide a photosensitive silver halide emulsion showing maximum sensitivity wavelength (λmax) of about 550–750 nm, preferably 600–690 nm, most preferably 620–680 nm.

The spectral sensitization dyes represented by the formula (IV) are described in British Patent No. 489,335, and they can be synthesized by using trinucleate melocyanines as a starting material. The spectral sensitization dyes represented by the formula (IV) can also be prepared by the method described in detail in the U.S. patent application of Mee filed on Feb. 28, 1995 (Title of the invention: METHOD OF SYNTHESIZING DEYS AND PRECURSOR COMPOUNDS THEREFOR).

Specific examples of the spectral sensitization dyes represented by the formula (IV) are mentioned below. However, the spectral sensitization dyes represented by the formula (IV) that can be used for the present invention are not limited to these.

IV-1

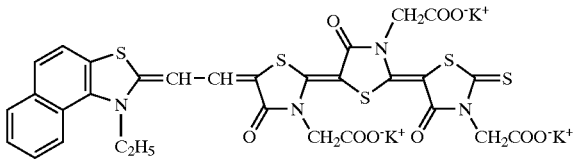

IV-2

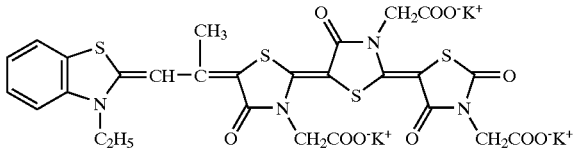

IV-3

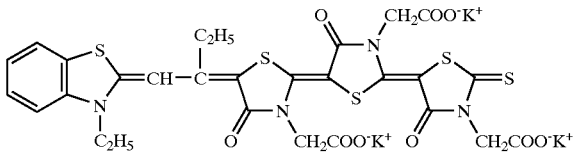

-continued

IV-4

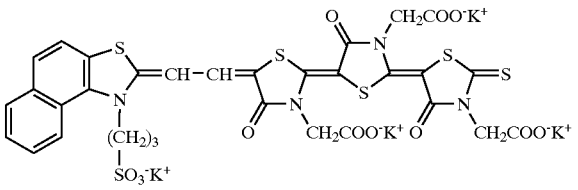

IV-5

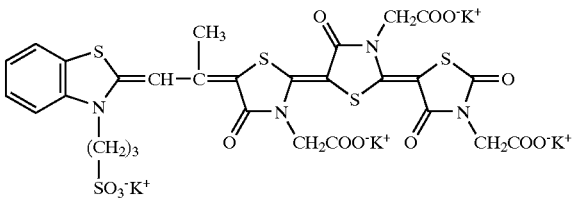

IV-6

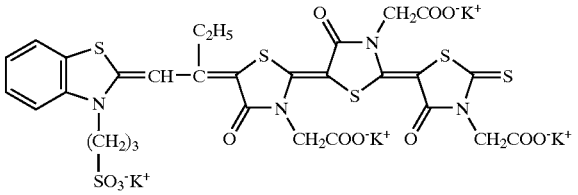

The compounds represented by the formula (V) used for the present invention will be explained hereafter. Examples of the 5- or 6-membered nitrogen-containing heterocyclic ring or 5- or 6-membered nitrogen-containing heterocyclic ring having a condensed ring formed with $Z^{51}$ or $Z^{52}$ include, for example, a thiazole ring (e.g., thiazole, 4-methylthiazole, 4-phenylthiazole, 4,5-dimethylthiazole, 4,5-diphenylthiazole etc.), a benzothiazole ring (e.g., benzothiazole, 5-chlorobenzothiazole, 6-chlorobenzothiazole, 5-methylbenzothiazole, 6-methylbenzothiazole, 5-bromobenzothiazole, 6-bromobenzothiazole, 5-iodobenzothiazole, 6-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-hydroxybenzothiazole, 5-carboxybenzothiazole, 5-fluorobenzothiazole, 5-dimethylaminobenzothiazole, 5-acetylaminobenzothiazole, 5-trifluoromethylbenzothiazole, 5,6-dimethylbenzothiazole, 5-hydroxy-6-methylbenzothiazole, 5-ethoxy-6-methylbenzothiazole, tetrahydrobenzothiazole etc.), a naphthothiazole ring (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]-thiazole etc.), a selenazole ring (e.g., 4-methylselenazole, 4-phenylselenazole etc.), a benzoselenazole ring (e.g., benzoselenazole, 5-chlorobenzoselenazole, 5-phenylbenzoselenazole, 5-methoxybenzoselenazole, 5-methylbenzoselenazole, 5-hydroxybenzoselenazole etc.), a naphthoselenazole ring (e.g., naphtho[2,1-d]selenazole, naphtho[1,2-d]selenazole etc.), an oxazole ring (e.g., oxazole, 4-methyloxazole, 5-methyloxazole, 4,5-dimethyloxazole etc.), a benzoxazole ring (e.g., benzoxazole, 5-fluorobenzoxazole, 5-chlorobenzoxazole, 5-bromobenzoxazole, 5-trifluoromethylbenzoxazole, 5-methylbenzoxazole, 5-methyl-6-phenylbenzoxazole, 5,6-dimethylbenzoxazole, 5-methoxybenzoxazole, 5,6-dimethoxybenzoxazole, 5-phenylbenzoxazole, 5-carboxybenzoxazole, 5-methoxycarbonylbenzoxazole, 5-acetylbenzoxazole, 5-hydroxybenzoxazole etc.), a naphthooxazole ring (e.g., naphtho[2,1-d]-oxazole, naphtho[1,2-d]oxazole, naphtho[2,3-d]oxazole etc.), a 2-quinoline nucleus, an imidazole nucleus, a benzimidazole ring, 3,3'-dialkylindolenine ring, a 2-pyridine ring and a thiazoline ring.

Particularly preferably, at least one of the 5- or 6-membered nitrogen-containing heterocyclic rings or 5- or 6-membered nitrogen-containing heterocyclic rings having a condensed ring formed with $Z^{51}$ and $Z^{52}$ is a thiazole ring, a thiazoline ring, an oxazole ring or a benzoxazole ring.

As for the groups represented by $R^{51}$ and $R^{52}$, examples of the alkyl group include, for example, an alkyl group having 5 or less carbon atoms (e.g., methyl group, ethyl group, n-propyl group, n-butyl group etc.), examples of the substituted alkyl group include a substituted alkyl group having 5 or less carbon atoms {e.g., a hydroxyalkyl group (e.g., 2-hydroxyethyl group, 3-hydroxypropyl group, 4-hydroxybutyl group etc.), a carboxyalkyl group (e.g., carboxymethyl group, 2-carboxyethyl group, 3-carboxypropyl group, 4-carboxybutyl group, 2-(2-carboxyethoxy) ethyl group etc.), a sulfoalkyl group (e.g., 2-sulfoethyl group, 3-sulfopropyl group, 3-sulfobutyl group, 4-sulfobutyl group, 2-hydroxy-3-sulfopropyl group, 2-(3-sulfopropoxy) ethyl group, 2-acetoxy-3-sulfopropyl group, 3-methoxy-2-(3-sulfopropoxy)propyl group, 2-[(3-sulfopropoxy) ethoxy] ethyl group, 2-hydroxy-3-(3'-sulfopropoxy)propyl group etc.), an aralkyl group (preferred is an aralkyl group of which alkyl moiety has 1–5 carbon atoms, and the aryl moiety is preferably phenyl group, e.g., benzyl group, phenethyl group, phenylpropyl group, phenylbutyl group, p-tolylpropyl group, p-methoxyphenethyl group, p-chlorophenethyl group, p-carboxybenzyl group, p-sulfophenethyl group, p-sulfobenzyl group etc.), an aryloxyalkyl group (the alkyl moiety preferably has 1–5 carbon atoms, and the aryl moiety of the aryloxy moiety is preferably phenyl group, e.g., phenoxyethyl group, phenoxypropyl group, phenoxybutyl group, p-methylphenoxyethyl group, p-methoxyphenoxypropyl group etc.), vinylmethyl group etc.}, and examples of the aryl group include a phenyl group etc.

Examples of the substituent of the substituted methine group represented by $L^{51}$, $L^{52}$ or $L^{53}$ include, for example, analkyl group (e.g., methyl group, ethyl group etc.), an substituted alkyl group {e.g., an alkoxyalkyl group (e.g., 2-ethoxyethyl group etc.), a carboxyalkyl group (e.g., 2-carboxyethyl group etc.), an alkoxycarbonylalkyl group (e.g., 2-methoxycarbonylethyl group etc.), an aralkyl group (e.g., benzyl group, phenethyl group etc.)}, an aryl group (e.g., phenyl group, p-methoxyphenyl group, p-chlorophenyl group, o-carboxyphenyl group etc.) and so forth.

Further, $L^{51}$ and $R^{51}$ or $L^{53}$ and $R^{52}$ may bond to each other at the methine chain, respectively, to form a nitrogen-containing heterocyclic ring.

Examples of the substituent on the nitrogen atom of the thiazolidinone ring or imidazolidinone ring formed with $Q^{51}$ and $Q^{52}$ together include, for example, an alkyl group (preferably an alkyl group having 1–8 carbon atoms, such as methyl group, ethyl group and propyl group), an allyl group, an aralkyl group (preferably an aralkyl group having 1–5 carbon atoms for the alkyl moiety, such as benzyl group and p-carboxyphenylmethyl group), an aryl group (preferably an aryl group having 6–9 carbon atoms in total, such as phenyl group and p-carboxyphenyl group), a hydroxyalkyl group (preferably a hydroxyalkyl group having 1–5 carbon atoms for the alkyl group moiety, such as 2-hydroxyethyl group), a carboxyalkyl group (preferably a carboxyalkyl group having 1–5 carbon atoms for the alkyl group moiety, such as carboxymethyl group), an alkoxycarbonylalkyl group (preferably an alkoxycarbonylalkyl group having 1–3 carbon atoms for the alkoxy moiety, such as methoxycarbonylethyl group) and so forth.

$M^5$ represents an ion required to offset the charge of the molecule. Specific examples of cation include, for example, a proton, an organic ammonium ion (e.g., triethylammonium ion, triethanolammonium ion etc.) and an inorganic cation (e.g., cations of lithium, sodium, calcium etc.), and examples of acidic anion include, for example, a halogen ion (e.g., chloride ion, bromide ion, iodide ion etc.), p-toluenesulfonate ion, perchlorate ion, boron tetrafluoride ion and so forth.

$n^{53}$ is a number required to neutralize the total charge of the molecule with $M^5$. When the dye molecule forms an intramolecular salt, the charge of the molecule does not need to be offset and thus $n^{53}$ is 0.

Specific examples of the spectral sensitization dyes represented by the formula (V) are mentioned below. However, the spectral sensitization dyes represented by the formula (V) that can be used for the present invention are not limited to these.

V-1

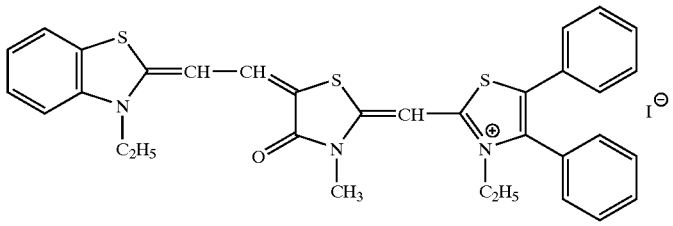

V-2

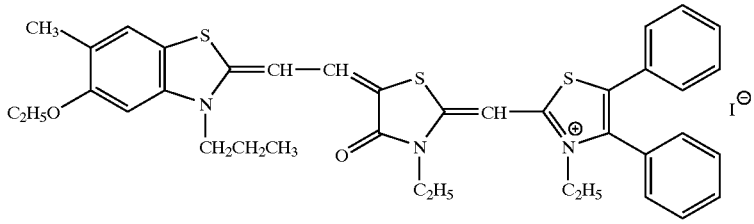

V-3

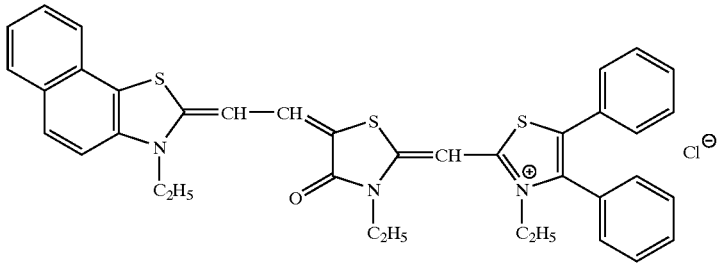

V-4

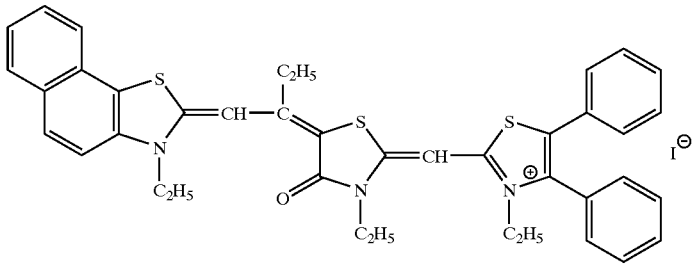

V-5

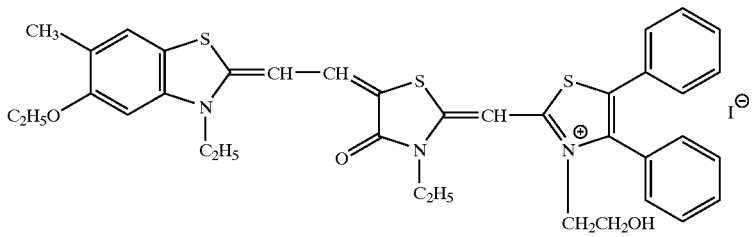

-continued
V-6
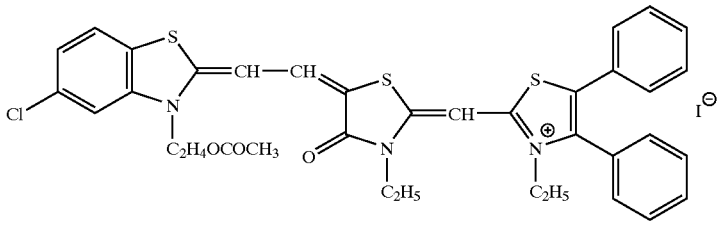
V-7
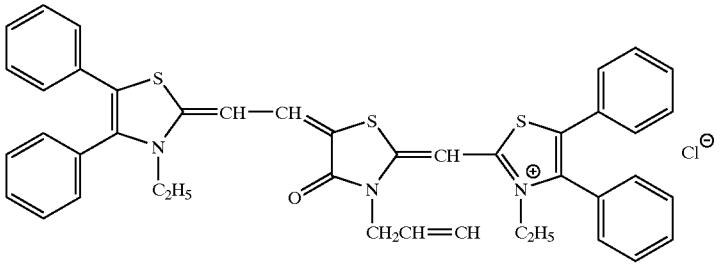
V-8
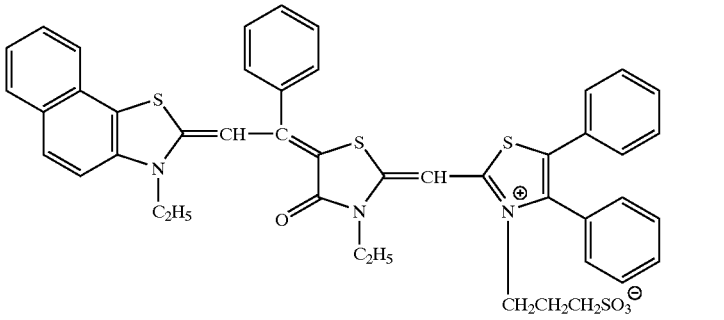
V-9
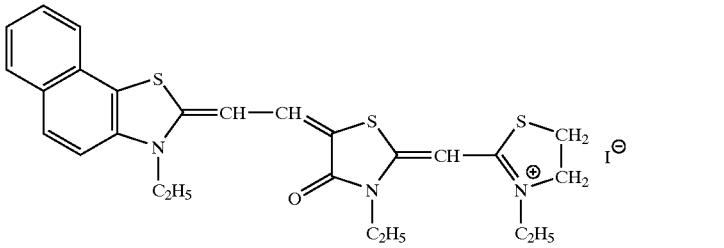
V-10
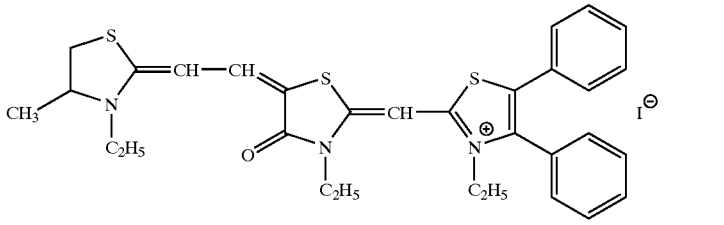
V-11
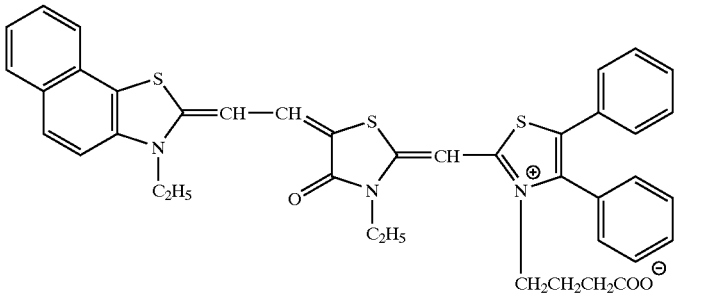

-continued
V-12
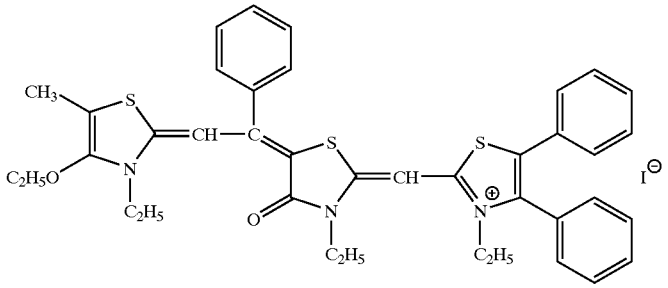
V-13
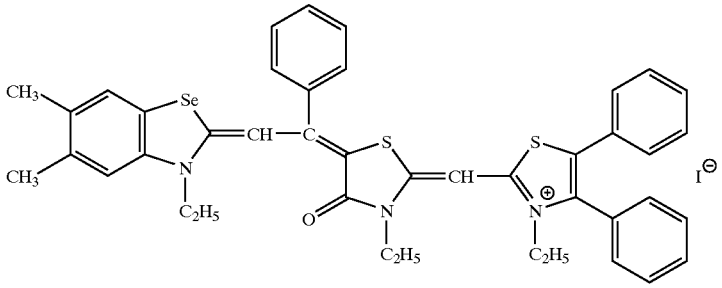
V-14
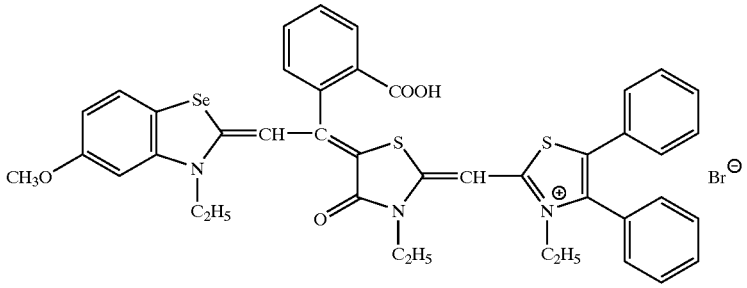
V-15
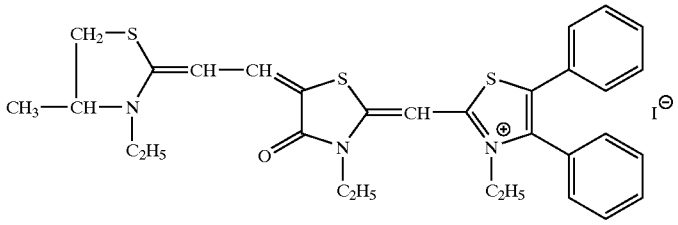
V-16
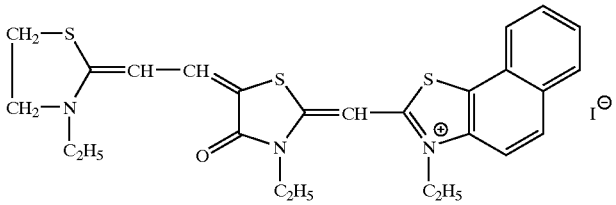
V-17
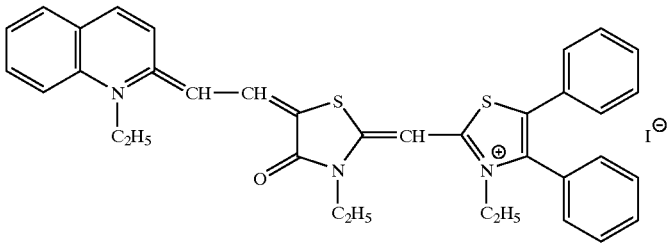

-continued
V-18
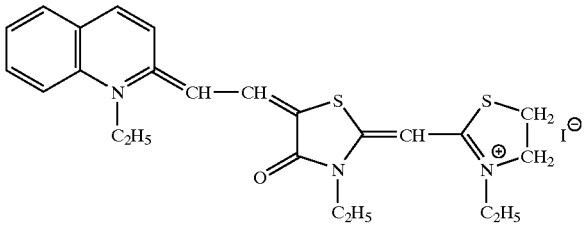
V-19
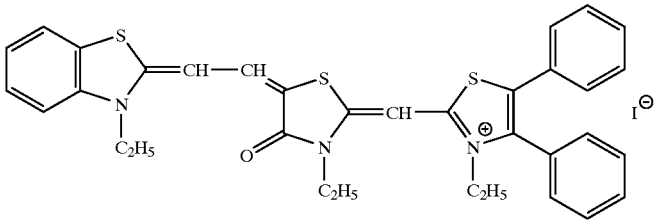
V-20
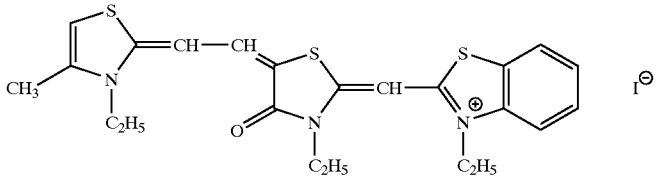
V-21
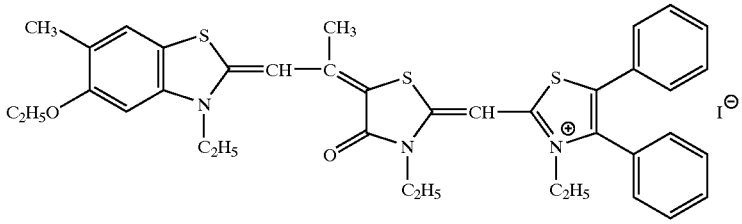
V-22
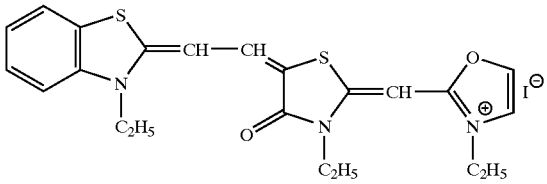
V-23
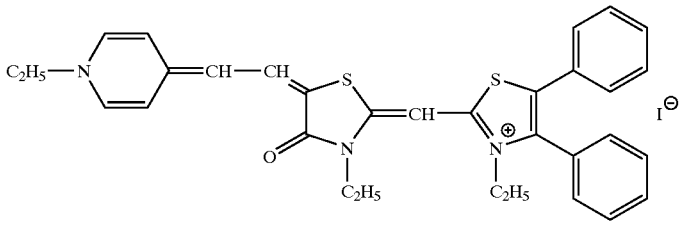
V-24
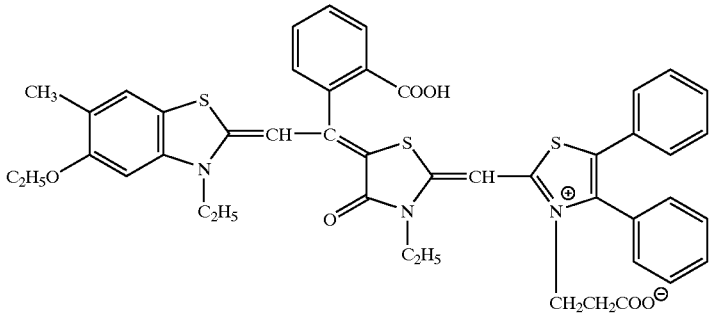

-continued
V-25
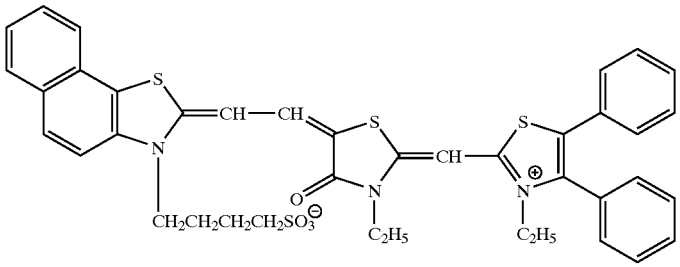
V-26
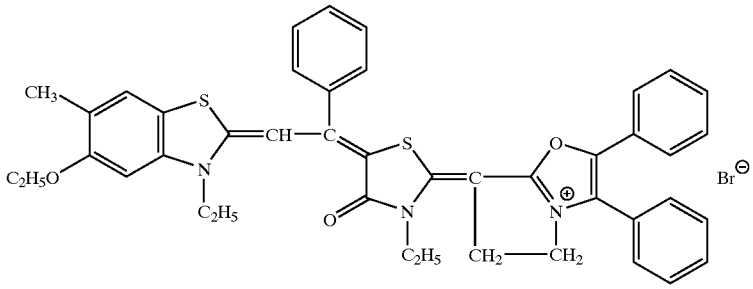
V-27
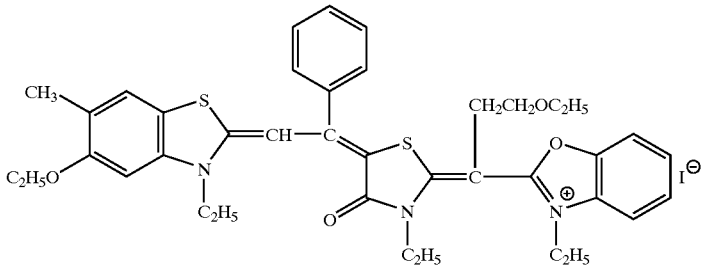
V-28
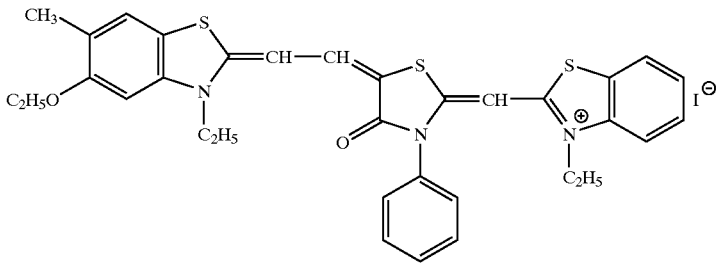
V-29
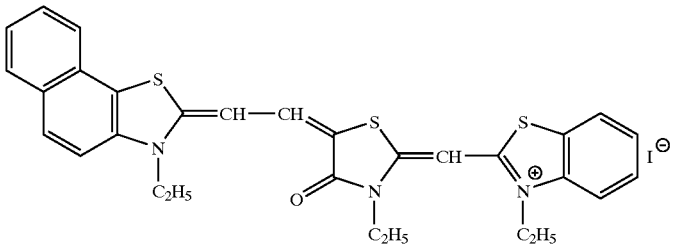
V-30
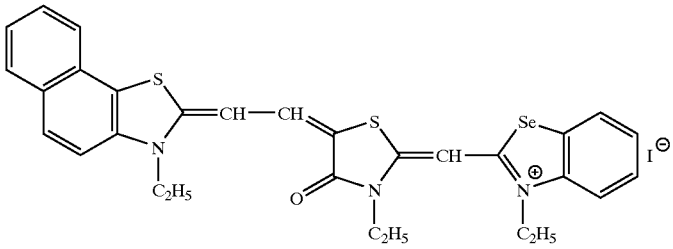

-continued
V-31
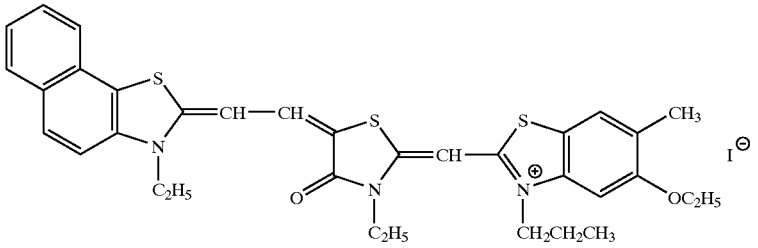
V-32
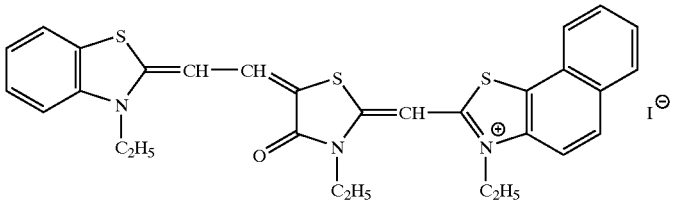
V-33
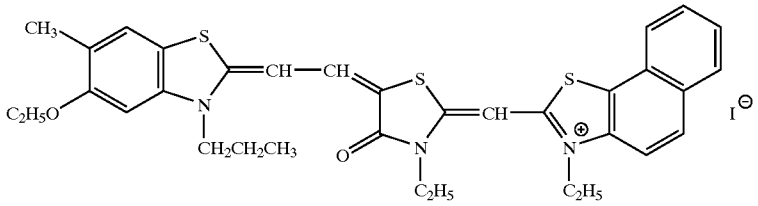
V-34
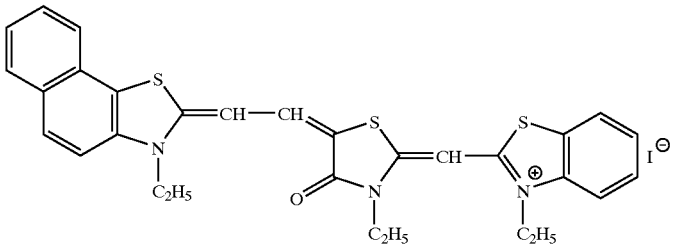
V-35
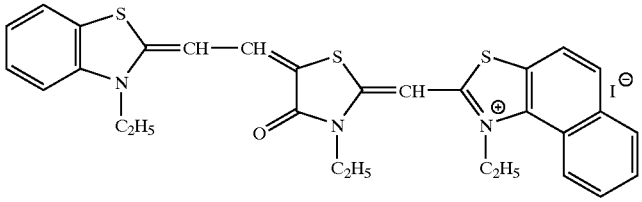
V-36
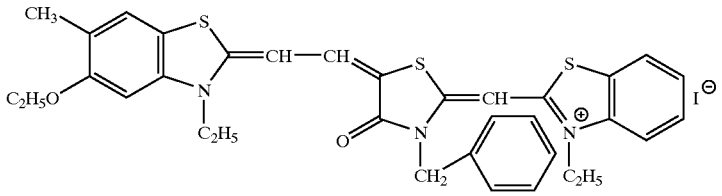
V-37
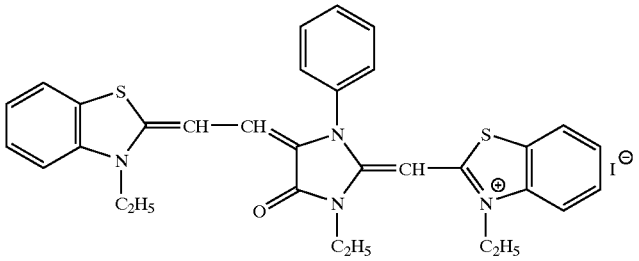

-continued

V-38

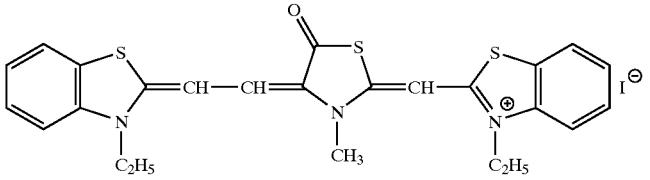

The compounds represented by the formula (VIa) used for the present invention will be explained hereafter. The alkyl group represented by $R^{61}$ or $R^{62}$ includes a substituted alkyl group. The alkyl group represented by $R^{61}$ or $R^{62}$ is preferably an alkyl group having 1–8 carbon atoms such as methyl group, ethyl group, propyl group, butyl group, pentyl group, heptyl group and octyl group.

Examples of the substituted alkyl group include a substituted alkyl group (preferably having 6 or less carbon atoms for the alkyl moiety) having, as a substituent, for example, a carboxyl group, a sulfo group, a cyano group, a halogen atom (e.g., fluorine atom, chlorine atom, bromine atom etc.), a hydroxyl group, an alkoxycarbonyl group (preferably an alkoxycarbonyl group having 8 or less carbon atoms, such as methoxycarbonyl group, ethoxycarbonyl group and benzyloxycarbonyl group), an alkoxy group (preferably an alkoxy group having 7 or less carbon atoms, such as methoxy group, ethoxy group, propoxy group, butoxy group and benzyloxy group), an aryloxy group (e.g., phenoxy group, p-tolyloxy group etc.), an acyloxy group (preferably an acyloxy group having 3 or less carbon atoms, such as acetyloxy group and propionyloxy group), an acyl group (preferably an acyl group having 8 or less carbon atoms, such as acetyl group, propionyl group, benzoyl group and mesyl group), a carbamoyl group (e.g., carbamoyl group, N,N-dimethylcarbamoyl group, morpholinocarbamoyl group, piperidinocarbamoyl group etc.), a sulfamoyl group (e.g., sulfamoyl group, N,N-dimethylsulfamoyl group, morpholinosulfonyl group etc.), an aryl group (e.g., phenyl group, p-hydroxyphenyl group, p-carboxyphenyl group, p-sulfophenyl group, ,-naphthyl group etc.) or the like. The substituted alkyl group may have two or more substituents consisting of any combination of the foregoing substituents.

$R^{63}$ is preferably a phenyl group, a benzyl group or a phenethyl group, particularly preferably a lower alkyl group or a benzyl group.

As for the groups represented by $R^{63}$, the lower alkyl is preferably an alkyl group having 1–4 carbon atoms, such as methyl group, ethyl group, propyl group and butyl group, and the lower alkoxy group is preferably an alkoxy group having 1–4 carbon atoms, such as methoxy group, ethoxy group, propoxy group and butoxy group.

As for the groups represented by $V^6$, the lower alkyl group is preferably an alkyl group having 1–4 carbon atoms, such as methyl group, ethyl group and propyl group, the alkoxy group is preferably an alkoxy group having 1–4 carbon atoms, such as methoxy group, ethoxy group and butoxy group, examples of the halogen atom include fluorine atom, chlorine atom etc., and the substituted alkyl group is preferably a substituted alkyl group having 1–4 carbon atoms such as trifluoromethyl group and carboxymethyl group.

Examples of the 5- or 6-membered nitrogen-containing heterocyclic ring or 5- or 6-membered nitrogen-containing heterocyclic ring having a condensed ring formed with $Z^{61}$ include, for example, a thiazole ring {e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]-thiazole, 8-methoxynaphtho[2,1-d]thiazole, 5-methoxynaphtho-[2,3-d]thiazole etc.}, a selenazole ring {e.g. benzoselenazole, 5-chlorobenzoselenazole, 5-methoxybenzoselenazole, 5-methylbenzoselenazole, 5-hydroxybenzoselenazole, naphtho[2,1-d]-selenazole, naphtho[1,2-d]selenazole etc.}, an oxazole ring {e.g. benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d] oxazole, naphtho[2,3-d]-oxazole etc.}, a quinoline ring {e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline etc.}, 3,3-dialkylindolenine ring {e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine etc.}, an imidazole ring {e.g., 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole etc. and a pyridine ring (e.g., pyridine, 5-methyl-2-pyridine, 3-methyl-4-pyridine etc.}.

The 5- or 6-membered nitrogen-containing heterocyclic ring is preferably a thiazole ring or an oxazole ring, and the 5- or 6-membered nitrogen-containing heterocyclic ring or 5- or 6-membered nitrogen-containing heterocyclic ring having a condensed ring is more preferably a benzothiazole ring, a naphthothiazole ring, a naphthooxazole ring or a benzoxazole ring.

$M^{61}$ represents an ion required to offset the charge of the molecule. Specific examples of cation include, for example, a proton, an organic ammonium ion (e.g., triethylammonium ion, triethanolammonium ion etc.) and an inorganic cation (e.g., cations of lithium, sodium, calcium etc.), and examples of acidic anion include, for example, a halogen ion (e.g., chloride ion, bromide ion, iodide ion etc.), p-toluenesulfonate ion, perchlorate ion, boron tetrafluoride ion and so forth.

$n^{61}$ is a number required to neutralize the total charge of the molecule with $M^{61}$. When the dye molecule forms an intramolecular salt, the charge of the molecule does not need to be offset and thus $n^{61}$ is 0.

Specific examples of the spectral sensitization dyes represented by the formula (VIa) are mentioned below. However, the spectral sensitization dyes represented by the formula (VIa) that can be used for the present invention are not limited to these.

VIa-1

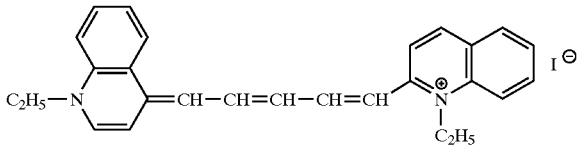

VIa-2

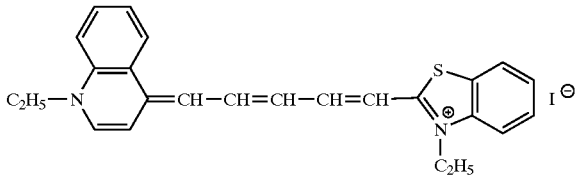

VIa-3

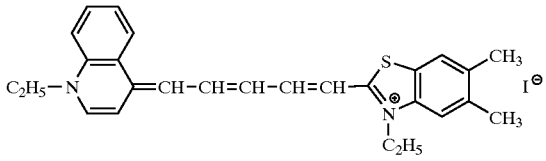

VIa-4

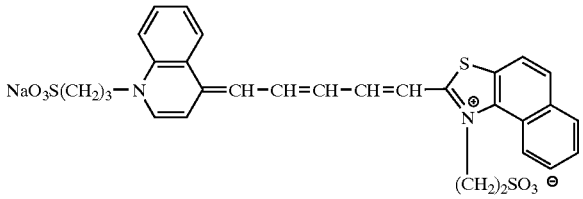

VIa-5

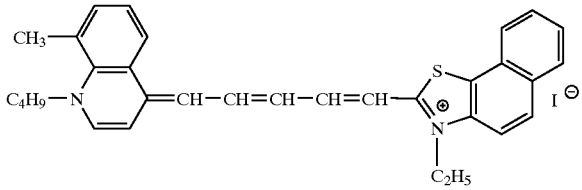

VIa-6

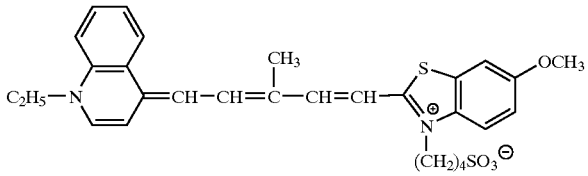

VIa-7

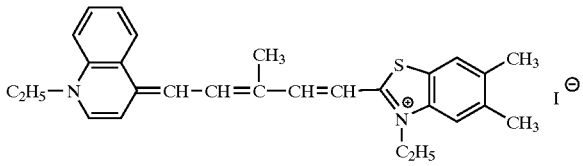

VIa-8

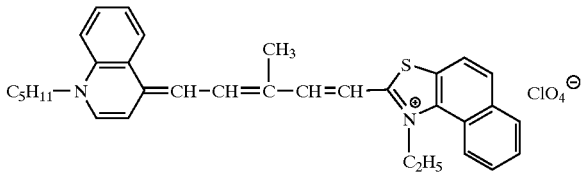

VIa-9

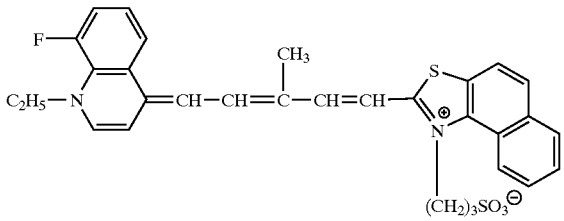

VIa-10

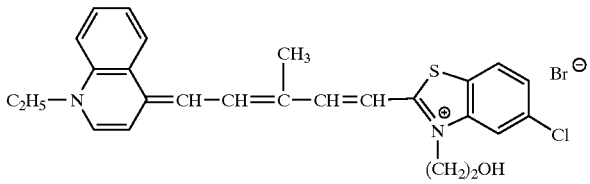

VIa-11

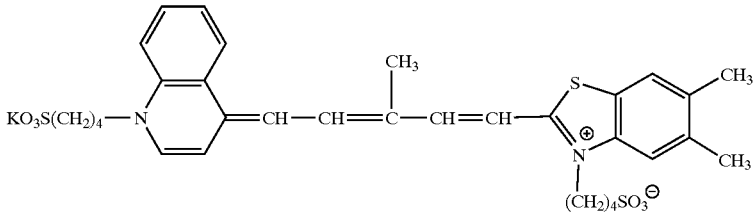

-continued
VIa-12
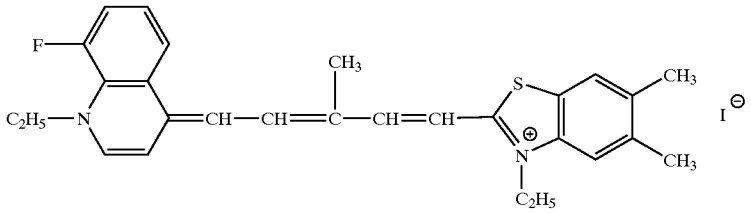
VIa-13
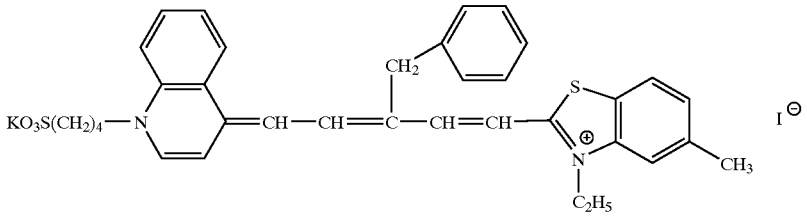
VIa-14
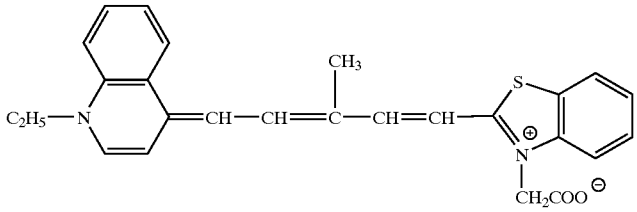
VIa-15
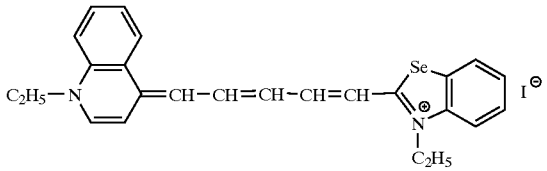
VIa-16
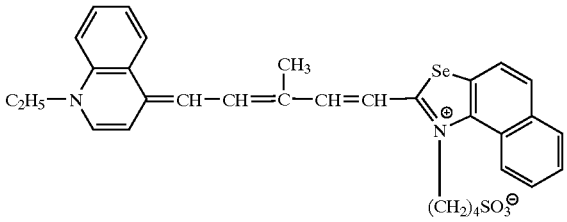
VIa-17
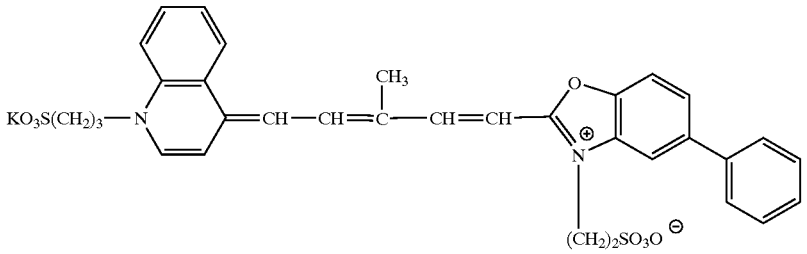
VIa-18
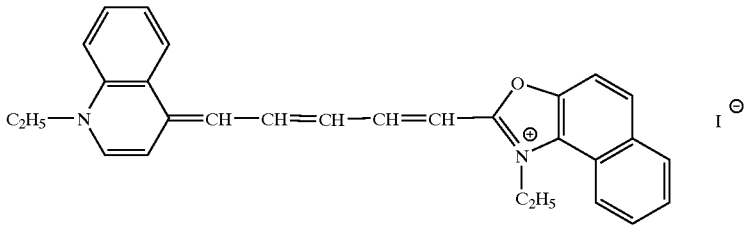

-continued

VIa-19

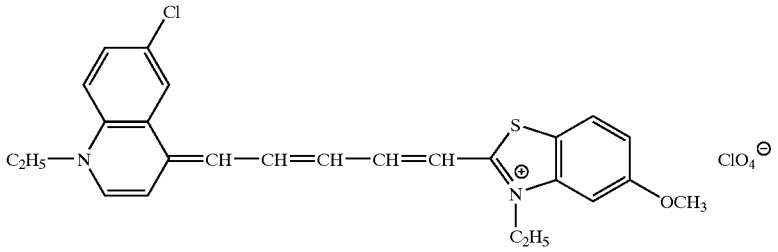

VIa-20

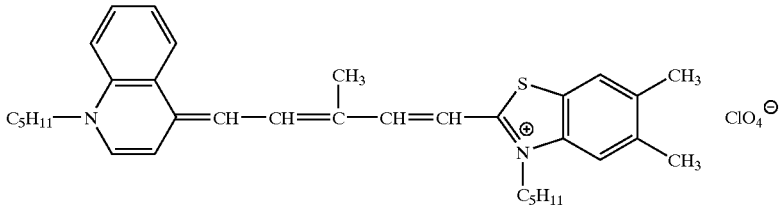

The compounds represented by the formula (VIb) used for the present invention will be explained hereafter. The alkyl group represented by $R^{64}$ or $R^{65}$ includes a substituted alkyl group. The alkyl group represented by $R^{64}$ or $R^{65}$ is preferably an alkyl group having 1–8 carbon atoms such as methyl group, ethyl group, propyl group, butyl group, pentyl group, heptyl group and octyl group.

Examples of the substituted alkyl group include a substituted alkyl group (preferably having 6 or less carbon atoms for the alkyl moiety) having, as a substituent, for example, a carboxyl group, a sulfo group, a cyano group, a halogen atom (e.g., fluorine atom, chlorine atom, bromine atom etc.), a hydroxyl group, an alkoxycarbonyl group (preferably an alkoxycarbonyl group having 8 or less carbon atoms, such as methoxycarbonyl group, ethoxycarbonyl group and benzyloxycarbonyl group), an alkoxy group (preferably an alkoxy group having 7 or less carbon atoms, such as methoxy group, ethoxy group, propoxy group, butoxy group and benzyloxy group), an aryloxy group (e.g., phenoxy group, p-tolyloxy group etc.), an acyloxy group (preferably an acyloxy group having 3 or less carbon atoms, such as acetyloxy group and propionyloxy group), an acyl group (preferably an acyl group having 8 or less carbon atoms, such as acetyl group, propionyl group, benzoyl group and mesyl group), a carbamoyl group (e.g., carbamoyl group, N,N-dimethylcarbamoyl group, morpholinocarbamoyl group, piperidinocarbamoyl group), a sulfamoyl group (e.g., sulfamoyl group, N,N-dimethylsulfamoyl group, morpholinosulfonyl group etc.), an aryl group (e.g., phenyl group, p-hydroxyphenyl group, p-carboxyphenyl group, p-sulfophenyl group, ,-naphthyl group etc.) or the like. The substituted alkyl group may have two or more substituents consisting of any combination of the foregoing substituents.

As for the groups represented by $R^{66}$ or $R^{67}$, the lower alkyl group is preferably an alkyl group having 1–4 carbon atoms, such as methyl group, ethyl group, propyl group and butyl group, and the alkoxy group is preferably an alkoxy group having 1–4 carbon atoms, such as methoxy group, ethoxy group, propoxy group and butoxy group.

$R^{66}$ and $R^{67}$ preferably represent a phenyl group, a benzyl group or a phenethyl group, particularly preferably a lower alkyl group or a benzyl group.

Examples of the divalent alkylene group formed with $R^{68}$ and $R^{69}$ bonding to each other include, for example, an ethylene group, a trimethylene and so forth. These alkylene groups may have one or more substituents. Examples of the substituent include an alkyl group (preferably an alkyl group having 1–4 carbon atoms, such as methyl group, ethyl group, propyl group, isopropyl group and butyl group), a halogen atom (e.g., chlorine atom, bromine atom), an alkoxy group (preferably an alkoxy group having 1–4 carbon atoms, such as methoxy group, ethoxy group, propoxy group, isopropoxy group and butoxy group) and so forth.

As for the groups represented by $R^{70}$, the lower alkyl group is preferably an alkyl group having 1–4 carbon atoms such as methyl group, ethyl group, propyl group and butyl group, and the lower alkoxy group is preferably an alkoxy group having 1–4 carbon atoms such as methoxy group, ethoxy group, propoxy group and butoxy group.

As for the groups represented by $W^{61}$ or $W^{62}$ in —N ($W^{61}$) ($W^{62}$) represented by $R^{70}$, the alkyl group is preferably an alkyl group having 1–18 carbon atoms, more preferably an alkyl group having 1–4 carbon atoms, in the alkyl moiety. The alkyl group includes an alkyl group having a substituent, and examples thereof include methyl group, ethyl group, propyl group, butyl group, benzyl group, phenylethyl group and so forth. The aryl group includes an aryl group having a substituent, and examples thereof include, for example, phenyl group, naphthyl group, tolyl group, p-chlorophenyl group and so forth. Further, $W^{61}$ and $W^{62}$ may bond to each other to form a 5- or 6-membered nitrogen-containing heterocyclic ring.

Further, as for $R^{66}$, $R^{67}$ and $R^{70}$, $R^{66}$ and $R^{70}$ or $R^{67}$ and $R^{70}$ may bond to each other, respectively, to form a divalent alkylene group. Examples of the divalent alkylene group include, for example, an ethylene group, a trimethylene group and so forth. These alkylene groups may have one or more substituents. Examples of the substituent include an alkyl group (preferably an alkyl group having 1–4 carbon atoms, such as methyl group, ethyl group, propyl group, isopropyl group and butyl group), a halogen atom (e.g., chlorine atom, bromine atom), an alkoxy group (preferably an alkoxy group having 1–4 carbon atoms, such as methoxy group, ethoxy group, propoxy group, isopropoxy group and butoxy group).

Examples of the 5- or 6-membered nitrogen-containing heterocyclic ring or 5- or 6-membered nitrogen-containing heterocyclic ring having a condensed ring formed with $Z^{62}$ or $Z^{63}$ include, for example, a thiazole ring {e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtha[2,1-d]thiazole, naphtho[1,2-d]thiazole, naphtho[2,3-d]thiazole, 5-methoxynaphtho[1,2-d]thiazole, 7-ethoxynaphtho[2,1-d]-thiazole, 8-methoxynaphtho[2,1-d]thiazole, 5-methoxynaphtho[2,3-d]thiazole etc.}, a selenazole ring {e.g. benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole etc.}, an oxazole ring {e.g. benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole etc.}, a quinoline ring {e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline etc.}, 3,3-dialkylindolenine ring {e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine etc.}, an imidazole ring {e.g., 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole etc.} and a pyridine ring {e.g., pyridine, 5-methyl-2-pyridine, 3-methyl-4-pyridine etc.}.

The 5- or 6-membered nitrogen-containing heterocyclic ring is preferably a thiazole ring or an oxazole ring, and the 5- or 6-membered nitrogen-containing heterocyclic ring or 5- or 6-membered nitrogen-containing heterocyclic ring having a condensed ring is more preferably a benzothiazole ring, a naphthothiazole ring, a naphthooxazole ring or a benzoxazole ring.

$M^{62}$ represents an ion required to offset the charge of the molecule. Specific examples of cation include, for example, a proton, an organic ammonium ion (e.g., triethylammonium ion, triethanolammonium ion etc.) and an inorganic cation (e.g., cations of lithium, sodium, calcium etc.), and examples of acidic anion include, for example, a halogen ion (e.g., chloride ion, bromide ion, iodide ion etc.), p-toluenesulfonate ion, perchlorate ion, boron tetrafluoride ion and so forth.

$n^{62}$ is a number required to neutralize the total charge of the molecule with $M^{62}$. When the dye molecule forms an intramolecular salt, the charge of the molecule does not need to be offset and thus $n^{62}$ is 0.

Specific examples of the spectral sensitization dyes represented by the formula (VIb) are mentioned below. However, the spectral sensitization dyes represented by the formula (VIb) that can be used for the present invention are not limited to these.

VIb-1

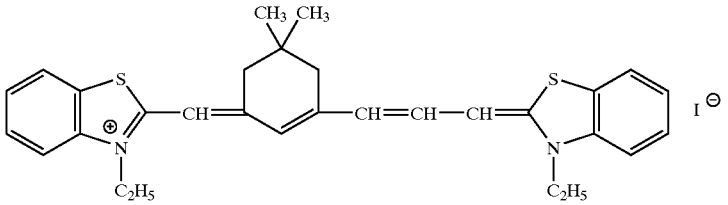

VIb-2

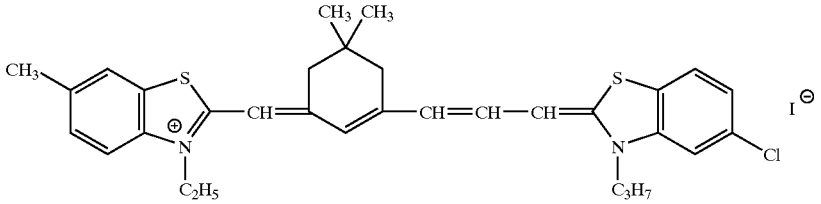

VIb-3

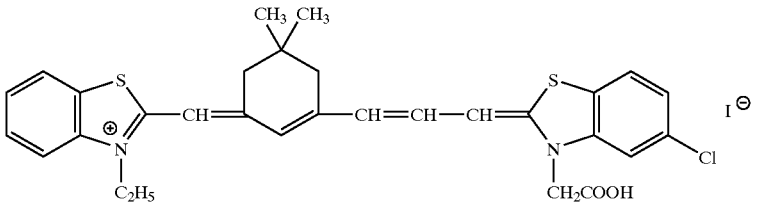

-continued
VIb-4
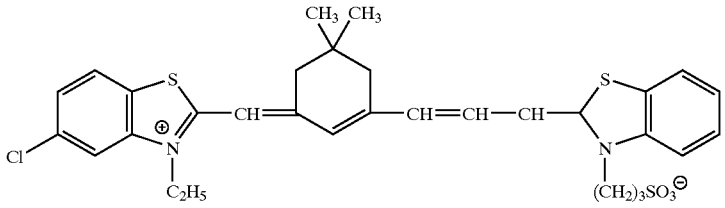
VIb-5
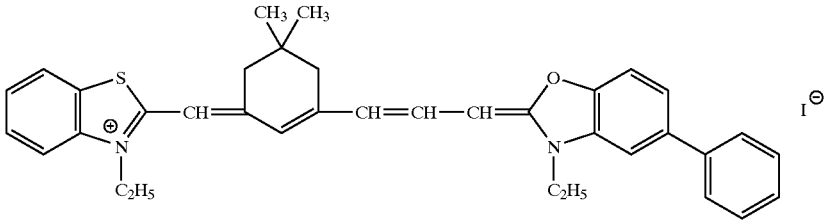
VIb-6
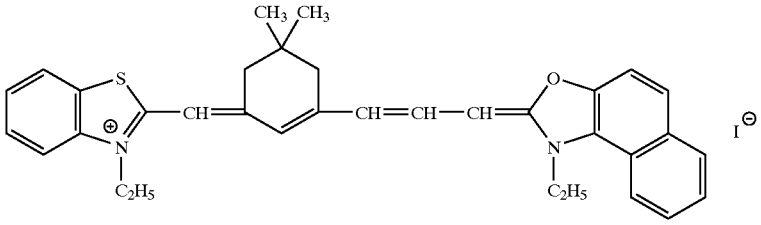
VIb-7
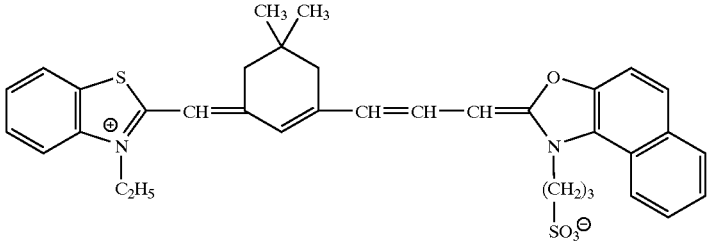
VIb-8
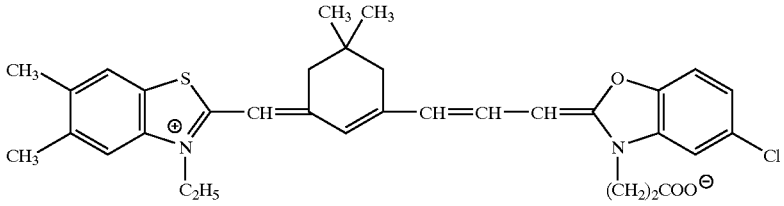
VIb-9
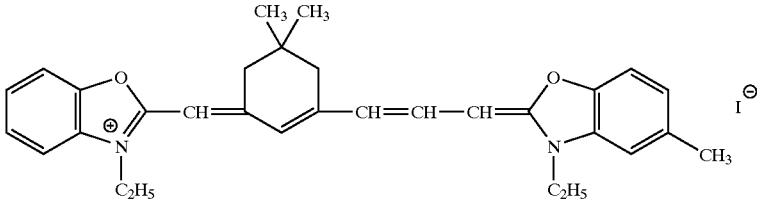
VIb-10
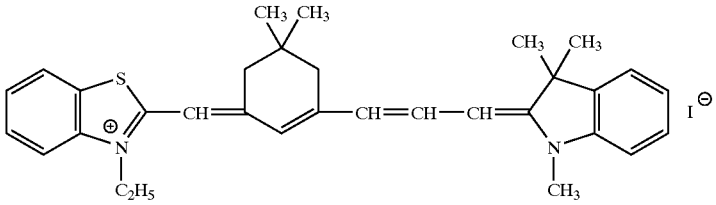

-continued

VIb-11

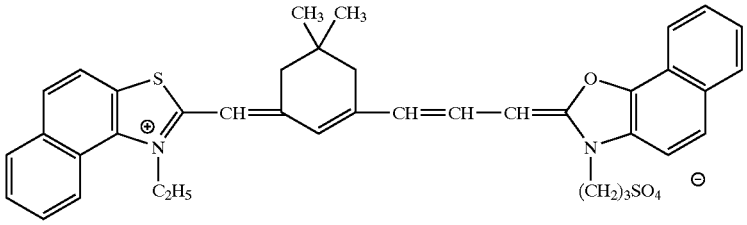

VIb-12

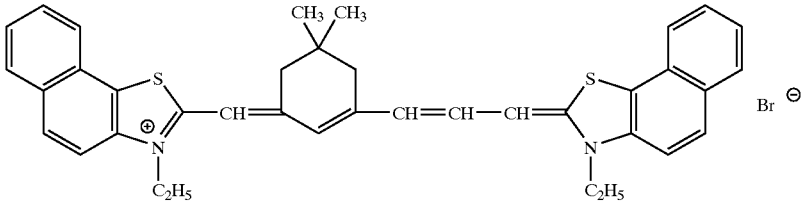

VIb-13

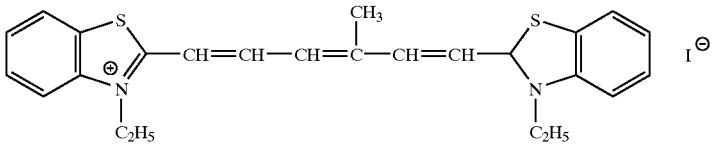

VIb-14

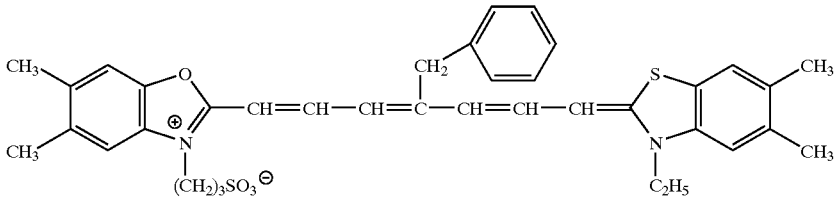

VIb-15

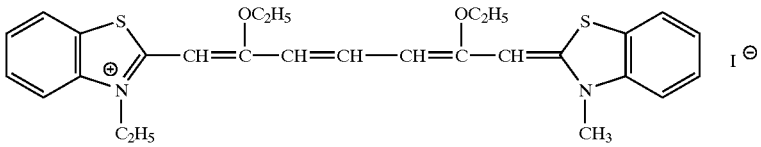

VIb-16

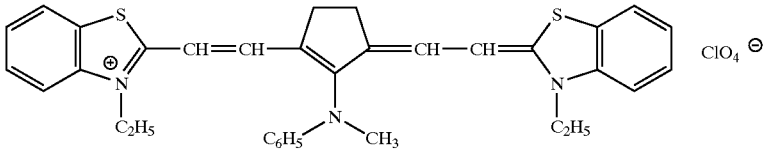

VIb-17

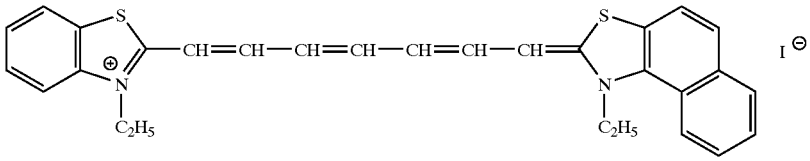

VIb-18

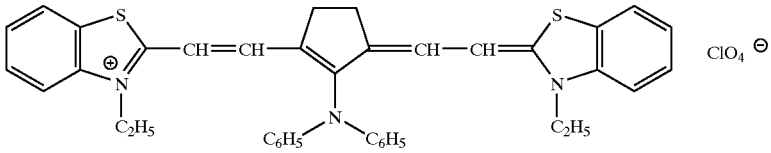

These spectral sensitization dyes may be used individually or in combination, and a combination of spectral sensitization dyes is often used for the purpose of, in particular, supersensitization. In combination with a spectral sensitization dye, a dye which itself has no spectral sensitization effect, or a material that absorbs substantially no visible light, but exhibits supersensitization may be incorporated into the emulsion.

Useful spectral sensitization dyes, combinations of dyes that exhibit supersensitization and materials that show supersensitization are described in, for example, Research Disclosure, Vol. 176, 17643, page 23, Item IV-J (December 1978); JP-B-49-25500, JP-B-43-4933, JP-A-59-19032, JP-A-59-192242 mentioned above and so forth.

The spectral sensitization dyes used for the present invention may be used in a combination of two or more of them. The spectral sensitization dye may be added to a silver halide emulsion by dispersing it directly in the emulsion, or by dissolving it in a sole or mixed solvent of such solvents as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the spectral sensitization dye may be added to the emulsion by the method disclosed in U.S. Pat. No. 3,469,987, in which a dye is dissolved in a volatile organic solvent, the solution is dispersed in water or a hydrophilic colloid and the dispersion is added to the emulsion; the methods disclosed in JP-B-44-23389, JP-B-44-27555, JP-B-57-22091 and so forth, in which a dye is dissolved in an acid and the solution is added to the emulsion, or a dye is made into an aqueous solution in the presence of an acid or base and the solution is added to the emulsion; the method disclosed in, for example, U.S. Pat. Nos. 3,822,135 and 4,006,025, in which a dye is made into an aqueous solution or a colloid dispersion in the presence of a surfactant, and the solution or dispersion is added to the emulsion; the method disclosed in JP-A-53-102733 and JP-A-58-105141, in which a dye is directly dispersed in a hydrophilic colloid and the dispersion is added to the emulsion; or the method disclosed in JP-A-51-74624, in which a dye is dissolved by using a compound capable of red-shift and the solution is added to the emulsion. Ultrasonic waves may also be used for the preparation of the solution.

The spectral sensitization dye used for the present invention may be added to a silver halide emulsion at any step known to be useful during the preparation of emulsion. For example, the dye may be added at a step of formation of silver halide grains and/or in a period before desalting or at a step of desilverization and/or in a period after desalting and before initiation of chemical ripening, as disclosed in, for example, U.S. Pat. Nos. 2,735,766, 3,628,960, 4,183,756, 4,225,666, JP-A-58-184142, JP-A-60-196749 etc., or the dye may be added in any period or at any step before coating of the emulsion, such as immediately before or during chemical ripening, or in a period after chemical ripening but before coating, as disclosed in, for example, JP-A-58-113920. Further, a sole kind of compound alone or compounds different in structure in combination may be added as divided portions, for example, a part is added during grain formation, and the remaining during chemical ripening or after completion of the chemical ripening, or a part is added before or during chemical ripening and the remaining after completion of the chemical ripening, as disclosed in, for example, U.S. Pat. No. 4,225,666 and JP-A-58-7629. The kind of compound or the kind of the combination of compounds added as divided portions may be changed.

The addition amount of the spectral sensitization dye used for the present invention varies depending on the shape, size, halogen composition of silver halide grains, method and degree of chemical sensitization, kind of antifoggant and so forth, but the addition amount may be from $4\times10^{-6}$ to $8\times10^{-3}$ mol per mol of silver halide. For example, when the silver halide grain size is 0.2–1.3 $\mu$m, the addition amount is preferably from $2\times10^{-7}$ to $3.5\times10^{-6}$, more preferably from $6.5\times10^{-7}$ to $2.0\times10^{-6}$ mol, per $m^2$ of the surface area of silver halide grains.

The silver halide photographic light-sensitive material of the present invention has a characteristic curve with a gamma of 4.0 or more, preferably 5.0–100, more preferably 5.0–30.

The "gamma" used in the present invention means inclination of a straight line connecting two points corresponding to optical densities of 0.1 and 1.5 on a characteristic curve drawn in orthogonal coordinates of optical density (y-axis) and common logarithm of light exposure (x-axis), in which equal unit lengths are used for the both axes. That is, when the angle formed by the straight line and the x-axis is represented by the gamma is represented by tan.

In the present invention, in order to obtain the characteristic curve, the silver halide photographic light-sensitive material is processed by using a developer (QR-D1 produced by Fuji Photo Film Co., Ltd) and a fixer (NF-1 produced by Fuji Photo Film Co., Ltd.) in an automatic developing machine (FG-680AG produced by Fuji Photo Film Co., Ltd) with development conditions of 35° C. for 30 seconds.

Various methods can be used as the method for obtaining a silver halide photographic light-sensitive material having the characteristic curve defined by the present invention. For example, gamma of the silver halide photographic light-sensitive material can be controlled by using silver halide emulsion containing a heavy metal that can realize high contrast (e.g., a metal belonging to Group VIII). It is particularly preferable to use a silver halide emulsion containing a rhodium compound, iridium compound, ruthenium compound or the like. Further, it is also preferable to add at least one compound selected from hydrazine derivatives, amine compounds, phosphonium compounds and so forth as a nucleating agent on the side having an emulsion layer.

The silver halide photographic light-sensitive material of the present invention preferably contains a hydrazine compound as a nucleating agent. It particularly preferably contains at least one compound represented by the following formula (D).

Formula (D)

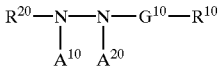

In the formula, $R^{20}$ represents an aliphatic group, an aromatic group or a heterocyclic group, $R^{10}$ represents a hydrogen atom or a blocking group, and $G^{10}$ represents —CO—, —COCO—, —C(=S)—, —$SO_2$—, —SO—, —PO($R^{30}$)— group ($R^{30}$ is selected from the same range of groups defined for $R^{10}$, and $R^{30}$ may be different from $R^{10}$) or an iminomethylene group. $A^{10}$ and $A^{20}$ both represent a hydrogen atom, or one of them represents a hydrogen atom and the other represents a substituted or unsubstituted alkylsulfonyl group, a substituted or unsubstituted arylsulfonyl group or a substituted or unsubstituted acyl group.

In the formula (D), the aliphatic group represented by $R^{20}$ is preferably a substituted or unsubstituted straight, branched or cyclic alkyl, alkenyl or alkynyl group having 1–30 carbon atoms.

In the formula (D), the aromatic group represented by $R^{20}$ is a monocyclic or condensed-ring aryl group. Examples of the ring include benzene ring and naphthalene ring. The heterocyclic group represented by $R^{20}$ is a monocyclic or condensed-ring, saturated or unsaturated, aromatic or non-aromatic heterocyclic group. Examples of the ring include pyridine ring, pyrimidine ring, imidazole ring, pyrazole ring, quinoline ring, isoquinoline ring, benzimidazole ring, thiazole ring, benzothiazole ring, piperidine ring, triazine ring and so forth.

$R^{20}$ is preferably an aryl group, especially preferably a phenyl group.

The group represented by $R^{20}$ may be substituted with a substituent. Typical examples of the substituent include, for example, a halogen atom (fluorine, chlorine, bromine or iodine atom), an alkyl group (including an aralkyl group, a cycloalkyl group, an active methine group etc.), an alkenyl group, an alkynyl group, an aryl group, a heterocyclic group, a quaternized nitrogen atom-containing heterocyclic group (e.g. piperidinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group containing a repeating unit of ethyleneoxy group or propyleneoxy group), an aryloxy group, a heterocyclyloxy group, an acyloxy group, an (alkoxy or aryloxy) carbonyloxy group, a carbamoyloxy group, a sulfonyloxy group, an amino group, an (alkyl, aryl or heterocyclyl)amino group, an N-substituted nitrogen-containing heterocyclic group, an acylamino group, a sulfonamido group, a ureido group, a thioureido group, an isothioureido group, an imido group, an (alkoxy or aryloxy) carbonylamino group, a sulfamoylamino group, a semicarbazido group, a thiosemicarbazido group, a hydrazino group, a quaternary ammonio group, an oxamoylamino group, an (alkyl or aryl)sulfonylureido group, an acylureido group, an N-acylsulfamoylamino group, a nitro group, a mercapto group, an (alkyl, aryl or heterocyclyl)thio group, an (alkyl or aryl)sulfonyl group, an (alkyl or aryl)sulfinyl group, a sulfo group or a salt thereof, a sulfamoyl group, an N-acylsulfamoyl group, a sulfonylsulfamoyl group or a salt thereof, a group having phosphoric acid amide or phosphoric acid ester structure and so forth.

These substituents may be further substituted with any of these substituents.

Preferred examples of the substituent that $R^{20}$ may have include an alkyl group having 1–30 carbon atoms (including an active methylene group), an aralkyl group, a heterocyclic group, a substituted amino group, an acylamino group, a sulfonamido group, a ureido group, a sulfamoylamino group, an imido group, a thioureido group, a phosphoric acid amido group, a hydroxyl group, an alkoxy group, an aryloxy group, an acyloxy group, an acyl group, an alkoxycarbonyl group, an aryloxycarbonyl group, a carbamoyl group, a carboxyl group or a salt thereof, an (alkyl, aryl or heterocyclyl)thio group, a sulfo group or a salt thereof, a sulfamoyl group, a halogen atom, a cyano group, a nitro group and so forth.

In the formula (D), $R^{10}$ represents a hydrogen atom or a blocking group, and specific examples of the blocking group include an alkyl group, an alkenyl group, an alkynyl group, an aryl group, a heterocyclic group, an alkoxy group, an aryloxy group, an amino group and a hydrazino group.

The alkyl group represented by $R^{10}$ is preferably an alkyl group having 1–10 carbon atoms. Examples of the alkyl group include methyl group, trifluoromethyl group, difluoromethyl group, 2-carboxytetrafluoroethyl group, pyridiniomethyl group, difluoromethoxymethyl group, difluorocarboxymethyl group, 3-hydroxypropyl group, methanesulfonamidomethyl group, benzenesulfonamidomethyl group, hydroxymethyl group, methoxymethyl group, methylthiomethyl group, phenylsulfonylmethyl group, o-hydroxybenzyl group and so forth. The alkenyl group is preferably an alkenyl group having 1–10 carbon atoms. Examples of the alkenyl group include vinyl group, 2,2-dicyanovinyl group, 2-ethoxycarbonylvinyl group, 2-trifluoro-2-methoxycarbonylvinyl group and so forth. The alkynyl group is preferably an alkynyl group having 1–10 carbon atoms. Examples of the alkynyl group include ethynyl group, 2-methoxycarbonylethynyl group and so forth. The aryl group is preferably a monocyclic or condensed-ring aryl group, and especially preferably an aryl group containing a benzene ring. Examples of the aryl group include phenyl group, 3,5-dichlorophenyl group, 2-methanesulfonamidophenyl group, 2-carbamoylphenyl group, 4-cyanophenyl group, 2-hydroxymethylphenyl group and so forth.

The heterocyclic group is preferably a 5- or 6-membered, saturated or unsaturated, monocyclic or condensed-ring heterocyclic group that contains at least one nitrogen, oxygen or sulfur atom, and it may be a heterocyclic group containing a quaternized nitrogen atom. Examples of the heterocyclic group include a morpholino group, a piperidino group (N-substituted), a piperazino group, an imidazolyl group, an indazolyl group (e.g., 4-nitroindazolyl group etc.), a pyrazolyl group, a triazolyl group, a benzimidazolyl group, a tetrazolyl group, a pyridyl group, a pyridinio group (e.g., N-methyl-3-pyridinio group), a quinolinio group, a quinolyl group and so forth. Among these, especially preferred are a morpholino group, a piperidino group, a pyridyl group, a pyridinio group and so forth.

The alkoxy group is preferably an alkoxy group having 1–8 carbon atoms. Examples of the alkoxy group include methoxy group, 2-hydroxyethoxy group, benzyloxy group and so forth. The aryloxy group is preferably a phenyloxy group. The amino group is preferably an unsubstituted amino group, an alkylamino group having 1–10 carbon atoms, an arylamino group or a saturated or unsaturated heterocyclylamino group (including a quaternized nitrogen atom-containing heterocyclic group). Examples of the amino group include 2,2,6,6-tetramethylpiperidin-4-ylamino group, propylamino group, 2-hydroxyethylamino group, anilino group, o-hydroxyanilino group, 5-benzotriazolylamino group, N-benzyl-3-pyridinioamino group and so forth. The hydrazino group is especially preferably a substituted or unsubstituted hydrazino group, a substituted or unsubstituted phenylhydrazino group (e.g., 4-benzenesulfonamidophenylhydrazino group) or the like.

The group represented by $R^{10}$ may be substituted with a substituent. Preferred examples of the substituent are the same as those exemplified as the substituent of $R^{20}$.

In the formula (D), $R^{10}$ may be a group capable of splitting the $G^{10}$-$R^{10}$ moiety from the residual molecule and subsequently causing a cyclization reaction that produces a cyclic structure containing atoms of the -$G^{10}$-$R^{1}$ moiety. Examples of such a group include those described in, for example, JP-A-63-29751.

The hydrazine derivatives represented by the formula (D) may contain an absorptive group capable of being absorbed onto silver halide. Examples of the absorptive group include an alkylthio group, an arylthio group, a thiourea group, a thioamido group, amercaptoheterocyclic group, a triazole group and so forth, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. Further, these groups capable of being absorbed onto silver halide may be modified into a precursor thereof. Examples of the precursor include those groups described in JP-A-2-285344.

$R^{10}$ or $R^{20}$ in the formula (D) may contain a ballast group or polymer that is usually used for immobile photographic additives such as couplers. The ballast group used in the present invention means a group having 6 or more carbon atoms including such a linear or branched alkyl group (or an alkylene group), an alkoxy group (or an alkyleneoxy group), an alkylamino group (or an alkyleneamino group), an alkylthio group or a group having any of these groups as a partial structure, more preferably a group having 7–24 carbon atoms including such a linear or branched alkyl group (or an alkylene group), an alkoxy group (or an alkyleneoxy group), an alkylamino group (or an alkyleneamino group), an alkylthio group or a group having any of these groups as a partial structure. Examples of the polymer include those described in, for example, JP-A-1-100530.

$R^{10}$ or $R^{20}$ in the formula (D) may contain a plurality of hydrazino groups as substituents. In such a case, the compound represented by the formula (D) is a multi-mer for hydrazino group. Specific examples of such a compound include those described in, for example, JP-A-64-86134, JP-A-4-16938, JP-A-5-197091, WO95/32452, WO95/32453, JP-A-9-179229, JP-A-9-235264, JP-A-9-235265, JP-A-9-235266, JP-A-9-235267 and so forth.

$R^{10}$ or $R^{20}$ in the formula (D) may contain a cationic group (specifically, a group containing a quaternary ammonio group, a group containing a quaternized phosphorus atom, a nitrogen-containing heterocyclic group containing a quaternized nitrogen atom etc.), a group containing repeating units of ethyleneoxy group or propyleneoxy group, an (alkyl, aryl or heterocyclyl)thio group, or a dissociating group (this means a group or partial structure having a proton of low acidity that can be dissociated with an alkaline developer or a salt thereof, specifically, for example, carboxyl group (—COOH), sulfo group (—$SO_3H$), phosphonic acid group (—$PO_3H$), phosphoric acid group (—$OPO_3H$), hydroxy group (—OH), mercapto group (—SH), —$SO_2NH_2$ group, N-substituted sulfonamido group (—$SO_2NH$—, —$CONHSO_2$— group, —$CONHSO_2NH$— group, —$NHCONHSO_2$— group, —$SO_2NHSO_2$— group), —CONHCO— group, active methylene group, —NH— group contained in a nitrogen-containing heterocyclic group, a salt thereof etc.). Examples of the compounds containing these groups include those described in, for example, JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, and German Patent No. 4006032, JP-A-11-7093 and so forth.

In the formula (D), $A^{10}$ and $A^{20}$ each represent a hydrogen atom or an alkyl- or arylsulfonyl group having 20 or less carbon atoms (preferably, phenylsulfonyl group, or a phenylsulfonyl group substituted with substituent (s) so that the total of the Hammett's substituent constant of the substituent (s) should become −0.5 or more), or an acyl group having 20 or less carbon atoms (preferably, benzoyl group, a benzoyl group substituted with substituent(s) so that the total of the Hammett's substituent constant of the substituent(s) should become −0.5 or more, or a straight, branched or cyclic, substituted or unsubstituted, aliphatic acyl group (examples of the substituent include a halogen atom, an ether group, a sulfonamido group, a carbonamido group, a hydroxyl group, a carboxyl group, a sulfo group etc.)). $A^{10}$ and $A^{20}$ each most preferably represent a hydrogen atom.

Hereafter, hydrazine derivatives especially preferably used for the present invention are explained.

$R^{20}$ is especially preferably a substituted phenyl group. Particularly preferred as the substituent are a sulfonamido group, an acylamino group, a ureido group, a carbamoyl group, a thioureido group, an isothioureido group, a sulfamoylamino group, an N-acylsulfamoylamino group and so forth, further preferred are a sulfonamido group and a ureido group, and the most preferred is a sulfonamido group.

The hydrazine derivatives represented by the formula (D) preferably have at least one substituent, directly or indirectly on $R^{20}$ or $R^{10}$, selected from the group consisting of a ballast group, a group that can be absorbed on silver halide, a group containing quaternary ammonio group, a nitrogen-containing heterocyclic group containing a quaternized nitrogen atom, a group containing repeating units of ethyleneoxy group, an (alkyl, aryl or heterocyclyl)thio group, a dissociating group capable of dissociating in an alkaline developer, and a hydrazino group capable of forming a multi-mer (group represented by —NHNH—$G^{10}$—$R^{10}$). Furthermore, $R^{20}$ preferably directly or indirectly has one group selected from the aforementioned groups as a substituent, and $R^{20}$ is most preferably a phenyl group substituted with a benzenesulfonamido group directly or indirectly having one of the aforementioned groups as a substituent on the benzene ring.

Among those groups represented by $R^{10}$, when $G^{10}$ is —CO— group, preferred are a hydrogen atom, an alkyl group, an alkenyl group, an alkynyl group, an aryl group and a heterocyclic group, more preferred are a hydrogen atom, an alkyl group or a substituted aryl group (the substituent is especially preferably an electron-withdrawing group or o-hydroxymethyl group), and the most preferred are a hydrogen atom and an alkyl group.

When $G^{10}$ is —COCO— group, an alkoxy group, an aryloxy group, and an amino group are preferred, and a substituted amino group, specifically an alkylamino group, an arylamino group and a saturated or unsaturated heterocyclylamino group are especially preferred.

Further, when $G^1$ is —$SO_2$— group, $R^{10}$ is preferably an alkyl group, an aryl group or a substituted amino group.

In the formula (D), $G^{10}$ is preferably —CO— group or —COCO— group, especially preferably —CO— group.

Specific examples of the compounds represented by the formula (D) are illustrated below, but the present invention is not limited to the following specific examples.

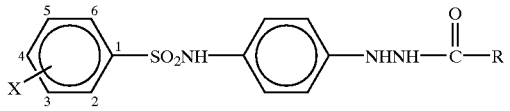
| | X = | R = —H | —$C_2F_4COOH$ (or —$C_2F_4COO^{\ominus}K^{\oplus}$ | 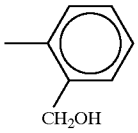 | 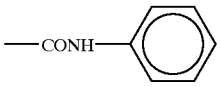 |
|---|---|---|---|---|---|
| D-1 | 3-$NHCOC_9H_{19}$(n) | 1a | 1b | 1c | 1d |
| D-2 | 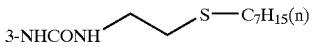 | 2a | 2b | 2c | 2d |
| D-3 | 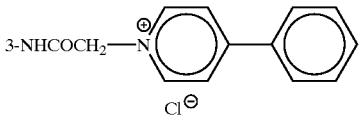 | 3a | 3b | 3c | 3d |
| D-4 | 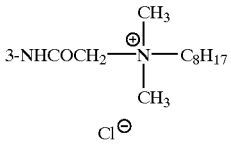 | 4a | 4b | 4c | 4d |
| D-5 | 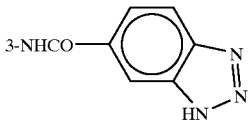 | 5a | 5b | 5c | 5d |
| D-6 | 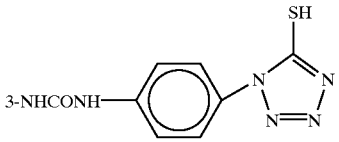 | 6a | 6b | 6c | 6d |
| D-7 | 2,4—$(CH_3)_2)_3$—$SC_2H_4$—$(OC_2H_4)_4OC_8H_{17}$ | 7a | 7b | 7c | 7d |
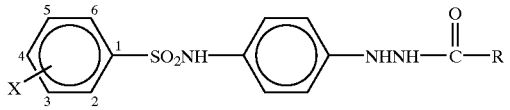
| | X = | R = —H | —$CF_2H$ | 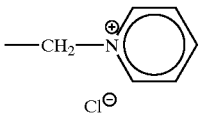 | 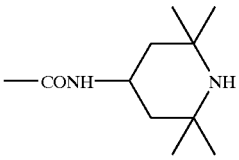 |
|---|---|---|---|---|---|
| D-8 | 3-$CONHCH_2CH(C_2H_5)C_4H_9$ | 8a | 8e | 8f | 8g |
| D-9 | 6-$OCH_3$-3-$C_5H_{11}$(t) | 9a | 9e | 9f | 9g |

-continued
| | | | | | |
|---|---|---|---|---|---|
| D-10 | 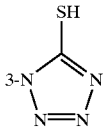 | 10a | 10e | 10f | 10g |
| D-11 | 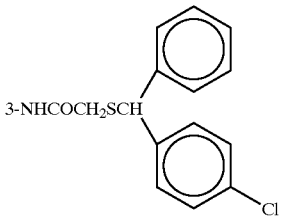 | 11a | 11e | 11f | 11g |
| D-12 | 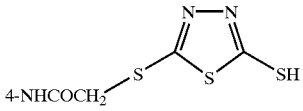 | 12a | 12e | 12f | 12g |
| D-13 | 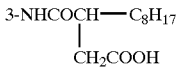 | 13a | 13e | 13f | 13g |
| D-14 | 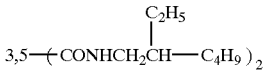 | 14a | 14e | 14f | 14g |
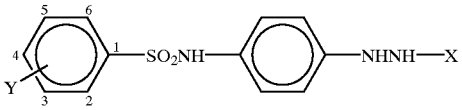
| | | X = | | | |
|---|---|---|---|---|---|
| | Y = | —CHO | —$COCF_3$ | —$SO_2CH_3$ | —$P(OC_2H_5)_2$ (O) |
| D-15 | 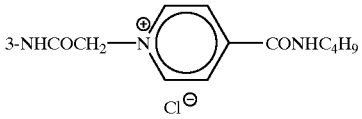 | 15a | 15h | 15i | 15j |
| D-16 | 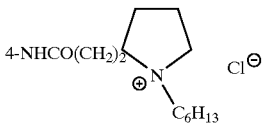 | 16a | 16h | 16i | 16j |
| D-17 | 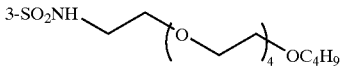 | 17a | 17h | 17i | 17j |
| D-18 | 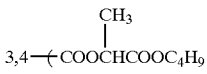 | 18a | 18h | 18i | 18i |
| D-19 | 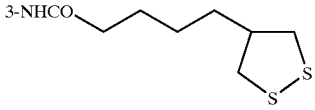 | 19a | 19h | 19i | 19j |
| D-20 | 3-$NHSO_2NH$—$C_8H_{17}$ | 20a | 20h | 20i | 20j |

-continued
| | | | | | |
|---|---|---|---|---|---|
| D-21 | 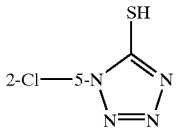 | 21a | 21h | 21i | 21j |
| | | | R = | | |
| | | | —H | —$CF_2H$ | 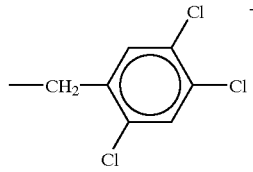 | —$CONHC_3H_7$ |
| D-22 | 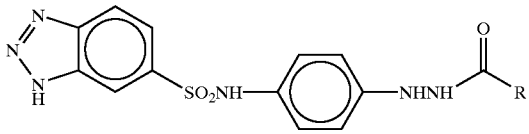 | 22a | 22e | 22k | 22l |
| D-23 | 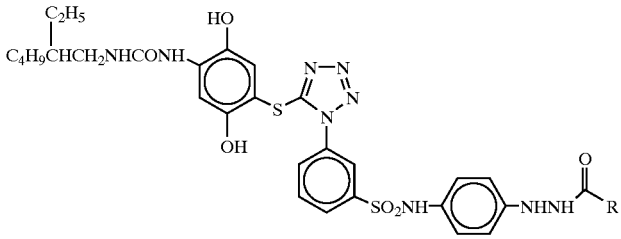 | 23a | 23e | 23k | 23l |
| D-24 | 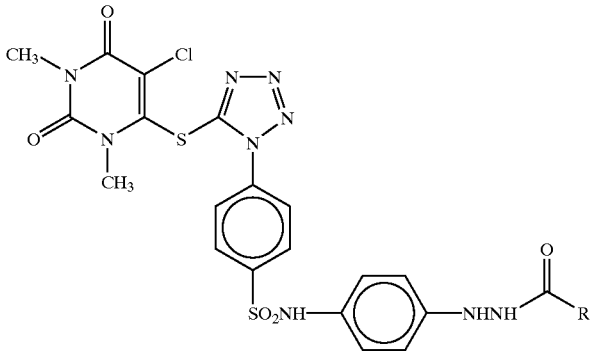 | 24a | 24e | 24k | 24l |
| D-25 | 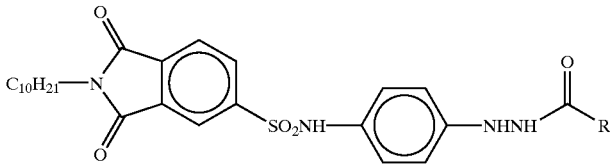 | 25a | 25e | 25k | 25l |
| D-26 | 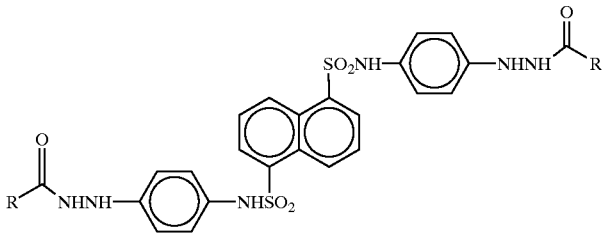 | 26a | 26e | 26k | 26l |

-continued
| | | | | | |
|---|---|---|---|---|---|
| D-27 | 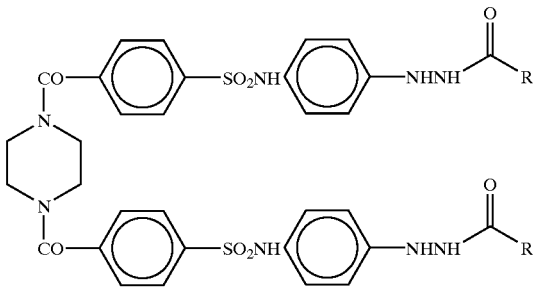 | 27a | 27e | 27k | 27l |
| D-28 | 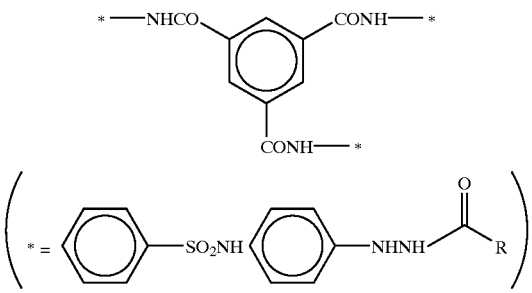 | 28a | 28e | 28k | 28l |
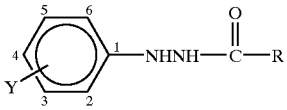
| Y = | R = —H | —$CH_2OCH_3$ | 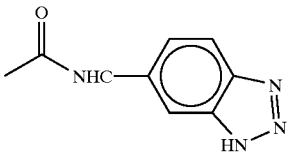 | 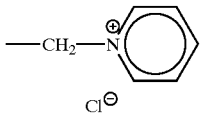 |
|---|---|---|---|---|
| D-29 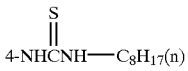 | 29a | 29m | 29n | 29f |
| D-30 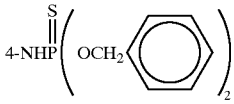 | 30a | 30m | 30n | 30f |
| D-31 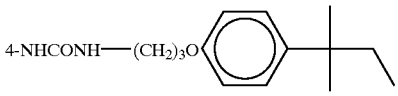 | 31a | 31m | 31n | 31f |
| D-32 4-OH 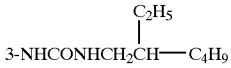 | 32a | 32m | 32n | 32f |
| D-33 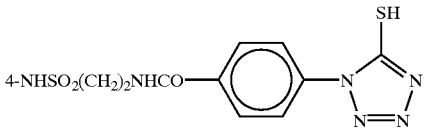 | 33a | 33m | 33n | 33f |
| D-34 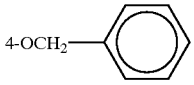 | 34a | 34m | 34n | 34f |

-continued
| | | | | | |
|---|---|---|---|---|---|
| D-35 | 4-NHCONHN—(CH$_2$—C$_6$H$_4$)$_2$ | 35a | 35m | 35n | 35f |
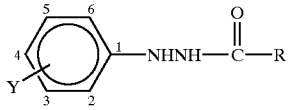
| Y = | R = —H | —C$_3$F$_4$—COOH | —CONHCH$_2$ | 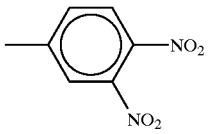 |
|---|---|---|---|---|
| | | | | | |
|---|---|---|---|---|---|
| D-36 | 2-NHSO$_2$CH$_3$— 4-NHCONH(CH$_2$)$_3$S— H | 36a | 36o | 36p | 36q |
| D-37 | 2-OCH$_2$— 4-NHSO$_2$C$_{12}$H$_{25}$ | 37a | 37o | 37p | 37q |
| D-38 | 2-NHCOC$_{11}$H$_{23}$— 4-NHSO$_2$CF$_3$ | 38a | 38o | 38p | 38q |
| D-39 | 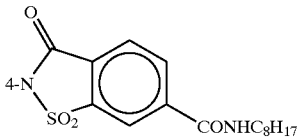 | 39a | 39o | 39p | 39q |
| D-40 | 4-OCO(CH$_2$)$_2$COOC$_6$H$_{13}$ | 40a | 40o | 40p | 40q |
| D-41 | 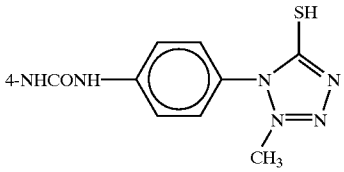 | 41a | 41o | 41p | 41q |
| D-42 | 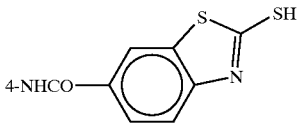 | 42a | 42o | 42p | 42q |
D-43
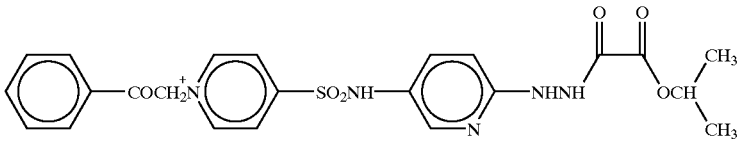
D-44
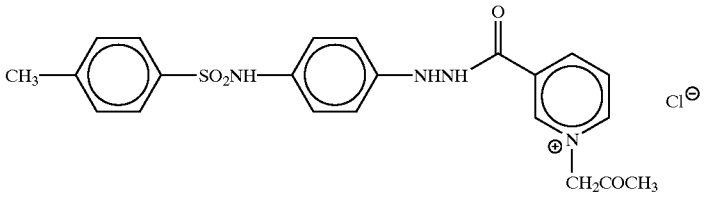

-continued
D-45
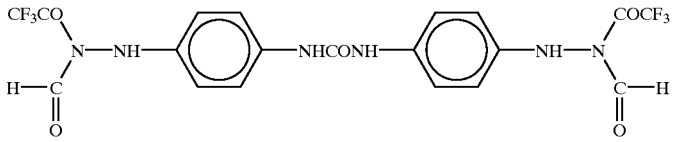
D-46
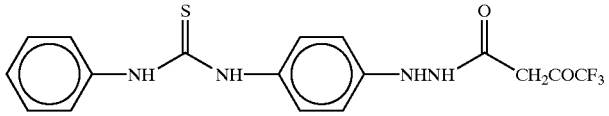
D-47
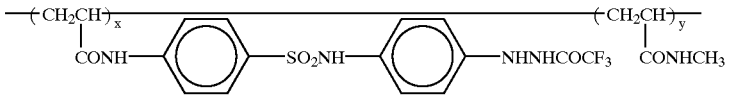
x:y = 3:97
x:y=3:97　　平均分子量ヶ10万
D-48
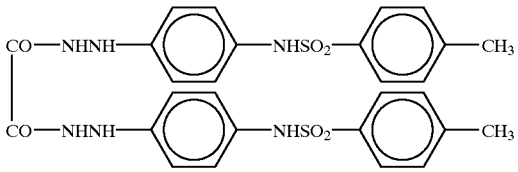
D-49
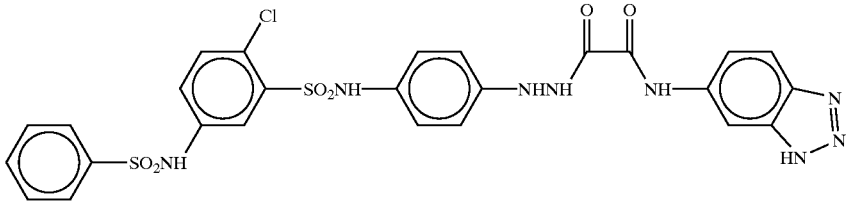
D-50
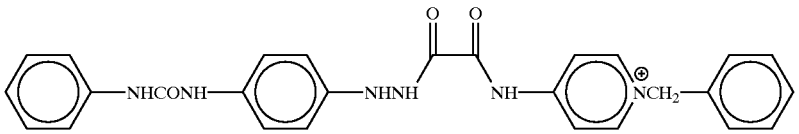
D-51
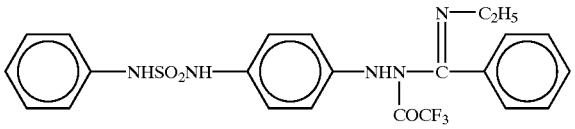
D-52
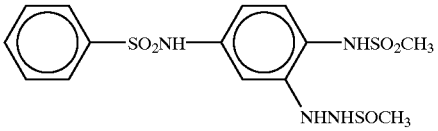
D-53
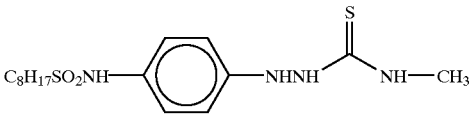
D-54
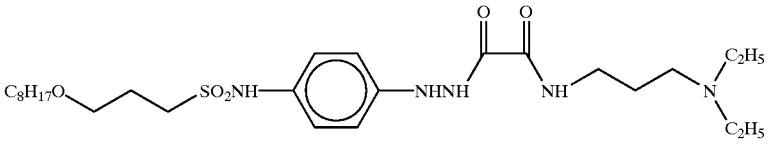

-continued
D-55
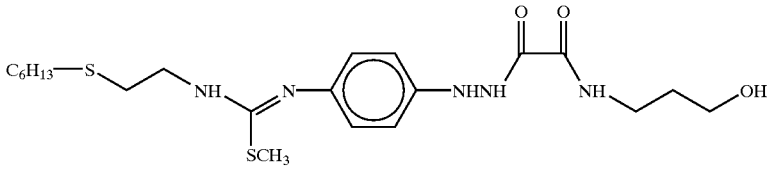
D-56
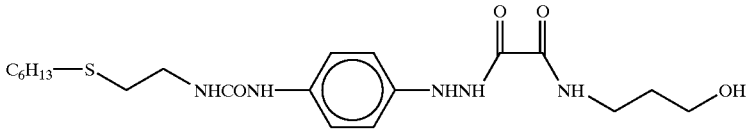
D-57
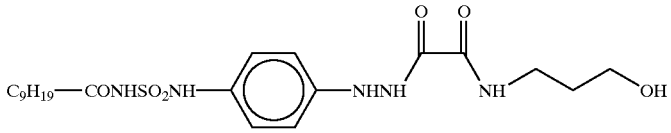
D-58
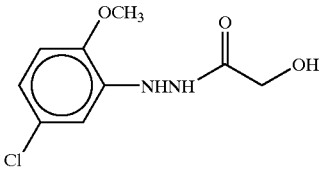
D-59
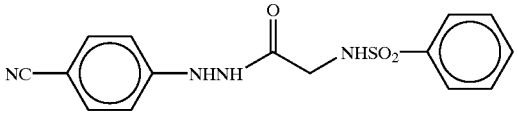
D-60
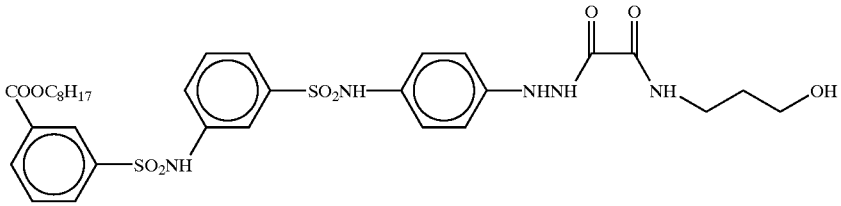
D-61
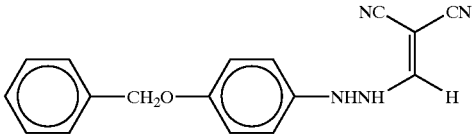
D-62
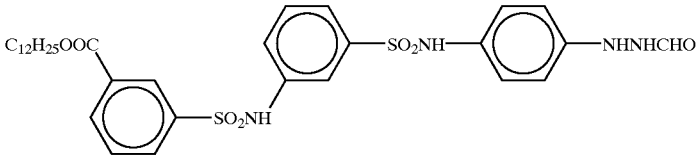
D-63
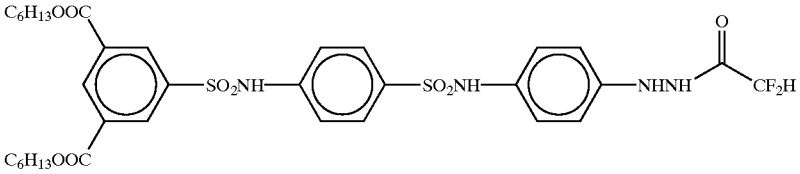

-continued
D-64
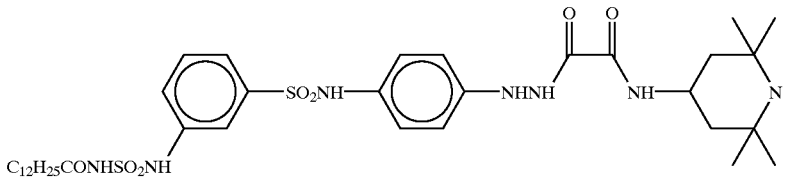
D-65
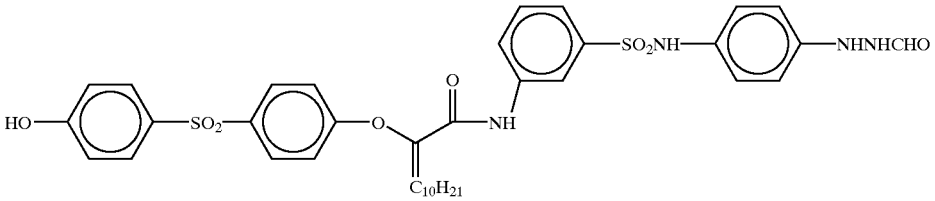
D-66
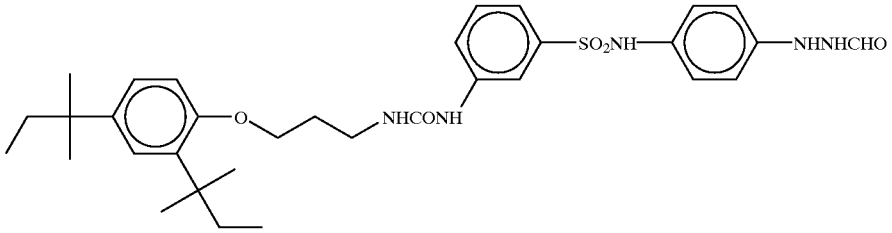
D-67
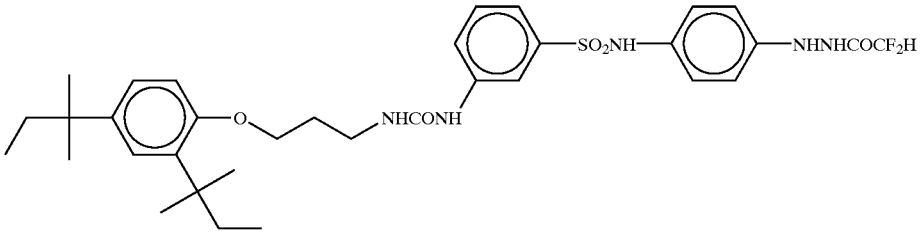
(D-68)
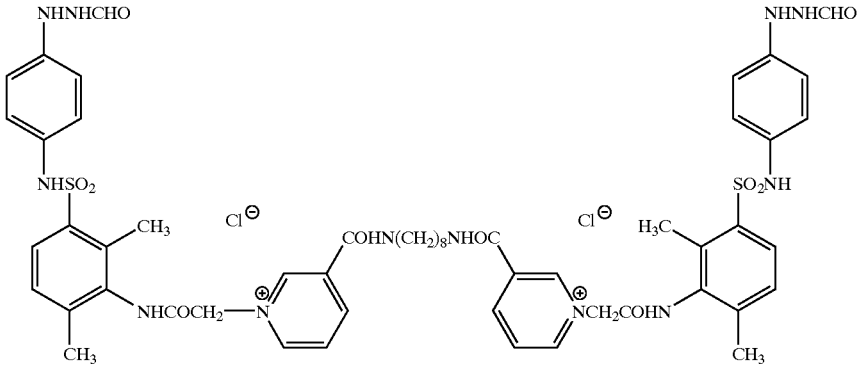

-continued
(D-69)
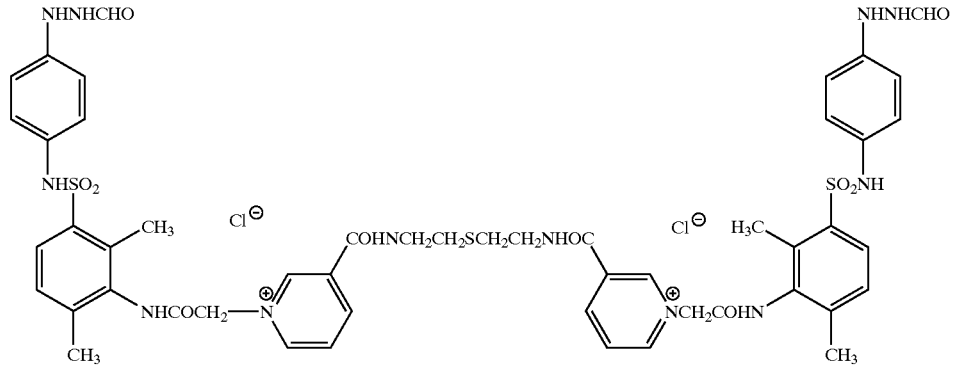
(D-70)
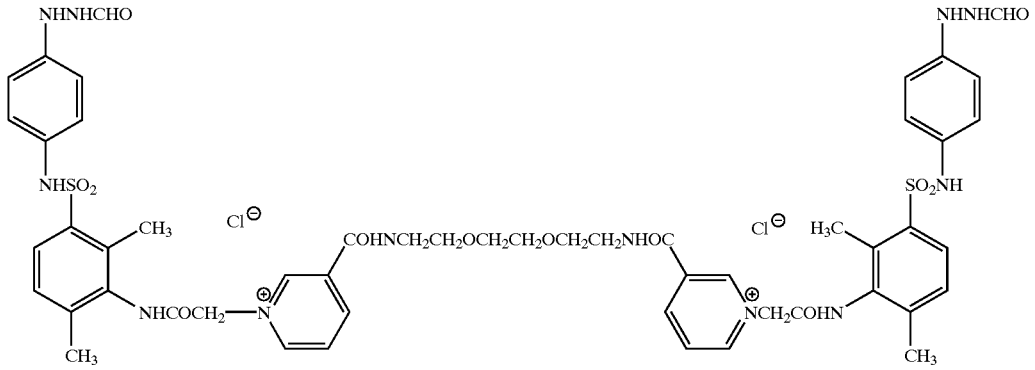
(D-71)
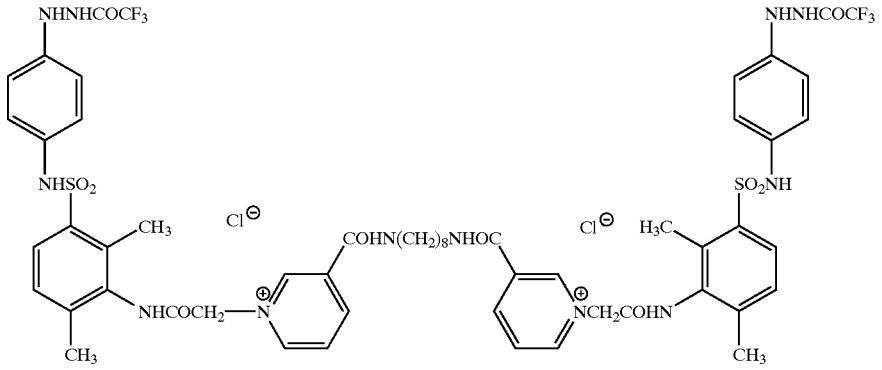
(D-72)
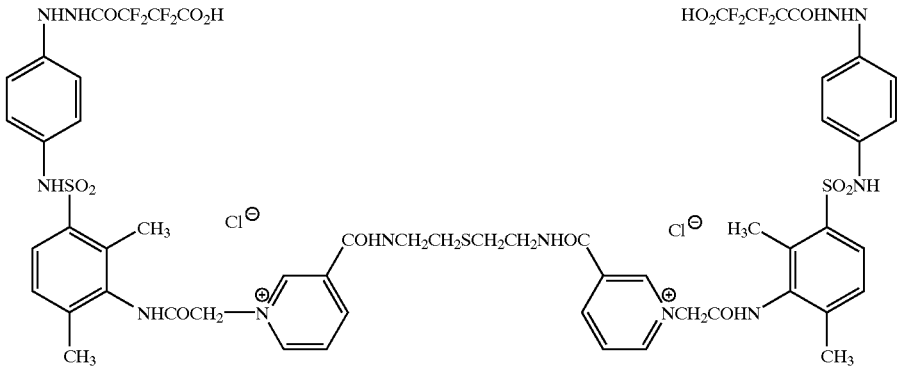

-continued
(D-73)
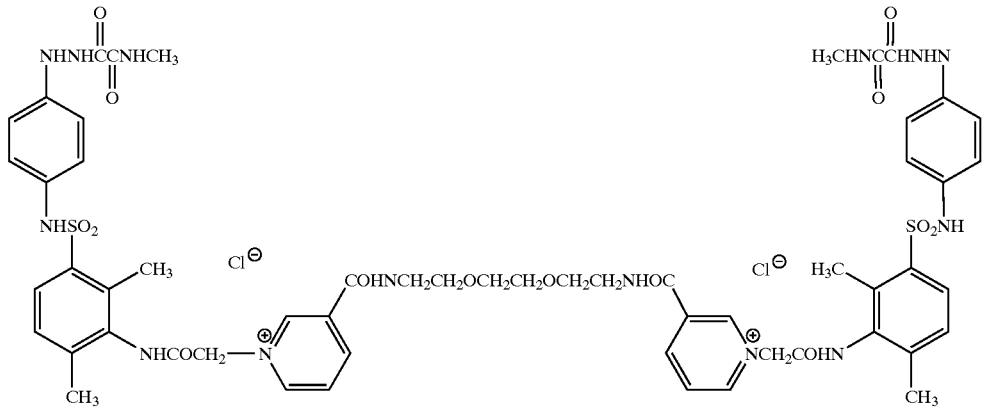
(D-74)
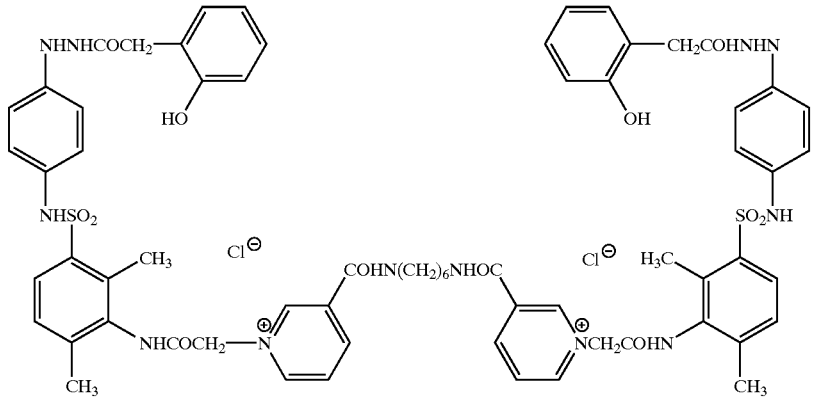
(D-75)
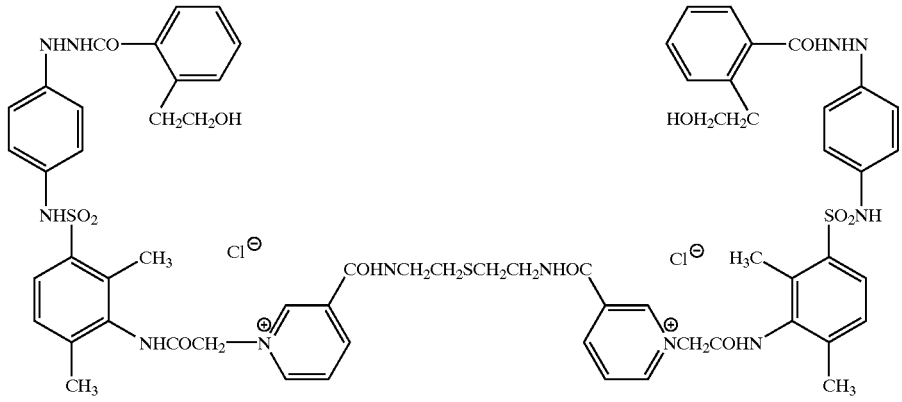

-continued
(D-76)
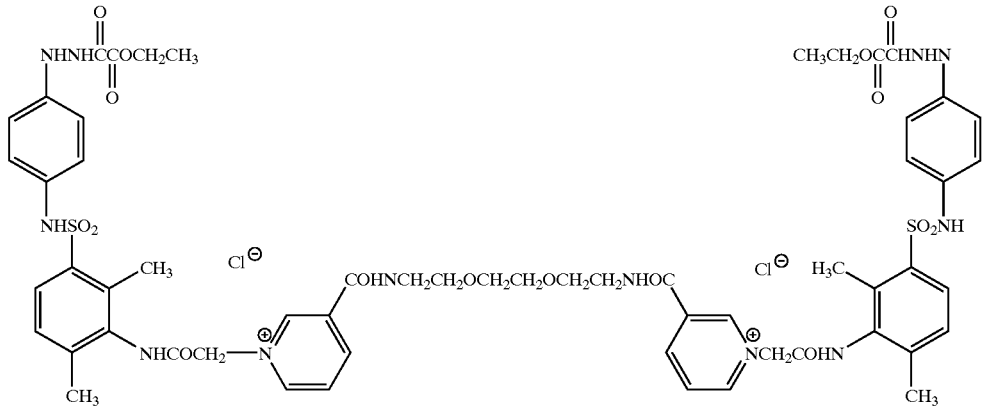
(D-77)
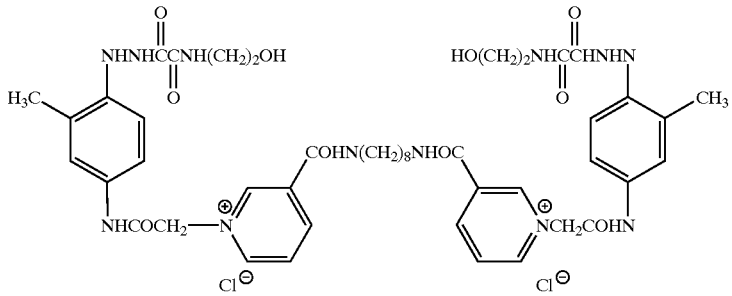
(D-78)
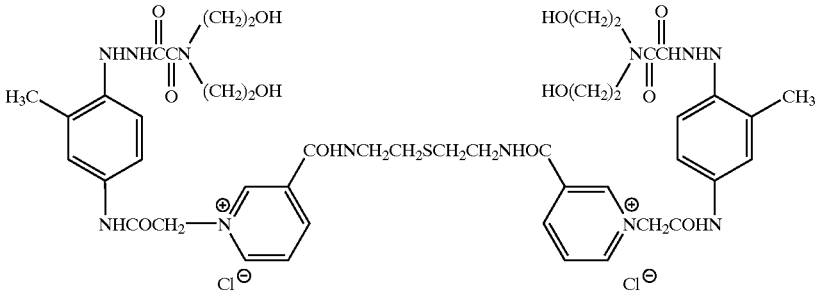
(D-79)
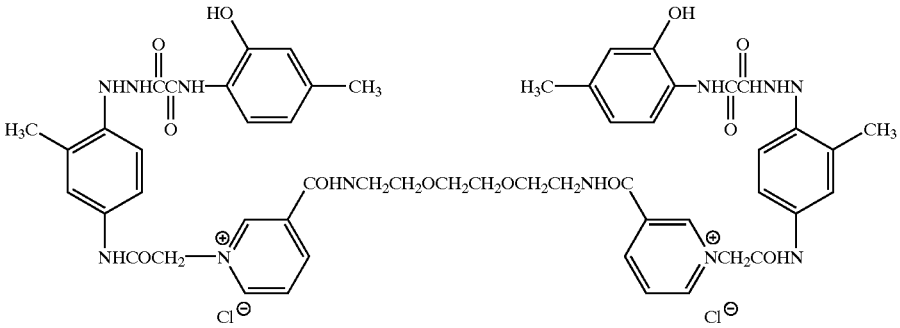

-continued
(D-80)
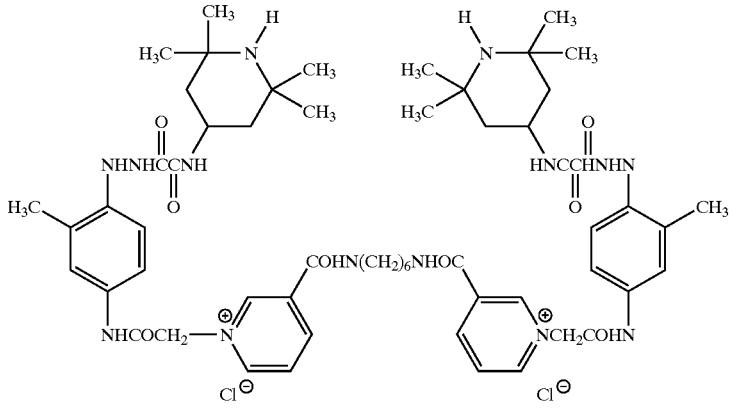
(D-81)
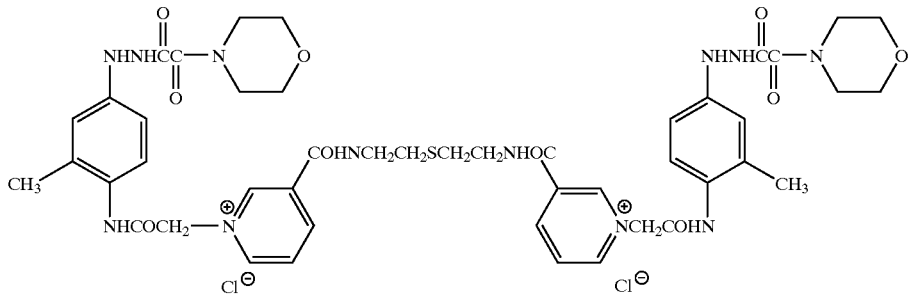
(D-82)
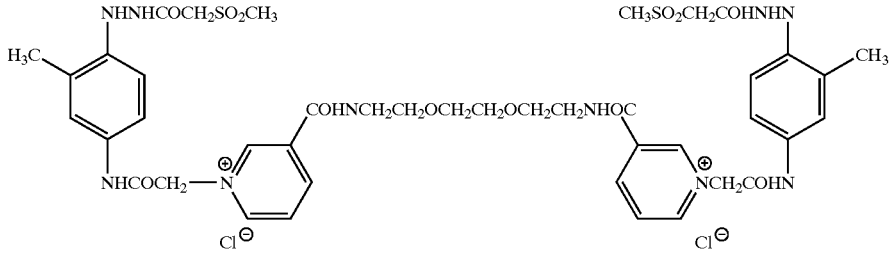
(D-83)
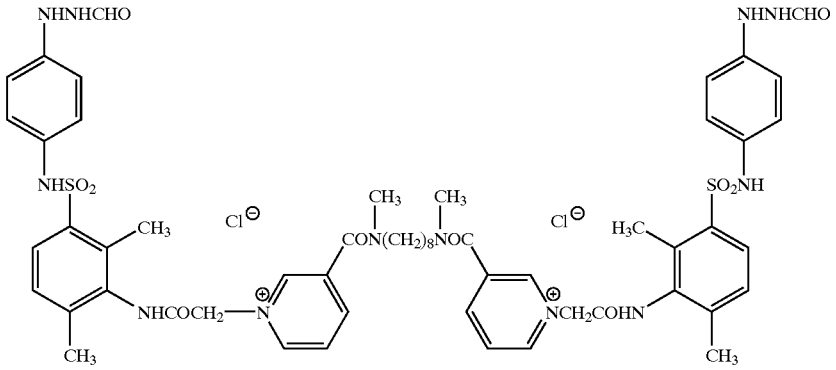

-continued
(D-84)
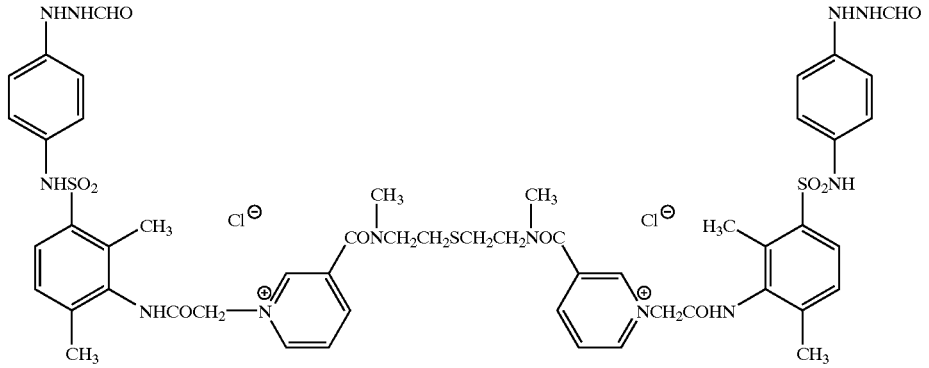
(D-85)
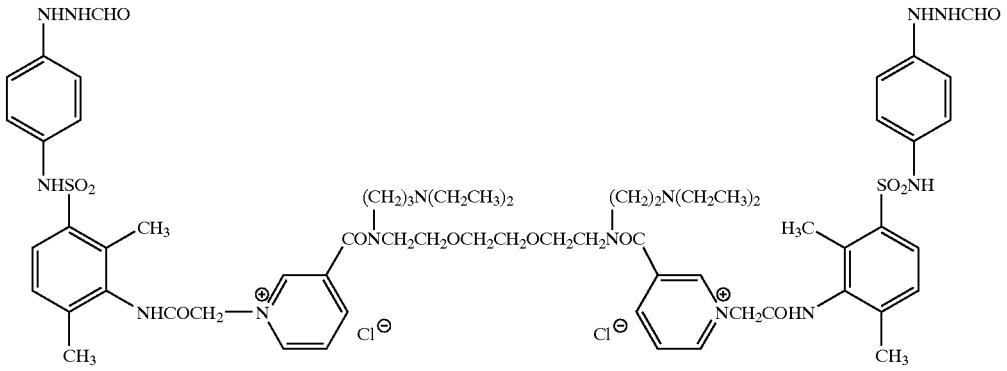
(D-86)
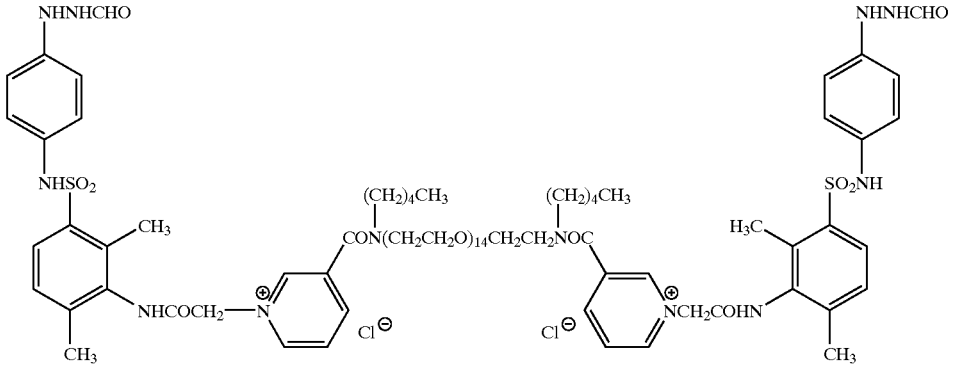
(D-87)
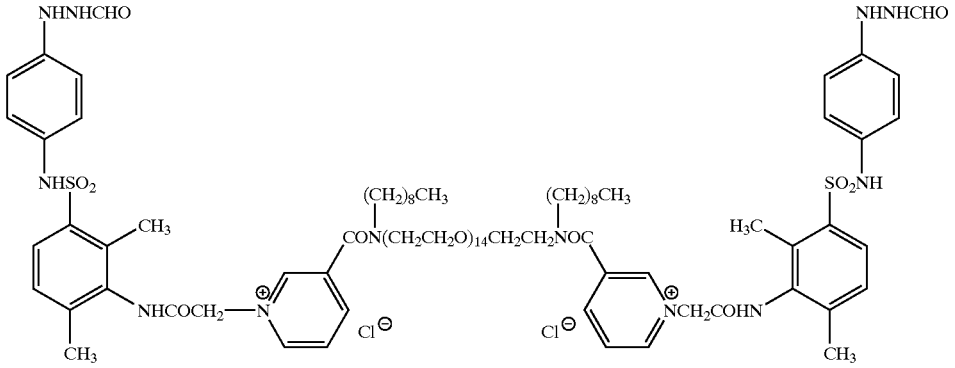

-continued
(D-88)
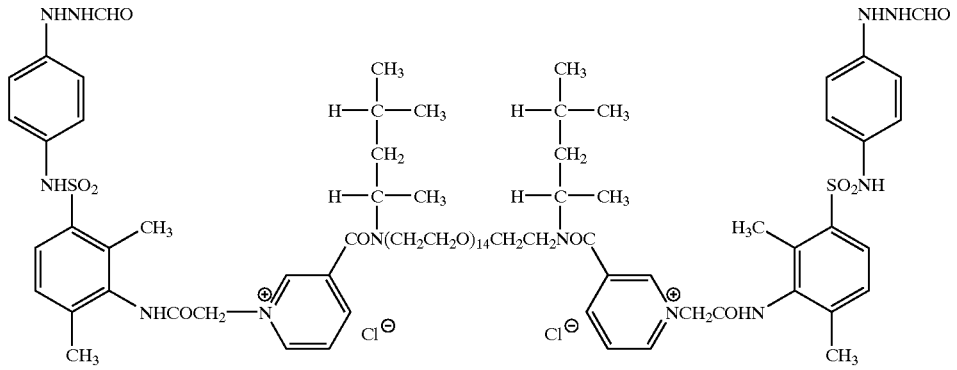
(D-89)
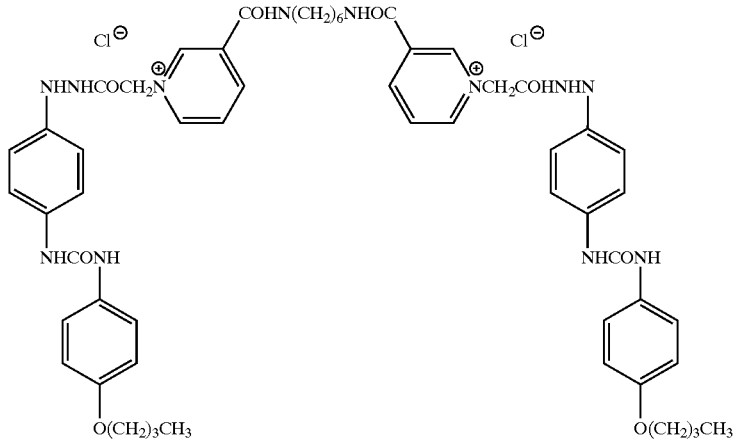
(D-90)
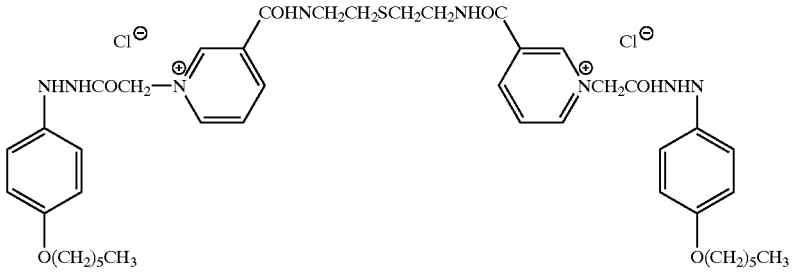
(D-91)
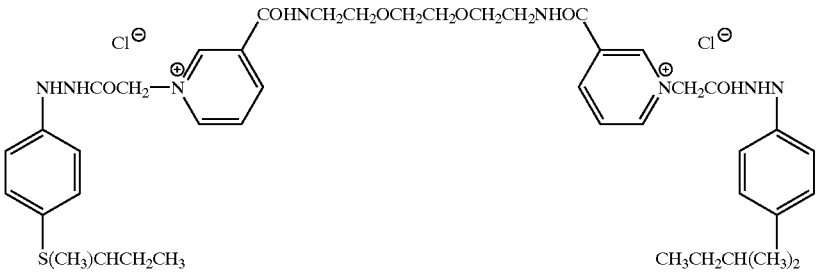

-continued
(D-92)
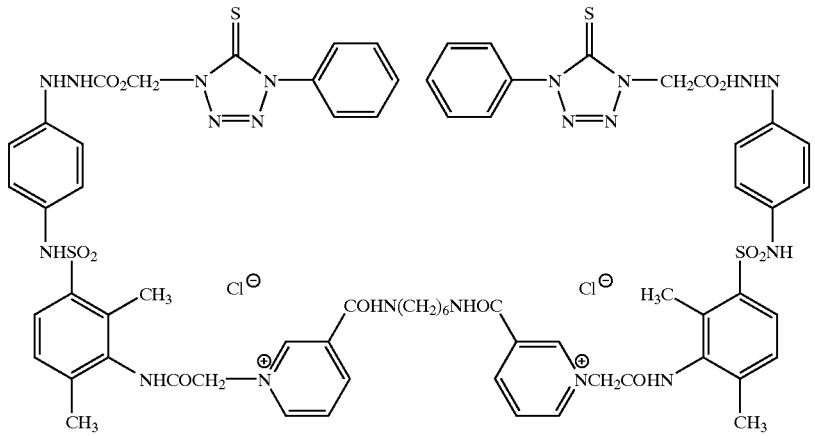
(D-93)
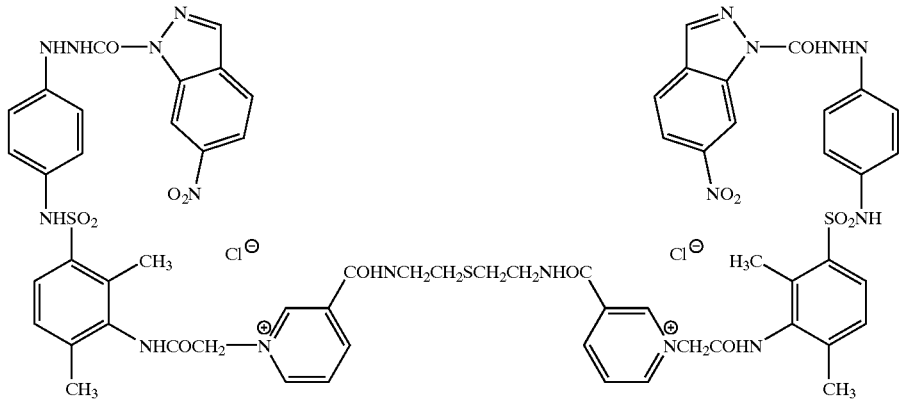
(D-94)
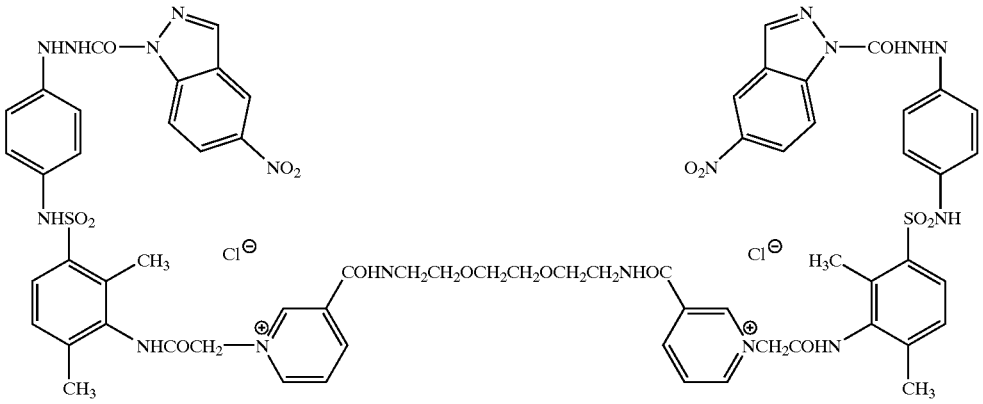

-continued
(D-95)
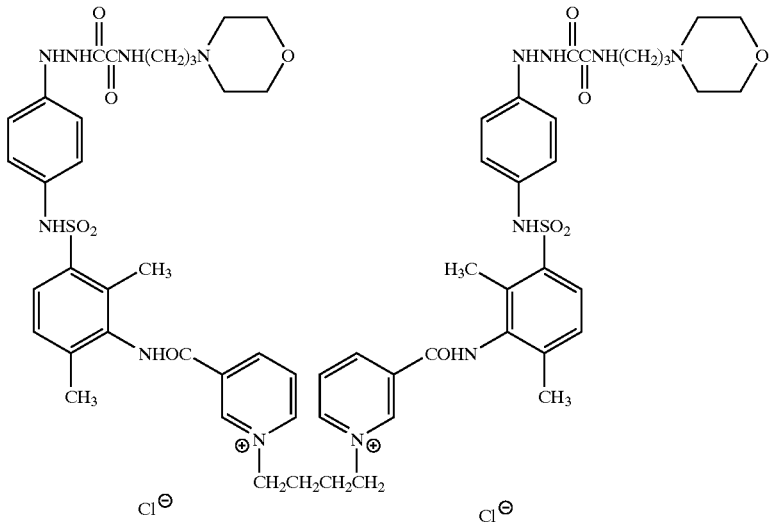
(D-96)
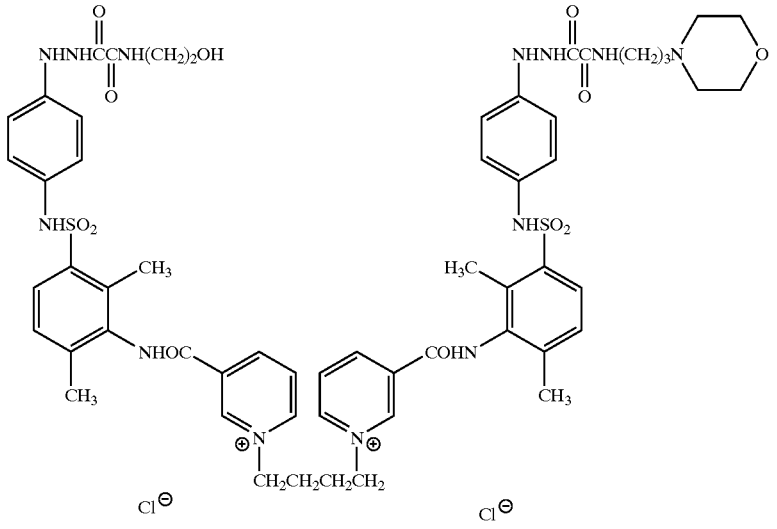
(D-97)
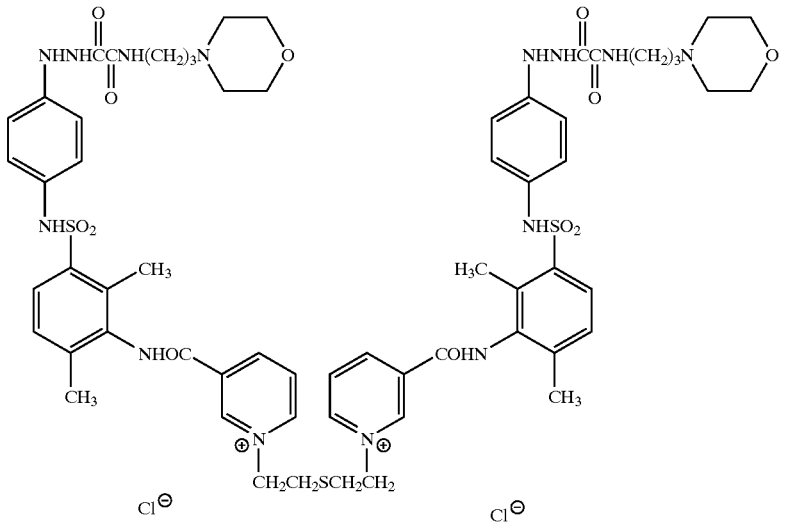

-continued
(D-98)
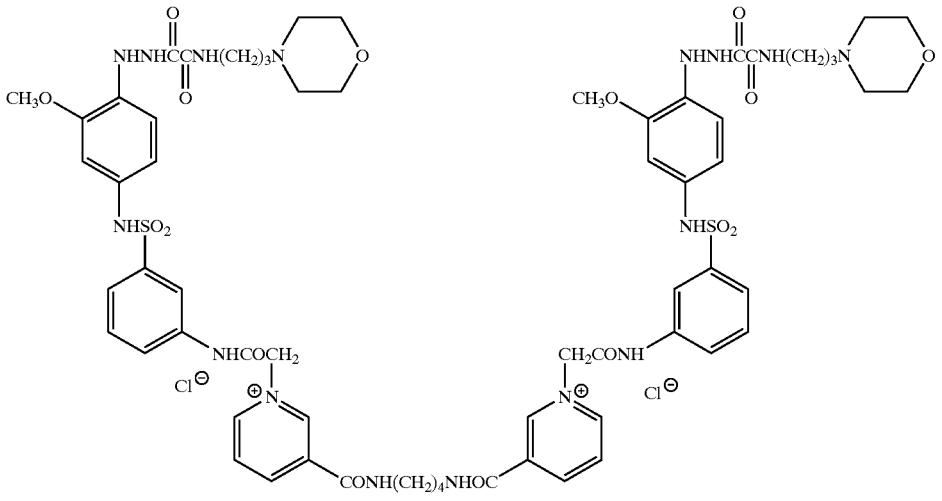
(D-99)
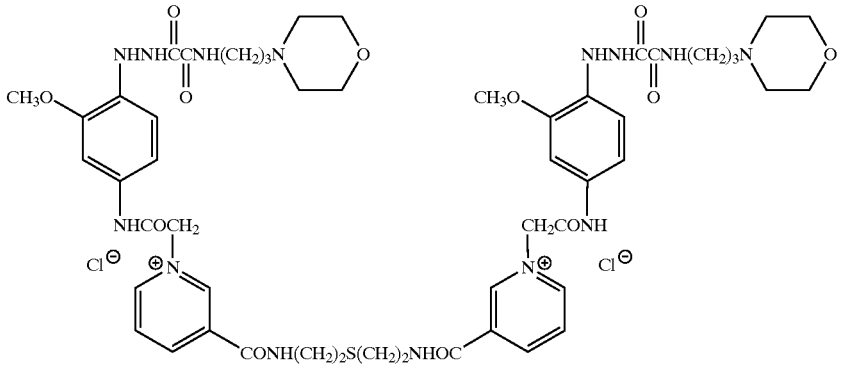
(D-100)
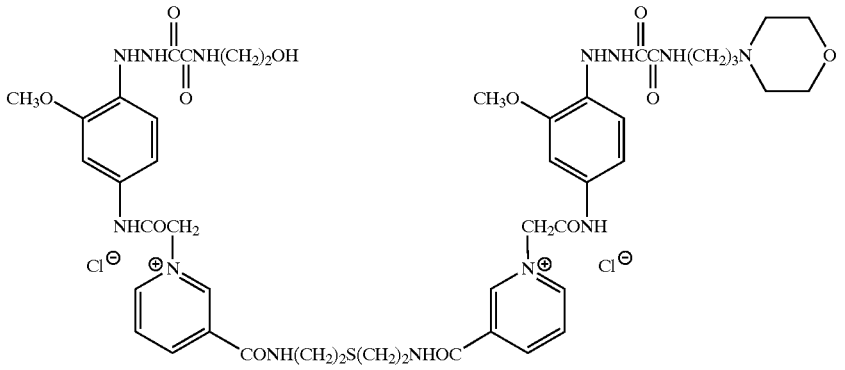

-continued
(D-101)
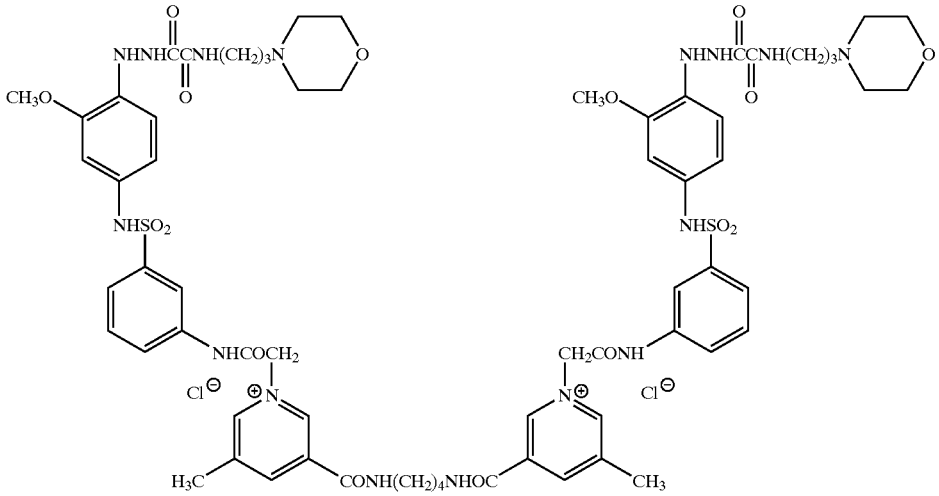
(D-102)
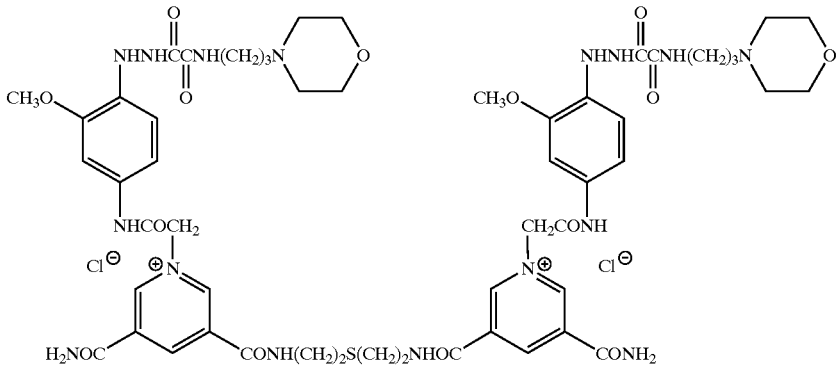
(D-103)
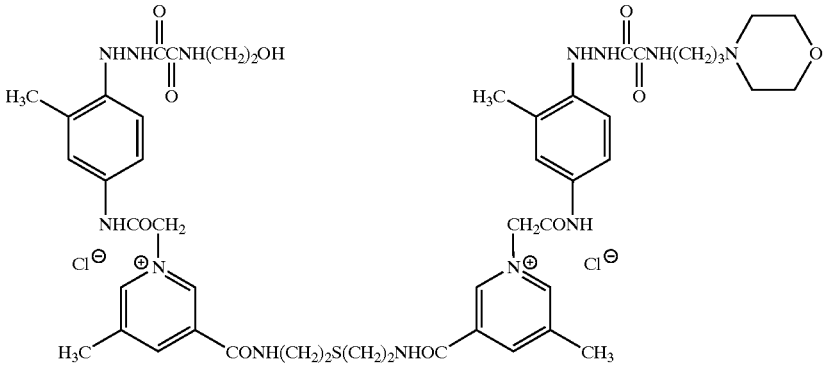

-continued
(D-104)
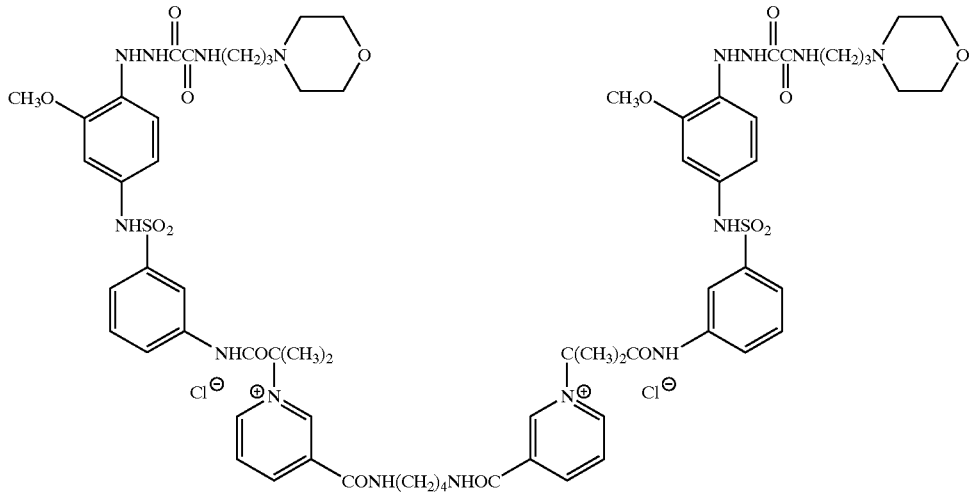
(D-105)
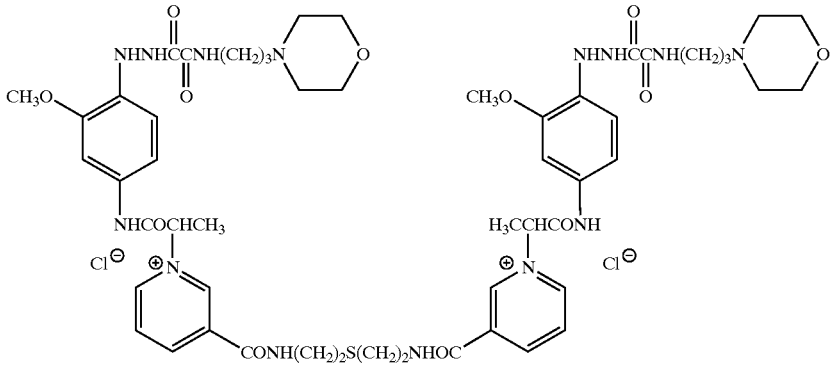
(D-106)
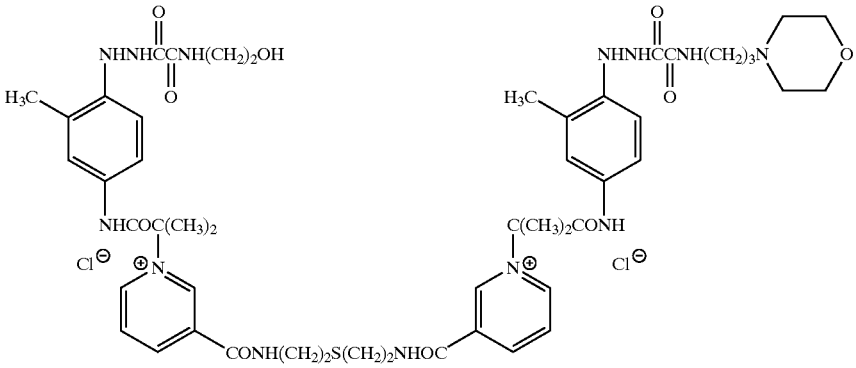

-continued
(D-107)
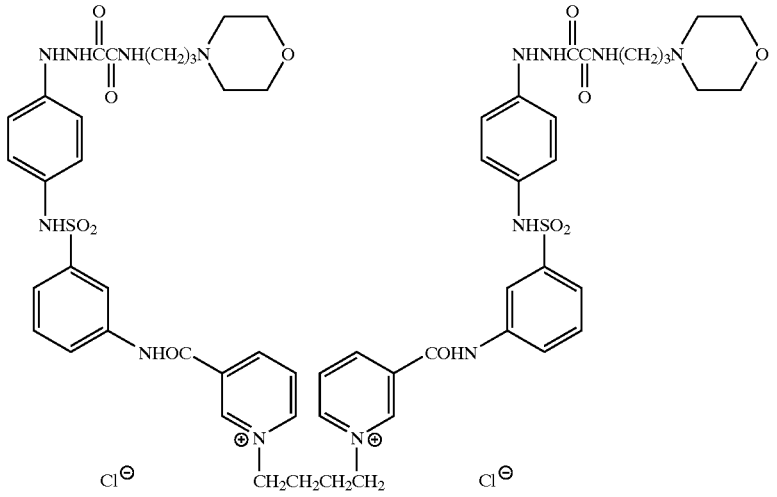
(D-108)
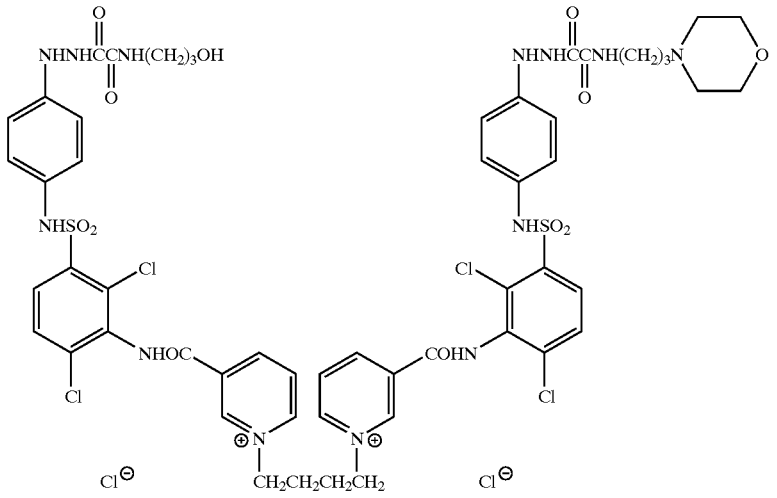
(D-109)
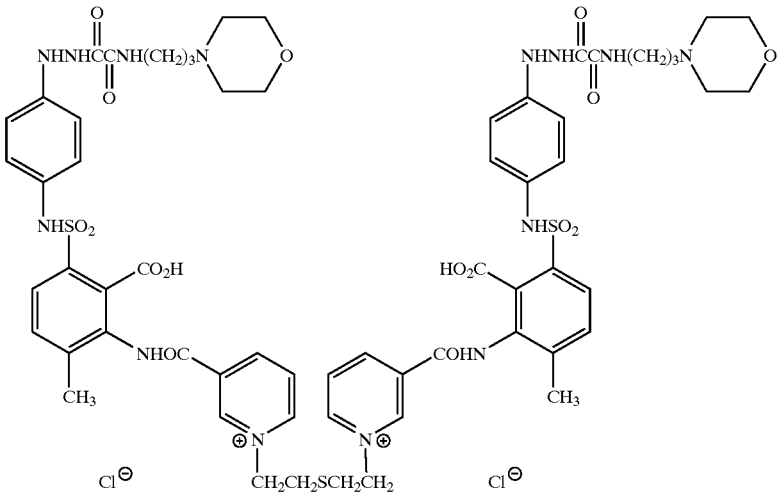

-continued
(D-110)
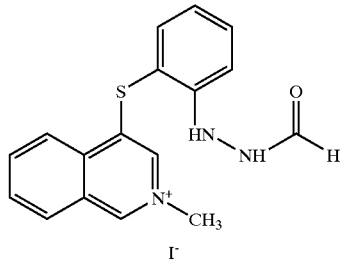
(D-111)
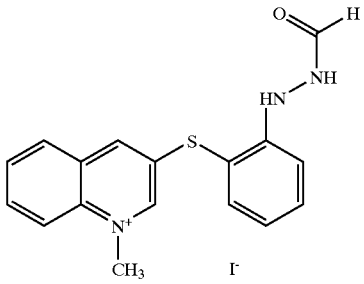
(D-112)
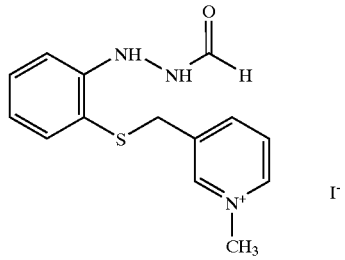
(D-113)
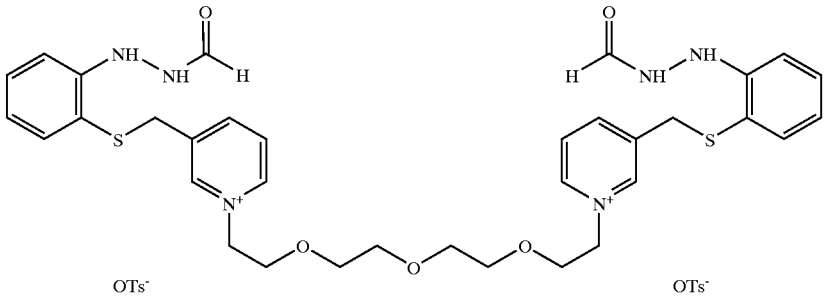
(D-114)
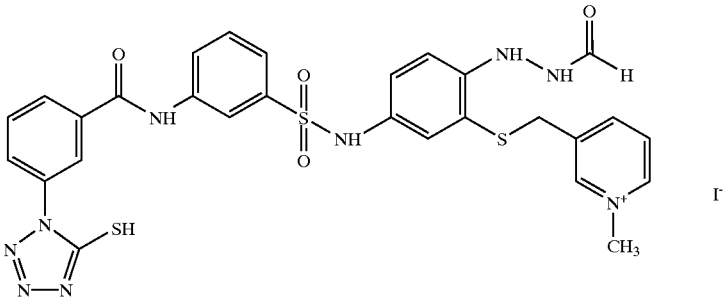

-continued
(D-115)
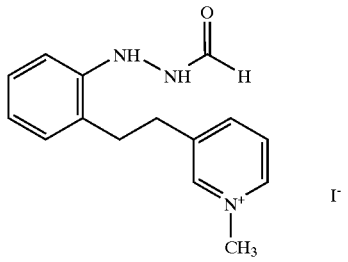
(D-116)
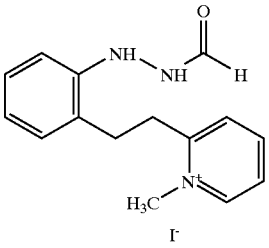
(D-117)
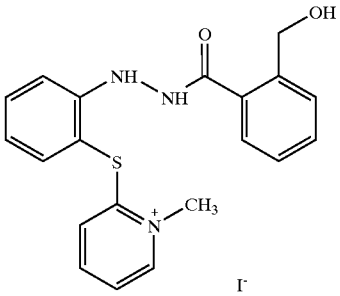
(D-118)
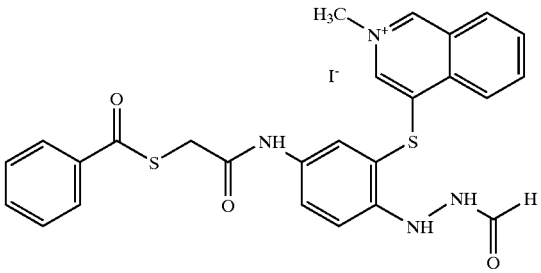
(D-119)
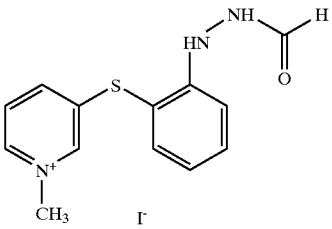
(D-120)
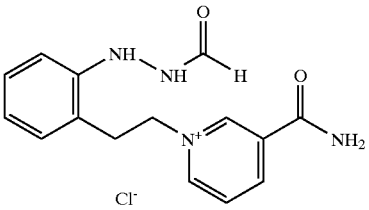

-continued
(D-121)
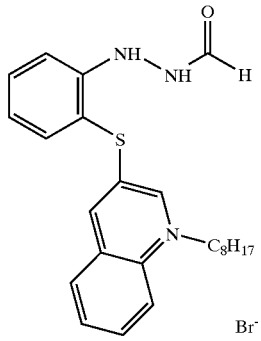
(D-122)
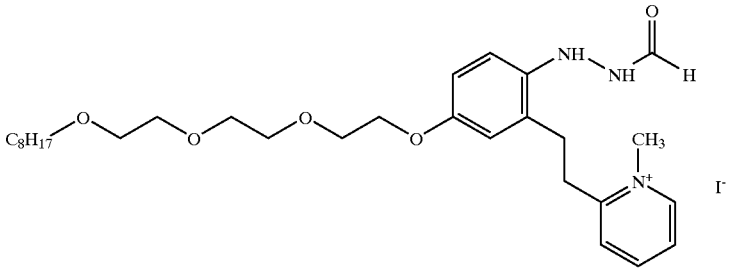
(D-123)
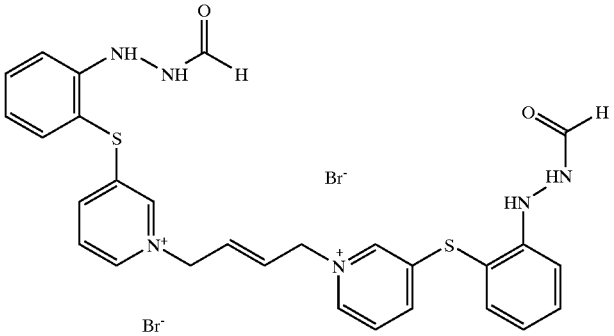
(D-124)
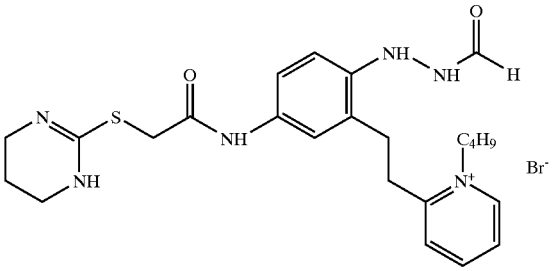
(D-125)
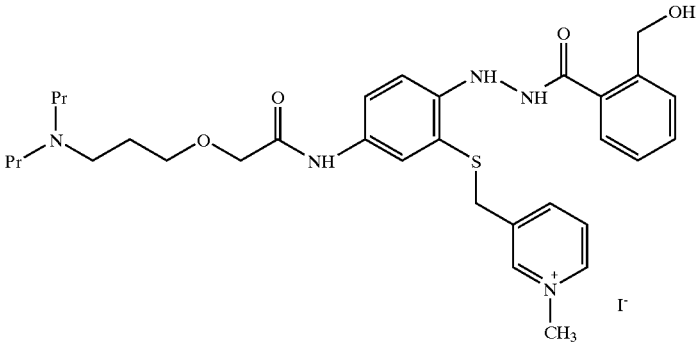

-continued (D-126)

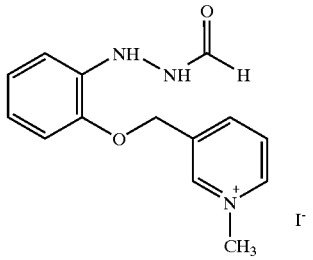

(D-127)

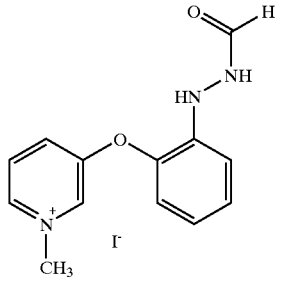

(D-128)

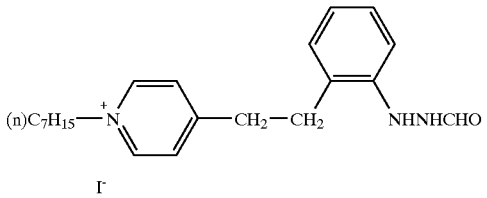

As the hydrazine derivatives used in the present invention, in addition to the above, the following hydrazine derivatives can also preferably be used. The hydrazine derivatives used in the present invention can be synthesized by various methods described in the following patent documents.

That is, there can be mentioned the compounds represented by (Chemical formula 1) described in JP-B-6-77138, specifically, compounds described on pages 3 and 4 of the same; compounds represented by formula (I) described in JP-B-693082, specifically, Compounds 1 to 38 described on pages 8 to 18 of the same; compounds represented by the formulas (4), (5), and (6) described in JP-A-6-230497, specifically, Compound 4-1 to Compound 4-10 described on pages 25 and 26, Compound 5-1 to Compound 5-42 described on pages 28 to 36 and Compound 6-1 to Compound 6-7 described on pages 39 and 40 of the same, respectively; compounds represented by the formulas (1) and (2) described in JP-A-6-289520, specifically, Compounds 1-1) to 1-17) and 2-1) described on pages 5 to 7 of the same; compounds represented by (Chemical formula 2) and (Chemical formula 3) described in JP-A-6-313936, specifically, compounds described on pages 6 to 19 of the same; compounds represented by (Chemical formula 1) described in JP-A-6-313951, specifically, compounds described on pages 3 to 5 of the same; compounds represented by the formula (I) described in JP-A-7-5610, specifically, Compounds I-1 to I-38 described on pages 5 to 10 of the same; compounds represented by the formula (II) described in JP-A-7-77783, specifically, Compounds II-1 to II-102 described on pages 10 to 27 of the same; compounds represented by the formulas (H) and (Ha) described in JP-A-7-104426, specifically, Compounds H-1 to H-44 described on pages 8 to 15 of the same; compounds that have an anionic group or nonionic group for forming an intramolecular hydrogen bond with the hydrogen atom of the hydrazine in the vicinity of the hydrazine group described in JP-A-9-22082, especially compounds represented by the formulas (A), (B), (C), (D), (E) and (F), specifically, Compounds N-1 to N-30 described in the same; compounds represented by the formula (1) described in JP-A-9-22082, specifically, Compounds D-1 to D-55 described in the same as well as the hydrazine derivatives described in WO95/32452, WO95/32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381 and JP-A-10-175946.

In the present invention, the hydrazine nucleating agents may be dissolved in an appropriate water-miscible organic solvent, such as an alcohol (e.g., methanol, ethanol, propanol, fluorinated alcohol), ketone (e.g., acetone, methyl ethyl ketone), dimethylformamide, dimethyl sulfoxide, methyl cellosolve or the like, before use.

The hydrazine nucleating agents may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of hydrazine nucleating agents may be dispersed in water by means of ball mill, colloid mill or ultrasonic waves according to a method known as solid dispersion method and used.

In the present invention, the hydrazine nucleating agent may be added to any layer on the silver halide emulsion layer side with respect to the support. For example, it can be added to a silver halide emulsion layer or another hydrophilic colloid layer. However, it is preferably added to a silver halide emulsion layer or a hydrophilic colloid layer adjacent thereto. Two or more kinds of hydrazine nucleating agents may be used in combination.

The addition amount of the nucleating agent in the present invention is preferably from $1\times10^{-5}$ to $1\times10^{-2}$ mol, more preferably from $1\times10^{-5}$ to $5\times10^{-3}$ mol, most preferably from $2\times10^{-5}$ to $5\times10^{-3}$ mol, per mol of silver halide.

The silver halide photographic light-sensitive material of the present invention may contain a nucleation accelerator.

Examples of the nucleation accelerator used for the present invention include amine derivatives, onium salts, disulfide derivatives, hydroxymethyl derivatives and so forth. Specific examples thereof include the compounds described in JP-A-7-77783, page 48, lines 2 to 37, specifically, Compounds A-1) to A-73) described on pages 49 to 58 of the same; compounds represented by (Chemical formula 21), (Chemical formula 22) and (Chemical formula 23) described in JP-A-7-84331, specifically, compounds described on pages 6 to 8 of the same; compounds represented by formulas [Na] and [Nb] described in JP-A-7-104426, specifically, Compounds Na-1 to Na-22 and Compounds Nb-1 to Nb-12 described on pages 16 to 20 of the same; compounds represented by the formulas (1), (2), (3), (4), (5), (6) and (7) described in JP-A-8-272023, specifically, Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38 mentioned in the same; and nucleation accelerators described in JP-A-9-297377, p.55, column 108, line 8 to p.69, column 136, line 44.

As the nucleation accelerator used for the present invention, the quaternary salt compounds represented by the formulas (a) to (f) are preferred, and the compounds represented by the formula (b) are most preferred.

Formula (a)

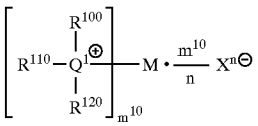

Formula (b)

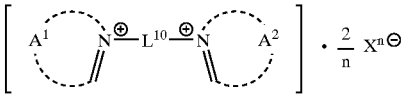

Formula (c)

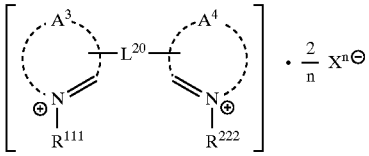

Formula (d)

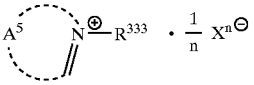

-continued

Formula (e)

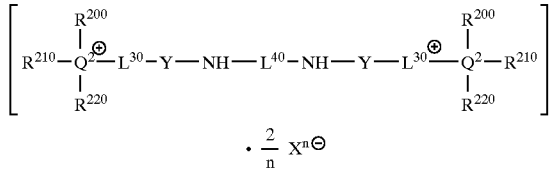

Formula (f)

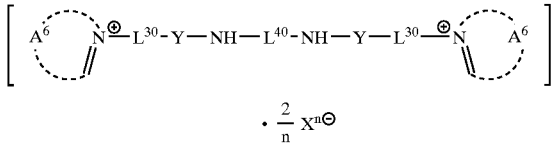

In the formula (a), $Q^1$ represents a nitrogen atom or a phosphorus atom, $R^{100}$, $R^{110}$ and $R^{120}$ each represent an aliphatic group, an aromatic group or a heterocyclic group, and these may bond to each other to form a ring structure. M represents an $m^{10}$-valent organic group bonding to $Q^1$ at a carbon atom contained in M, and $m^{10}$ represents an integer of 1–4.

In the formulas (b), (c) and (d), $A^1$, $A^2$, $A^3$, $A^4$ and $A^5$ each represent an organic residue for completing an unsaturated heterocyclic ring containing a quaternized nitrogen atom, $L^{10}$ and $L^{20}$ represent a divalent bridging group, and $R^{111}$, $R^{222}$ and $R^{333}$ represent a substituent.

The quaternary salt compounds represented by the formula (a), (b), (c) or (d) have 20 or more in total of repeating units of ethyleneoxy group or propyleneoxy group in the molecule, and they may contain the units at two or more sites.

In the formula (e), $Q^2$ represents a nitrogen atom or a phosphorus atom. $R^{200}$, $R^{210}$ and $R^{220}$ represent groups having the same meanings as $R^{100}$, $R^{110}$ and $R^{120}$ in the formula (a)

In the formula (f), $A^6$ represents a group having the same meaning as $A^1$ or $A^2$ in the formula (b). However, the nitrogen-containing unsaturated heterocyclic ring formed with $A^6$ may have a substituent, but it does not have a primary hydroxyl group on the substituent. In the formulas (e) and (f), $L^{30}$ represents an alkylene group, Y represents —C(=O)— or —$SO_2$—, and $L^{40}$ represents a divalent bridging group containing at least one hydrophilic group.

In the formulas (a) to (f), $X^{n-}$ represents an n-valent counter anion, and n represents an integer of 1–3. However, when another anionic group is present in the molecule and it forms an intramolecular salt with $(Q^1)^+$, $(Q^2)^+$ or $N^+$, $X^{n-}$ is not required.

Examples of the aliphatic group represented by $R^{100}$, $R^{110}$ and $R^{120}$ in the formula (a) include a linear or branched alkyl group such as methyl group, ethyl group, propyl group, isopropyl group, butyl group, isobutyl group, sec-butyl group, tert-butyl group, octyl group, 2-ethylhexyl group, dodecyl group, hexadecyl group and octadecyl group; an aralkyl group such as a substituted or unsubstituted benzyl group; a cycloalkyl group such as cyclopropyl groups, cyclopentyl group and cyclohexyl group; an alkenyl group such as allyl group, vinyl group and 5-hexenyl group; a cycloalkenyl group such as cyclopentenyl group and cyclohexenyl group; an alkynyl group such as phenylethynyl group and so forth. Examples of the aromatic group include an aryl group such as phenyl group, naphthyl group and phenanthoryl group, and examples of the heterocyclic group include pyridyl group, quinolyl group, furyl group, imidazolyl group, thiazolyl group, thiadiazolyl group, benzotriazolyl group, benzothiazolyl group, morpholyl group, pyrimidyl group, pyrrolidyl group and so forth.

Examples of the substituent on these groups include, besides the groups represented by $R^{100}$, $R^{110}$ and $R^{120}$, a halogen atom such as fluorine atom, chlorine atom, bromine atom and iodine atom, a nitro group, an (alkyl or aryl)amino group, an alkoxy group, an aryloxy group, an (alkyl or aryl)thio group, a carbonamido group, a carbamoyl group, a ureido group, a thioureido group, a sulfonylureido group, a sulfonamido group, a sulfamoyl group, a hydroxyl group, a sulfonyl group, a carboxyl group (including a carboxylate), a sulfo group (including a sulfonate), a cyano group, an oxycarbonyl group, an acyl group, a heterocyclic group (including a heterocyclic group containing a quaternized nitrogen atom) and so forth. These substituents may be further substituted with any of these substituents.

The groups represented by $R^{100}$, $R^{110}$ and $R^{120}$ in the formula (a) may bond to each other to form a ring structure.

Example of the group represented by M in the formula (a) include, when $m^{10}$ represents 1, the same groups as the groups defined for $R^{100}$, $R^{110}$ and $R^{120}$. When $m^{10}$ represents an integer of 2 or more, M represents an $m^{10}$-valent bridging group bonding to $Q^1$ at a carbon atom contained in M. Specifically, it represents an $m^{10}$-valent bridging group formed with an alkylene group, an arylene group, a heterocyclic group or a group formed from any of these groups in combination with any of —CO— group, —O— group, —N($R^N$)— group, —S— group, —SO— group, —$SO_2$— group and —P═O— group ($R^N$ represents a hydrogen atom or a group selected from the groups defined for $R^{100}$, $R^{110}$ and $R^{120}$, and when a plurality of $R^N$ exist in the molecule, they may be identical to or different from each other or one another, and may bond to each other or one another). M may have an arbitrary substituent, and examples of the substituent include the substituents that can be possessed by the groups represented by $R^{100}$, $R^{110}$ and $R^{120}$.

In the formula (a), $R^{100}$, $R^{110}$ and $R^{120}$ preferably represent a group having 20 or less carbon atoms. When $Q^1$ represents a phosphorus atom, an aryl group having 15 or less carbon atoms is particularly preferred, and when $Q^1$ represents a nitrogen atom, an alkyl group, aralkyl group and aryl group having 15 or less carbon atoms are particularly preferred $m^{10}$ is preferably 1 or 2. When $m^{10}$ represents 1, M is preferably a group having 20 or less carbon atoms, and an alkyl group, aralkyl group and aryl group having 15 or less carbon atoms are particularly preferred. When $m^{10}$ represents 2, the divalent organic group represented by M is preferably a divalent group formed with an alkylene group or an arylene group, or a group formed from either of these groups in combination with any of —CO— group, —O— group, —N($R^N$)— group, —S— group and —$SO_2$— group. When $m^{10}$ represents 2, M is preferably a divalent group having 20 or less carbon atoms and bonding to $Q^1$ at a carbon atom contained in M. When M or $R^{100}$, $R^{110}$ or $R^{120}$ contains a plurality of repeating units of ethyleneoxy group or propyleneoxy group, the preferred ranges for the total carbon numbers mentioned above may not be applied. Further, when $m^{10}$ represents an integer of 2 or more, a plurality of $R^{100}$, $R^{110}$ or $R^{120}$ exist in the molecule. In this case, a plurality of $R^{100}$, $R^{110}$ and $R^{120}$ may be identical to or different from each other or one another.

The quaternary salt compounds represented by the formula (a) contain 20 or more in total of repeating units of ethyleneoxy group or propyleneoxy group in the molecule, and they may exist at one site or two or more site. When $m^{10}$ represents an integer of 2 or more, it is more preferred that 20 or more in total of repeating units of ethyleneoxy group or propyleneoxy group should be contained in the bridging group represented by M.

In the formulas (b), (c) and (d), $A^1$, $A^2$, $A^3$, $A^4$ and $A^5$ represent an organic residue for completing a substituted or unsubstituted unsaturated heterocyclic ring containing a quaternized nitrogen atom, and it may contain a carbon atom, an oxygen atom, a nitrogen atom, a sulfur atom and a hydrogen atom and may be condensed with a benzene ring.

Examples of the unsaturated heterocyclic ring formed by $A^1$, $A^2$, $A^3$, $A^4$ or $A^5$ include pyridine ring, quinoline ring, isoquinoline ring, imidazole ring, thiazole ring, thiadiazole ring, benzotriazole ring, benzothiazole ring, pyrimidine ring, pyrazole ring and so forth. A pyridine ring, quinoline ring and isoquinoline ring are particularly preferred.

The unsaturated heterocyclic ring formed by $A^1$, $A^2$, $A^3$, $A^4$ or $A^5$ together with a quaternized nitrogen atom may have a substituent. Examples of the substituent include the same groups as the substituents that may be possessed by the groups represented by $R^{100}$, $R^{110}$ and $R^{120}$ in the formula (a). The substituent is preferably a halogen atom (in particular, chlorine atom), an aryl group having 20 or less carbon atoms (phenyl group is particularly preferred), an alkyl group, an alkynyl group, a carbamoyl group, an (alkyl or aryl) amino group, an (alkyl or aryl)oxycarbonyl group, an alkoxy group, an aryloxy group, an (alkyl or aryl)thio group, a hydroxyl group, a mercapto group, a carbonamido group, a sulfonamido group, a sulfo group (including a sulfonate), a carboxyl group (including a carboxylate), a cyano group or the like, particularly preferably a phenyl group, an alkylamino group, a carbonamido group, a chlorine atom, an alkylthio group or the like, most preferably a phenyl group.

The divalent bridging group represented by $L^{10}$ or $L^{20}$ is preferably an alkylene group, an arylene group, an alkenylene group, an alkynylene group, a divalent heterocyclic group, —$SO^2$—, —SO—, —O—, —S—, —N($R^{N'}$)—, —C(═O)—, —PO— or a group formed by a combination of any of these. $R^{N'}$ represents an alkyl group, an aralkyl group, an aryl group or a hydrogen atom. The divalent bridging group represented by $L^{10}$ or $L^{20}$ may have an arbitrary substituent. Examples of the substituent include the substituents that may be possessed by the groups represented by $R^{100}$, $R^{110}$ and $R^{120}$ in the formula (a). Particularly preferred examples of $L^{10}$ or $L^{20}$ are an alkylene group, an arylene group, —C(═O)—, —O—, —S—, —$SO_2$—, —N($R^{N'}$)— and a group formed by a combination of any of these.

$R^{111}$, $R^{222}$ and $R^{333}$ preferably represent an alkyl group or aralkyl group having 1–20 carbon atoms, and they may be identical to or different from one another. $R^{111}$, $R^{222}$ and $R^{333}$ may have a substituent, and examples of the substituent include the substituents that may be possessed by the groups represented by $R^{100}$, $R^{110}$ and $R^{120}$ in the formula (a). $R^{111}$, $R^{222}$ and $R^{333}$ each particularly preferably represent an alkyl group or aralkyl group having 1–10 carbon atoms. Preferred examples of the substituent thereof include a carbamoyl group, an oxycarbonyl group, an acyl group, an aryl group, a sulfo group (including a sulfonate), a carboxyl group (including a carboxylate), a hydroxyl group, an (alkyl or aryl)amino group and an alkoxy group.

However, when a plurality of repeating units of ethyleneoxy group or propyleneoxy group are included in $R^{111}$, $R^{222}$ or $R^{333}$, the preferred ranges for the total carbon numbers mentioned above for $R^{111}$, $R^{222}$ and $R^{333}$ shall not be applied.

The quaternary salt compounds represented by the formula (b) or (c) contain 20 or more in total of repeating units of ethyleneoxy group or propyleneoxy group in the molecule, and they may exist at one site or two or more site and may be contained any of $A^1$, $A^2$, $A^3$, $A^4$, $R^{111}$, $R^{222}$, $L^{10}$ and $L^{20}$. However, it is preferred that 20 or more in total of repeating units of ethyleneoxy group or propyleneoxy group should be contained in the bridging group represented by $L^{10}$ or $L^{20}$.

The quaternary salt compounds represented by the formula (d) contain 20 or more in total of repeating units of ethyleneoxy group or propyleneoxy group in the molecule, and they may exist at one site or two or more site and may be contained any of $A^5$ and $R^{333}$. However, it is preferred that 20 or more in total of repeating units of ethyleneoxy group or propyleneoxy group should be contained in the group represented by $R^{333}$.

The quaternary salt compounds represented by the formula (a), (b), (c) or (d) may contain both of a repeating unit of ethyleneoxy group and a repeating unit of propyleneoxy group. Further, when a plurality of repeating units of ethyleneoxy group or propyleneoxy group are contained, number of the repeating units may be defined strictly as one number or defined as an average number. In the latter case, each quaternary salt compound consists of a mixture having a certain degree of molecular weight distribution.

In the present invention, preferably 20 or more, more preferably 20–67, in total of repeating units of ethyleneoxy group should be contained.

In the formula (e), $Q^2$, $R^{200}$, $R^{210}$ and $R^{220}$ represent groups having the same meanings as $Q^1$, $R^{100}$, $R^{110}$ and $R^{120}$ in the formula (a), respectively, and the preferred ranges thereof are also the same.

In the formula (f), $A^6$ represents a group having the same meaning as $A^1$ or $A^2$ in the formula (b), and the preferred range thereof is also the same. The nitrogen-containing unsaturated heterocyclic ring formed with $A^6$ in the formula (f) together with a quaternized nitrogen atom may have a substituent, provided that it does not have a substituent containing a primary hydroxyl group.

In the formulas (e) and (f), $L^{30}$ represents an alkylene group. The alkylene group is preferably a linear, branched or cyclic substituted or unsubstituted alkylene group having 1–20 carbon atoms. Moreover, it includes not only a saturated alkylene group, of which typical example is ethylene group, but also an alkylene group containing an unsaturated group, of which typical examples are $—CH_2C_6H_4CH_2—$ and $—CH_2CH{=}CHCH_2—$. Further, when $L^{30}$ has a substituent, examples of the substituent include the examples of the substituent that may be possessed by the groups represented by $R^{100}$, $R^{110}$ and $R^{120}$ in the formula (a)

$L^{30}$ is preferably a linear or branched saturated group having 1–10 carbon atoms. More preferably, it is a substituted or unsubstituted methylene group, ethylene group or trimethylene group, particularly preferably a substituted or unsubstituted methylene group or ethylene group, most preferably a substituted or unsubstituted methylene group.

In the formulas (e) and (f), $L^{40}$ represents a divalent bridging group having at least one hydrophilic group. The hydrophilic group used herein represents $—SO_2—$, —SO—, —O—, —P(=O)=, —C(=O)—, —CONH—, $—SO_2NH—$, $—NHSO_2NH—$, —NHCONH—, an amino group, a guanidino group, an ammonio group, a heterocyclic group containing a quaternized nitrogen atom or a group consisting of a combination of these groups. $L^{40}$ is formed by an arbitrary combination of any of these hydrophilic groups and an alkylene group, an alkenylene group, an arylene group or a heterocyclic group.

The groups constituting $L^{40}$ such as an alkylene group, an arylene group, an alkenylene group and a heterocyclic group may have a substituent. Examples of the substituent include examples of the substituents that can be possessed by the groups represented by $R^{100}$, $R^{110}$ and $R^{120}$ in the formula (a).

Although the hydrophilic group in $L^{40}$ may exist so as to interrupt $L^{40}$ or as a part of a substituent on $L^{40}$, it is more preferably exist so as to interrupt $L^{40}$. For example, there can be mentioned a case where any one of —C(=O)—, $—SO_2—$, —SO—, —O—, —P(=O)=, —CONH—, $—SO_2NH—$, $—NHSO_2NH—$, —NHCONH—, a cationic group (specifically, a quaternary salt structure of nitrogen or phosphorus or a nitrogen-containing heterocyclic ring containing a quaternized nitrogen atom), an amino group and a guanidine group or a divalent group consisting of an arbitrary combination of these groups exists so as to interrupt $L^{40}$.

One of preferred examples of the hydrophilic group of $L^{40}$ is a group having a plurality of repeating units of ethyleneoxy group or propyleneoxy group consisting of a combination of ether bonds and alkylene groups. The polymerization degree or average polymerization degree of such a group is preferably 2–67.

The hydrophilic group of $L^{40}$ also preferably contains a dissociating group obtained as a result of combination of groups of $—SO_2—$, —SO—, —O—, —P(=O)=, —C(=O)—, —CONH—, $—SO_2NH—$, $—NHSO_2NH—$, —NHCONH—, an amino group, a guanidino group, an ammonio group, a heterocyclic group containing a quaternized nitrogen atom and so forth, or as a substituent on $L^{40}$. The dissociating group referred to herein means a group or partial structure having a proton of low acidity that can be dissociated with an alkaline developer, or a salt thereof. Specifically, it means, for example, a carboxy group (—COOH), a sulfo group ($—SO_3H$), a phosphonic acid group ($—PO_3H$), a phosphoric acid group ($—OPO_3H$), a hydroxy group (—OH), a mercapto group (—SH), $—SO_2NH_2$ group, N-substituted sulfonamido group ($—SO_2NH—$, $—CONHSO_2—$ group, $—SO_2NHSO_2—$ group), —CONHCO— group, an active methylene group, —NH— group contained in a nitrogen-containing heterocyclic group, salts thereof etc.

$L^{40}$ consisting of a suitable combination of an alkylene group or arylene group with-C (=O)—, $—SO_2—$, —O—, —CONH—, $—SO_2NH—$, $—NHSO_2NH—$, —NHCONH— or an amino group is preferably used. More preferably, L consisting of a suitable combination of an alkylene group having 2–5 carbon atoms with —C(=O)—, $—SO_2—$, —O—, —CONH—, $—SO_2NH—$, $—NHSO_2NH—$ or —NHCONH— is used.

Y represents —C(=O)— or $—SO_2—$, —C(=O)— is preferably used.

Example of the counter anion represented by $X^{n-}$ in the formulas (a) to formula (f) include a halide ion such as chloride ion, bromide ion and iodide ion, a carboxylate ion such as acetate ion, oxalate ion, fumarate ion and benzoate ion, a sulfonate ion such as p-toluenesulfonate ion, methanesulfonate ion, butanesulfonate ion and benzenesulfonate ion, a sulfate ion, a perchlorate ion, a carbonate ion, a nitrate ion and so forth.

As the counter anion represented by $X^{n-}$, a halide ion, a carboxylate ion, a sulfonate ion and a sulfate ion are preferred, and n is preferably 1 or 2. As $X^{n-}$, a chloride ion or a bromide ion is particularly preferred, and a chloride ion is the most preferred.

However, when another anionic group is present in the molecule and it forms an intramolecular salt with $(Q^1)^+$, $(Q^2)^+$ or $N^+$, $X^{n-}$ is not required.

As the quaternary salt compound used in the present invention, the quaternary salt compounds represented by the formula (b), (c) or (f) are more preferred, and the quaternary salt compounds represented by the formula (b) or (f) are particularly preferred. Further, in the formula (b), preferably 20 or more, particularly preferably 20–67, of repeating units of ethyleneoxy group should be contained in the bridging group represented by $L^{10}$. Further, in the formula (f), the unsaturated heterocyclic compound formed with $A^6$ particularly preferably represents 4-phenylpyridine, isoquinoline or quinoline.

Specific examples of the quaternary salt compounds represented by any of the formulas (a) to (f) are listed below. In the following formulas, Ph represents a phenyl group. However, the present invention is not limited to the following exemplary compounds.

| | $Q^+$-$L_o$-$Q^+$.2$X^-$ | | |
|---|---|---|---|
| No. | $Q^+$ = | $L_o$ = | $X^-$ = |
| 1 | 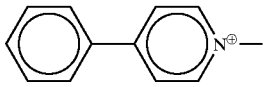 | $—C_2H_4—(OC_2H_4)_n—OC_2H_4—$<br>n = 20 | $Cl^{\ominus}$ |
| 2 | 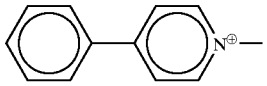 | $—C_2H_4—(OC_2H_4)_n—OC_2H_4—$<br>n ≈ 32 | $Cl^{\ominus}$ |
| 3 | 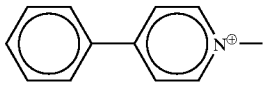 | $—C_2H_4—(OC_2H_4)_n—OC_2H_4—$<br>n ≈ 43 | $Cl^{\ominus}$ |
| 4 | 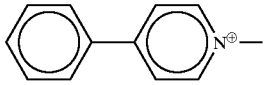 | $—C_2H_4—(OC_2H_4)_n—OC_2H_4—$<br>n ≈ 62 | $Cl^{\ominus}$ |
| 5 | 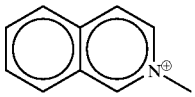 | $—C_2H_4—(OC_2H_4)_n—OC_2H_4—$<br>n ≈ 21 | $Cl^{\ominus}$ |
| 6 | 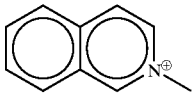 | $—C_2H_4—(OC_2H_4)_n—OC_2H_4—$<br>n ≈ 43 | $Cl^{\ominus}$ |
| 7 | 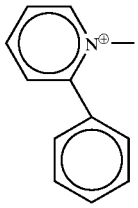 | $—C_2H_4—(OC_2H_4)_n—OC_2H_4—$<br>n = 20 | $Cl^{\ominus}$ |
| 8 | 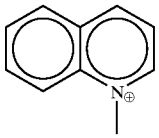 | $—C_2H_4—(OC_2H_4)_n—OC_2H_4—$<br>n ≈ 43 | $Cl^{\ominus}$ |
| 9 | 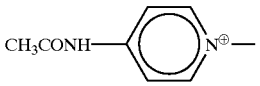 | $—C_2H_4—(OC_2H_4)_n—OC_2H_4—$<br>n ≈ 21 | $Cl^{\ominus}$ |
| 10 | 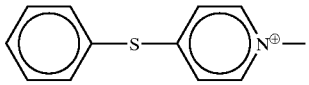 | $—C_2H_4—(OC_2H_4)_n—OC_2H_4—$<br>n ≈ 43 | $Cl^{\ominus}$ |
| 11 | 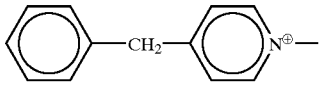 | $—C_2H_4—(OC_2H_4)_n—OC_2H_4—$<br>n ≈ 67 | $Cl^{\ominus}$ |

-continued
| | | | |
|---|---|---|---|
| 12 | 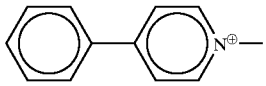 | 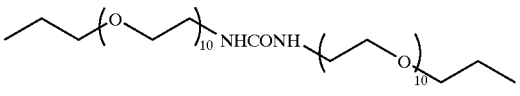 | $Cl^{\ominus}$ |
| 13 | 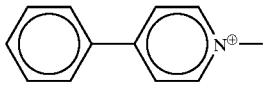 | 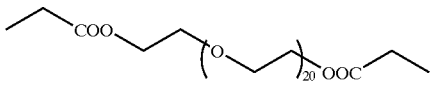 | $Cl^{\ominus}$ |
| 14 | 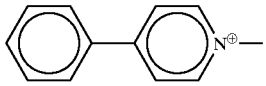 | 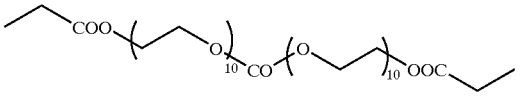 | $Cl^{\ominus}$ |
| 15 | 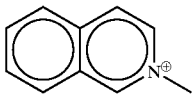 | 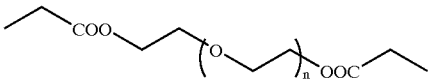 n≈43 | $Cl^{\ominus}$ |
| 16 | 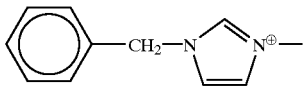 | $—C_2H_4—(OC_2H_4)_n—OC_2H_4—$ n ≈ 42 | $Cl^{\ominus}$ |
| 17 | 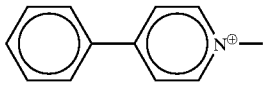 | $—C_2H_4—(OC_2H_4)_n—OC_2H_4—$ n ≈ 62 | 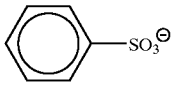 |
| 18 | 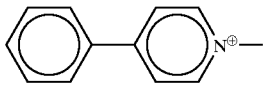 | $—C_2H_4—(OC_2H_4)_n—OC_2H_4—$ n ≈ 43 | $Br^{\ominus}$ |
| 19 | 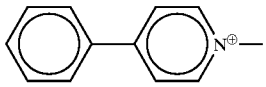 | $—C_2H_4—(OC_2H_4)_n—OC_2H_4—$ n = 20 | $(COO)_2^{2\ominus}$ |
| 20 | 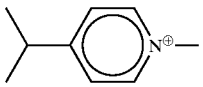 | $—C_2H_4—(OC_2H_4)_n—OC_2H_4—$ n ≈ 34 | $Cl^{\ominus}$ |
| 21 | 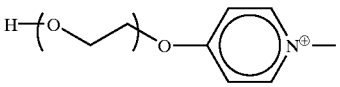 | $—(CH_2)_5—$ | $CH_3SO_3^{\ominus}$ |
| 22 | 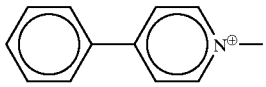 | 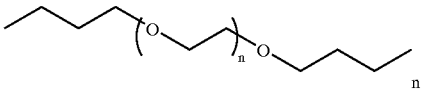 n ≈ 43 | $Cl^{\ominus}$ |
| 23 | 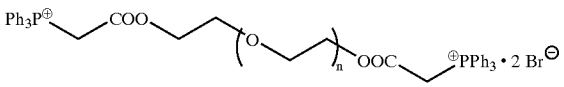 n ≈ 43 | | |
| 24 | 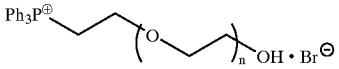 n ≈ 33 | | |
| 25 | 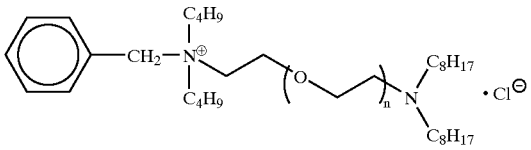 n ≈ 33 | | |

-continued
26
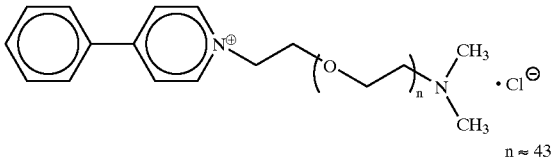
n ≈ 43
27
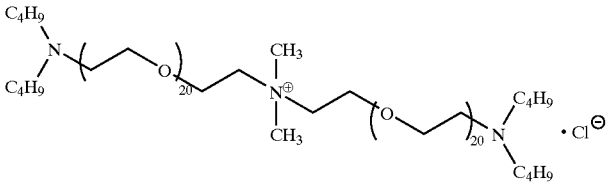
28
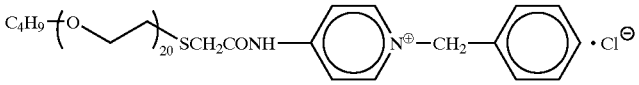
29
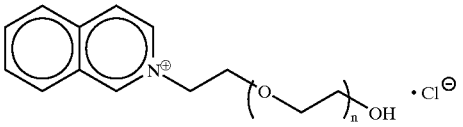
n ≈ 67
30
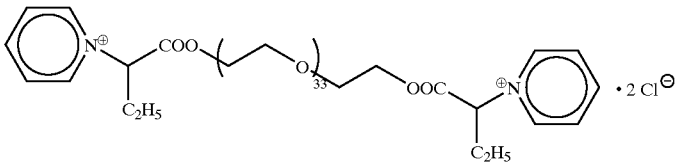
31
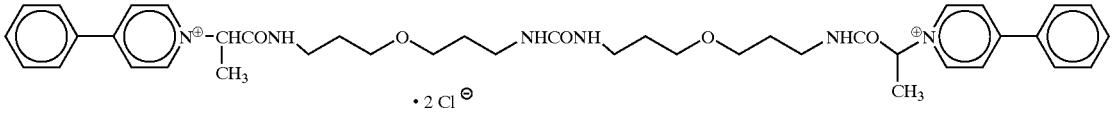
$Q^+$-$L_o$-$Q^+$.2$X^-$
| No. | $Q^+$ = | $L_o$ = | $X^-$ = |
|---|---|---|---|
| 32 | 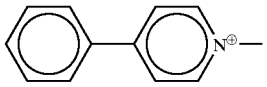 | 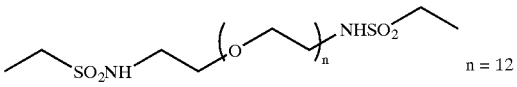 n = 12 | $Cl^{\ominus}$ |
| 33 | 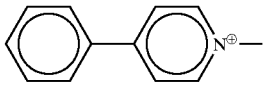 | 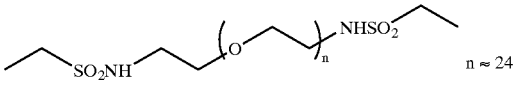 n ≈ 24 | $Br^{\ominus}$ |
| 34 | 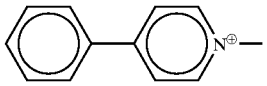 | 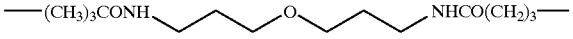 | $Cl^{\ominus}$ |
| 35 | 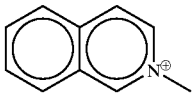 | 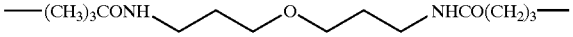 | $Cl^{\ominus}$ |
| 36 | 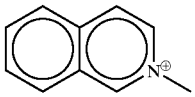 | 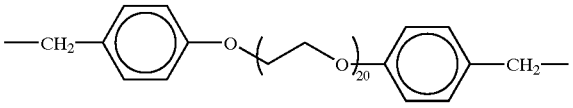 | $Cl^{\ominus}$ |

-continued

| | | | |
|---|---|---|---|
| 37 | 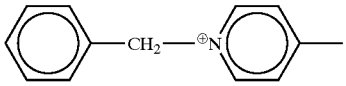 | 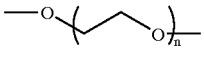 n ≈ 33 | $Cl^{\ominus}$ |
| 38 | 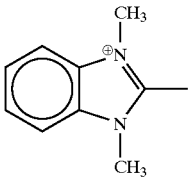 | 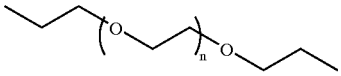 n ≈ 43 | $Cl^{\ominus}$ |
| 39 | $(C_4H_9)_3N^{\oplus}$— | 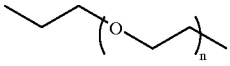 n = 20 | $Cl^{\ominus}$ |
| 40 | $(C_8H_{17})_2\overset{\oplus}{N}(CH_3)$— | 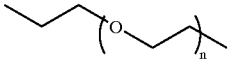 n ≈ 43 | $Cl^{\ominus}$ |
| 41 | $Ph_3P^{\oplus}$— | 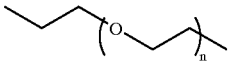 n = 20 | $Cl^{\ominus}$ |
| 42 | $Ph_3P^{\oplus}$— | 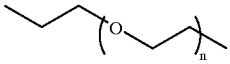 n ≈ 33 | $Br^{\ominus}$ |

$Q^+$-$CH_2CONH$-L-$NHCOCH_2$-$Q^+.2X^-$

| No. | $Q^+$ = | L = | $X^-$ = |
|---|---|---|---|
| 43 | $PhP^{\oplus}$— | —$C_2H_4$—$(OC_2H_4)_n$— n = 3 | $Cl^{\ominus}$ |
| 44 | $PhP^{\oplus}$— | —$C_2H_4$—$(OC_2H_4)_n$— n = 20 | $Br^{\ominus}$ |
| 45 | $PhP^{\oplus}$— | —$C_2H_4$—$(OC_2H_4)_n$— n ≈ 34 | $Cl^{\ominus}$ |
| 46 | $PhP^{\oplus}$— | —$C_2H_4$—$(OC_2H_4)_n$— n ≈ 67 | $Cl^{\ominus}$ |
| 47 | 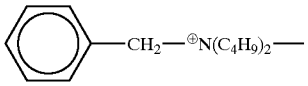 | —$C_2H_4$—$(OC_2H_4)_n$— n = 12 | $Cl^{\ominus}$ |
| 48 | 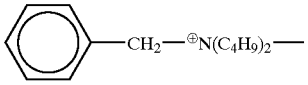 | —$C_2H_4$—$(OC_2H_4)_n$— n = 30 | $Br^{\ominus}$ |
| 49 | 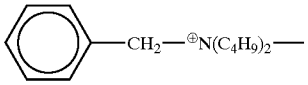 | —$C_2H_4$—$(OC_2H_4)_n$— n ≈ 43 | 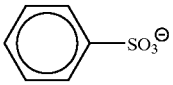 |
| 50 | 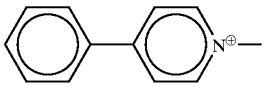 | —$C_2H_4$—$(OC_2H_4)_n$— n = 3 | $Cl^{\ominus}$ |
| 51 | 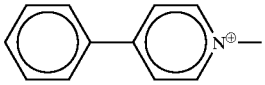 | —$C_2H_4$—$(OC_2H_4)_n$— n = 12 | $Cl^{\ominus}$ |

-continued

| | | | |
|---|---|---|---|
| 52 | 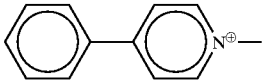 | $—C_2H_4—(OC_2H_4)_n—$<br>n = 20 | $Cl^{\ominus}$ |
| 53 | 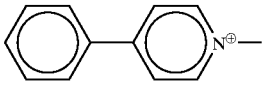 | $—C_2H_4—(OC_2H_4)_n—$<br>n ≈ 43 | $Cl^{\ominus}$ |
| 54 | 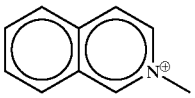 | $—C_2H_4—(OC_2H_4)_n—$<br>n = 2 | $Cl^{\ominus}$ |
| 55 | 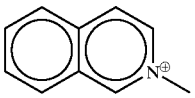 | $—C_2H_4—(OC_2H_4)_n—$<br>n = 12 | $Br^{\ominus}$ |
| 56 | 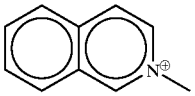 | $—C_2H_4—(OC_2H_4)_n—$<br>n = 30 | 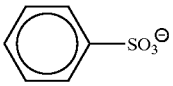 |
| 57 | 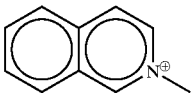 | $—C_2H_4—(OC_2H_4)_n—$<br>n ≈ 67 | $(COO)_2^{2\ominus}$ |
| 58 | 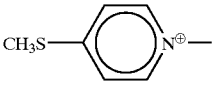 | $—C_2H_4—(OC_2H_4)_n—$<br>n = 12 | $Cl^{\ominus}$ |
| 59 | 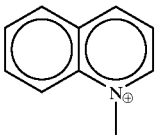 | $—C_2H_4—(OC_2H_4)_n—$<br>n = 20 | $Cl^{\ominus}$ |
| 60 | 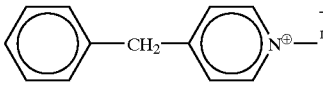 | $—C_2H_4—(OC_2H_4)_n—$<br>n = 30 | $Cl^{\ominus}$ |
| 61 | 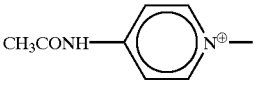 | $—C_2H_4—(OC_2H_4)_n—$<br>n ≈ 67 | $Cl^{\ominus}$ |
| 62 | 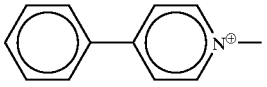 | $—C_3H_6—(OC_2H_4)_n—OC_3H_6—$<br>n = 2 | $Cl^{\ominus}$ |
| 63 | 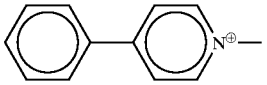 | $—C_3H_6—(OC_2H_4)_n—OC_3H_6—$<br>n = 20 | $Cl^{\ominus}$ |
| 64 | 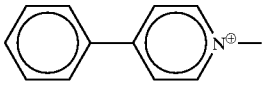 | $—C_3H_6—(OC_2H_4)_n—OC_3H_6—$<br>n ≈ 43 | $Cl^{\ominus}$ |
| 65 | $Ph_3P^{\oplus}—$ | $—C_3H_6—(OC_2H_4)_n—OC_3H_6—$<br>n = 2 | $Cl^{\ominus}$ |
| 66 | $Ph_3P^{\oplus}—$ | $—C_3H_6—(OC_2H_4)_n—OC_3H_6—$<br>n = 12 | $Cl^{\ominus}$ |

-continued

| | | | |
|---|---|---|---|
| 67 | 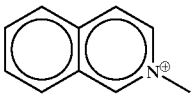 | $—C_3H_6—(OC_2H_4)_n—OC_3H_6—$ n = 20 | $Cl^{\ominus}$ |
| 68 | 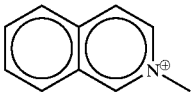 | $—C_3H_6—(OC_2H_4)_n—OC_3H_6—$ n ≈ 43 | $Cl^{\ominus}$ |
| 69 | $(C_3H_7)_3N^{\oplus}—$ | $—C_3H_6—(OC_2H_4)_n—OC_3H_6—$ n ≈ 67 | $Cl^{\ominus}$ |
| 70 | $(C_3H_7)_3N^{\oplus}—$ | $—CH(CH_3)CH_2—(OC_2H_4)_n—OCH_2CH(CH_3)—$ n = 12 | $Cl^{\ominus}$ |
| 71 | 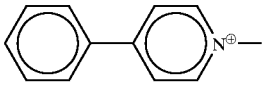 | $—CH(CH_3)CH_2—(OC_2H_4)_n—OCH_2CH(CH_3)—$ n ≈ 18 | $Cl^{\ominus}$ |
| 72 | 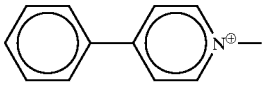 | $—CH(CH_3)CH_2—(OC_2H_4)_n—OCH_2CH(CH_3)—$ n = 20 | $Cl^{\ominus}$ |
| 73 | 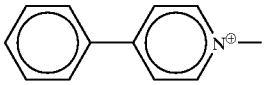 | $—C_2H_4—(O—CH(CH_3)—)_n$ n = 4 | $Cl^{\ominus}$ |
| 74 | 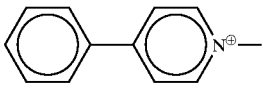 | $—C_2H_4—(O—CH(CH_3)—)_n$ n ≈ 13 | $Cl^{\ominus}$ |
| 75 | 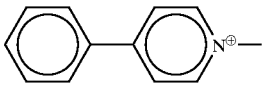 | $(O—CH_2—CH_2)_3—NHCONH—(CH_2—CH_2—O)_3$ | $Cl^{\ominus}$ |
| 76 | 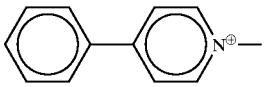 | $—NHSO_2NH—$ | $Cl^{\ominus}$ |
| 77 | 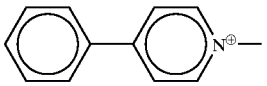 | $—NHCONH—$ | $Cl^{\ominus}$ |
| 78 | 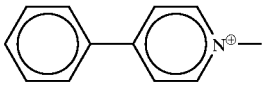 | $—NH—C(=O)—C(=O)—NH—$ | $Cl^{\ominus}$ |
| 79 | 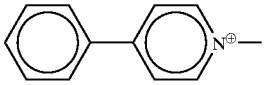 | $—CONH—CONH—NHCO—NHCO—$ | $Cl^{\ominus}$ |
| 80 | 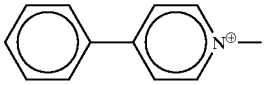 | $—NHCO—CONH—$ | $Cl^{\ominus}$ |
| 81 | 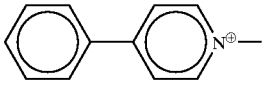 | $—SO_2NHSO_2—$ | $Cl^{\ominus}$ |

-continued

| | | | |
|---|---|---|---|
| 82 | 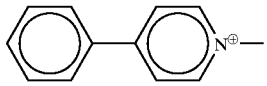 | 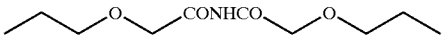 | $Cl^{\ominus}$ |
| 83 | 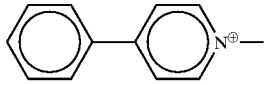 | 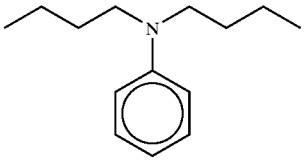 | $Cl^{\ominus}$ |
| 84 | 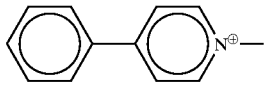 | 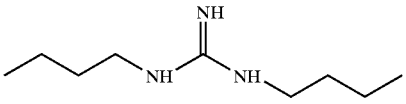 | $Cl^{\ominus}$ |
| 85 | 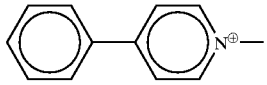 | 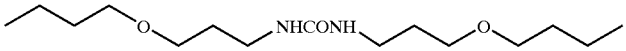 | $Cl^{\ominus}$ |
| 86 | 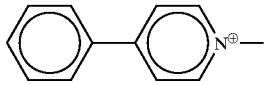 | 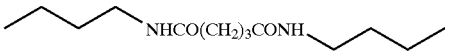 | $Cl^{\ominus}$ |

The quaternary salt compounds represented by the formulas (a) to (f) can be easily synthesized by known methods.

The nucleation accelerator that can be used in the present invention may be dissolved in an appropriate water-miscible organic solvent such as an alcohol (e.g., methanol, ethanol, propanol or a fluorinated alcohol), ketone (e.g., acetone or methyl ethyl ketone), dimethylformamide, dimethyl sulfoxide or methyl cellosolve and used.

Alternatively, the nucleation accelerator may also be dissolved in an oil such as dibutyl phthalate, tricresyl phosphate, glyceryl triacetate or diethyl phthalate using an auxiliary solvent such as ethyl acetate or cyclohexanone and mechanically processed into an emulsion dispersion by a conventionally well-known emulsion dispersion method before use. Alternatively, powder of the nucleation accelerator may be dispersed in water by means of ball mill, colloid mill or ultrasonic waves according to a method known as solid dispersion method and used.

The nucleation accelerator that can be used in the present invention is preferably added to a non-photosensitive layer consisting of a hydrophilic colloid layer not containing silver halide emulsion provided on the silver halide emulsion layer side of the support, particularly preferably to a hydrophilic colloid layer between a silver halide emulsion layer and the support.

The nucleation accelerator is preferably used in an amount of from $1\times10^{-6}$ to $2\times10^{-2}$ mol, more preferably from $1\times10^{-5}$ to $2\times10^{-2}$ mol, most preferably from $2\times10^{-5}$ to $1\times10^{-2}$ mol, per mol of silver halide. It is also possible to use two or more kinds of nucleation accelerators in combination.

There are no particular limitations on various additives used in the silver halide photographic light-sensitive material of the present invention and, for example, those described below can be used: polyhydroxybenzene compounds described in JP-A-3-39948, page 10, right lower column, line 11 to page 12, left lower column, line 5, specifically, Compounds (III)-1 to (III)-25 described in the same; compounds that substantially do not have an absorption maximum in the visible region represented by the formula (I) described in JP-A-1-118832, specifically, Compounds I-1 to I-26 described in the same; antifoggants described in JP-A-2-103536, page 17, right lower column, line 19, to page 18, right upper column, line 4; polymer latexes described in JP-A-2-103536, page 18, left lower column, line 12 to left lower column, line 20, polymer latexes having an active methylene group represented by the formula (I) described in JP-A-9-179228, specifically, Compounds I-1 to I-16 described in the same, polymer latexes having core/shell structure described in JP-A-9-179228, specifically, Compounds P-1 to P-55 described in the same, and acidic polymer latexes described in JP-A-7-104413, page 14, left column, line 1 to right column, line 30, specifically, Compounds II-1) to II-9) described on page 15 of the same; matting agents, lubricants and plasticizers described in JP-A-2-103536, page 19, left upper column, line 15 to right upper column, line 15; hardening agents described in JP-A-2-103536, page 18, right upper column, line 5 to line 17; compounds having an acid radical described in JP-A-2-103536, page 18, right lower column, line 6 to page 19, left upper column, line 1; conductive materials described in JP-A-2-18542, page 2, left lower column, line 13 to page 3, right upper column, line 7, specifically, the metal oxides described in page 2, right lower column, line 2 to line 10 of the same, and conductive polymer compounds P-1 to P-7 described in the same; water-soluble dyes described in JP-A-2-103536, page 17, right lower column, line 1 to, page 18, right upper column, line 18; solid dispersion dyes represented by the formulas (FA), (FA1), (FA2) and (FA3) described in JP-A-9-179243, specifically, Compounds F1 to F34 described in the same; Compounds (II-2) to (II-24), Compounds (III-5) to (III-18) and Compounds (IV-2) to (TV-7) described in JP-A-7-152112, and solid dispersion dyes described in JP-A-2-294638 and JP-A-5-11382; redox compounds capable of releasing a development inhibitor by oxidation described in JP-A-5-274816, preferably redox compounds represented by the formulas (R-1), (R-2) and (R-3) described in the same, specifically, Compounds R-1 to R-68 described in the same; and binders described in JP-A-2-18542, page 3, right lower column, line 1 to line 20.

The swelling ratio of the hydrophilic colloid layers including the emulsion layers and protective layers of the silver halide photographic light-sensitive materials of the present invention is preferably in the range of 80–150%, more preferably 90–140%. The swelling ratio of hydrophilic colloid layers can be determined in the following manner. The thickness ($d_0$) of the hydrophilic colloid layers including the emulsion layers and protective layers of the silver halide photographic light-sensitive material is measured, and the swollen thickness („d) is measured after the silver halide photographic material is immersed in distilled water at 25° C. for one minute. The swelling ratio is calculated from the following equation:

$$\text{Swelling ratio } (\%)=(„d/d_0)\times 100.$$

The silver halide photographic light-sensitive material of the present invention preferably has a film surface pH of 7.5 or lower, more preferably 4.5–6.0, still more preferably 4.8–6.0, for the side on which silver halide emulsion layer is coated. If it is lower than 4.5, advance of hardening of emulsion layer tends to be slower.

As supports that can be used for practicing the present invention, for example, baryta paper, polyethylene-laminated paper, polypropylene synthetic paper, glass plate, cellulose acetate, cellulose nitrate, and polyester film, e.g., polyethylene terephthalate, can be exemplified. The support is appropriately selected depending on the intended use of the silver halide photographic light-sensitive material.

Further, supports comprising a styrene polymer having syndiotactic structure described in JP-A-7-234478 and U.S. Pat. No. 5,558,979 are also preferably used.

Processing chemicals such as developing solution (developer) and fixing solution (fixer) and processing methods that can be used for the present invention are described below. However, of course the present invention should not be construed as being limited to the following description and specific examples.

For the development of the silver halide photographic light-sensitive material of the present invention, any of known methods can be used, and known developers can be used.

A developing agent for use in developer (hereinafter, starter developer and replenisher developer are collectively referred to as developer) used for the present invention is not particularly limited, but it is preferable to add a dihydroxybenzene compound, ascorbic acid derivative or hydroquinonemonosulfonate, and they can be used each alone or in combination. In particular, a dihydroxybenzene type developing agent and an auxiliary developing agent exhibiting superadditivity are preferably contained in combination, and combinations of a dihydroxybenzene compound or an ascorbic acid derivative with a 1-phenyl-3-pyrazolidone compound, or combinations of a dihydroxybenzene compound or ascorbic acid compound with a p-aminophenol compound can be mentioned.

Examples of the dihydroxybenzene developing agent as a developing agent used for the present invention includes hydroquinone, chlorohydroquinone, isopropylhydroquinone, methylhydroquinone and so forth, and hydroquinone is particularly preferred. Examples of the ascorbic acid derivative developing agent include ascorbic acid, isoascorbic acid and salts thereof. Sodium erythorbate is particularly preferred in view of material cost.

Examples of the 1-phenyl-3-pyrazolidones or derivatives thereof as the developing agent used for the present invention include 1-phenyl-3-pyrazolidone, 1-phenyl-4,4-dimethyl-3-pyrazolidone, 1-phenyl-4-methyl-4-hydroxymethyl-3-pyrazolidone and so forth.

Examples of the p-aminophenol type developing agent that can be used for the present invention include N-methyl-p-aminophenol, p-aminophenol, N-($_n$-hydroxyphenyl)-p-aminophenol, N-(4-hydroxyphenyl) glycine, o-methoxy-p-(N,N-dimethylamino)phenol, o-methoxy-p-(N-methylamino) phenol etc. and N-methyl-p-aminophenol and aminophenols described in JP-A-9-297377 and JP-A-9-297378 are especially preferred.

The dihydroxybenzene type developing agent is preferably used in an amount of generally 0.05–0.8 mol/L. When a dihydroxybenzene compound and a 1-phenyl-3-pyrazolidone compound or a p-aminophenol compound are used in combination, the former is preferably used in an amount of 0.05–0.6 mol/L, more preferably 0.10–0.5 mol/L, and the latter is preferably used in an amount of 0.06 mol/L or less, more preferably 0.003–0.03 mol/L.

The ascorbic acid derivative developing agent is preferably used in an amount of generally 0.01–0.5 mol/L, more preferably 0.05–0.3 mol/L. When an ascorbic acid derivative and a 1-phenyl-3-pyrazolidone compound or a p-aminophenol compound are used in combination, the ascorbic acid derivative is preferably used in an amount of from 0.01–0.5 mol/L, and the 1-phenyl-3-pyrazolidone compound or p-aminophenol compound is preferably used in an amount of 0.005–0.2 mol/L.

The developer used in processing the silver halide photographic light-sensitive material of the present invention may contain additives (e.g., a developing agent, alkali agent, pH buffer, preservative, chelating agent etc.) that are commonly used. Specific examples thereof are described below, but the present invention is by no means limited to them.

Examples of the buffer for use in the developer used in development include carbonates, boric acids described in JP-A-62-186259, saccharides (e.g., saccharose) described in JP-A-60-93433, oximes (e.g., acetoxime), phenols (e.g., 5-sulfosalicylic acid), tertiaryphosphates (e.g., sodium salt and potassium salt) etc., and carbonates are preferably used. The buffer, in particular carbonate, is preferably used in an amount of 0.05 mol/L or more, particularly preferably 0.08–1.0 mol/L.

In the present invention, both the starter developer and the replenisher developer preferably have a property that the solution shows pH increase of 0.8 or less when 0.1 mol of sodium hydroxide is added to 1 L of the solution. As for the method of confirming whether the starter developer or replenisher developer used has the property, pH of the starter developer or replenisher developer to be tested is adjusted to 10.5, 0.1 mol of sodium hydroxide is added to 1 L of the solution, then pH of the solution is measured, and if increase of pH value is in the range of 0.8 or less, the solution is determined to have the property defined above. In the present invention, it is particularly preferable to use a starter developer and replenisher developer showing pH increase of 0.7 or less in the aforementioned test.

Examples of the preservative that can be used for the present invention include sodium sulfite, potassium sulfite, lithium sulfite, ammonium sulfite, sodium bisulfite, sodium methabisulfite, formaldehyde-sodium bisulfite and so forth. A sulfite is used in an amount of preferably 0.2 mol/L or more, particularly preferably 0.3 mol/L or more, but if it is added too excessively, silver staining in the developer is caused. Accordingly, the upper limit is desirably 1.2 mol/L. The amount is particularly preferably 0.35–0.7 mol/L.

As the preservative for a dihydroxybenzene type developing agent, a small amount of the aforementioned ascorbic acid derivative may be used together with the sulfite. Sodium erythorbate is particularly preferably used in view of material cost. It is preferably added in an amount of 0.03–0.12, particularly preferably 0.05–0.10, in terms of molar ratio with respect to the dihydroxybenzene type developing agent. When an ascorbic acid derivative is used as the preservative, the developer preferably does not contain a boron compound.

Examples of additives to be used other than those described above include a development inhibitor such as sodium bromide and potassium bromide, an organic solvent such as ethylene glycol, diethylene glycol, triethylene glycol and dimethylformamide, a development accelerator such as an alkanolamine including diethanolamine, triethanolamine etc., and an imidazole and derivatives thereof and an agent for preventing uneven physical development such as a heterocyclic mercapto compound (e.g., sodium 3-(5-mercaptotetrazol-1-yl)-benzenesulfonate, 1-phenyl-5-mercaptotetrazole etc.) and the compounds described in JP-A-62-212651.

Further, a mercapto compound, indazole compound, benzotriazole compound or benzimidazole compound may be added as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, 2-mercaptobenzotriazole and so forth. The amount of these additives is generally 0.01–10 mmol, preferably 0.1–2 mmol, per liter of the developer.

Further, various kinds of organic or inorganic chelating agents can be used individually or in combination in the developer used for the present invention.

As the inorganic chelating agents, sodium tetrapolyphosphate, sodium hexametaphosphate and so forth can be used.

As the organic chelating agents, organic carboxylic acid, aminopolycarboxylic acid, organic phosphonic acid, aminophosphonic acid and organic phosphonocarboxylic acid can be mainly used.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, tartaric acid etc.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycol ether-tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether-diaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acids described in U.S. Pat. Nos. 3,214,454 and 3,794,591 and West German Patent Publication No. 2,227,369, and the compounds described in Research Disclosure, Vol. 181, Item 18170 (May, 1979) and so forth.

Examples of the aminophosphonic acid include aminotris(methylenephosphonic acid), ethylenediaminetetramethylenephosphonic acid, aminotrimethylenephosphonic acid and so forth, and the compounds described in Research Disclosure, No. 18170 (supra), JP-A-57-208554, JP-A-54-61125, JP-A-55-29883, JP-A-56-97347 and so forth can also be mentioned.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, Research Disclosure, No. 18170 (supra) and so forth.

The organic and/or inorganic chelating agents are not limited to those described above. The organic and/or inorganic chelating agents may be used in the form of an alkali metal salt or an ammonium salt. The amount of the chelating agent added is preferably from $1\times10^{-4}$ to $1\times10^{-1}$ mol, more preferably from $1\times10^{-3}$ to $1\times10^{-2}$ mol, per liter of the developer.

Further, a silver stain inhibitor may be added to the developer, and examples thereof include, for example, the compounds described in JP-A-56-24347, JP-B-56-46585, JP-B-62-2849, JP-A-4-362942 and JP-A-8-6215; triazines having one or more mercapto groups (for example, the compounds described in JP-B-6-23830, JP-A-3-282457, and JP-A-7-175178); pyrimidines having one or more mercapto groups (e.g., 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, the compounds described in JP-A-9-274289 etc.); pyridines having one or more mercapto groups (e.g., 2-mercaptopyridine, 2,6-dimercaptopyridine, 3,5-dimercaptopyridine, 2,4,6-trimercaptopyridine, compounds described in JP-A-7-248587 etc.); pyrazines having one or more mercapto groups (e.g., 2-mercaptopyrazine, 2,6-dimercaptopyrazine, 2,3-dimercaptopyrazine, 2,3,5-trimercaptopyrazine etc.); pyridazines having one or more mercapto groups (e.g., 3-mercaptopyridazine, 3,4-dimercaptopyridazine, 3,5-dimercaptopyridazine, 3,4,6-trimercaptopyridazine etc.); the compounds described in JP-A-7-175177, polyoxyalkylphosphate esters described in U.S. Pat. No. 5,457,011 and so forth. These silver stain inhibitors may be used individually or in combination of two or more of these. The addition amount thereof is preferably 0.05–10 mmol, more preferably 0.1–5 mmol, per liter of the developer.

The developer may also contain the compounds described in JP-A-61-267759 as a dissolution aid.

Further, the developer may also contain a toning agent, surfactant, defoaming agent, hardening agent or the like, if necessary.

The developer preferably has a pH of 9.0–12.0, more preferably 9.0–11.0, particularly preferably 9.5–11.0. The alkali agent used for adjusting pH may be a usual water-soluble inorganic alkali metal salt (e.g., sodium hydroxide, potassium hydroxide, sodium carbonate, potassium carbonate etc.).

With respect to the cation of the developer, potassium ion less inhibits development and causes less indentations, called fringes, on peripheries of blackened portions, compared with sodium ion. When the developer is stored as a concentrated solution, potassium salt is generally preferred, because of its higher solubility. However, since, in the fixer, potassium ion causes fixing inhibition on the same level as silver ion, a high potassium ion concentration in the developer disadvantageously causes increase of the potassium ion concentration in the fixer because of carrying over of the developer by the silver halide photographic light-sensitive material. In view of the above, the molar ratio of potassium ion to sodium ion in the developer is preferably between 20:80 and 80:20. The ratio of potassium ion to sodium ion can be freely controlled within the above-described range by a counter cation such as those derived from a pH buffer, pH adjusting agent, preservative, chelating agent or the like.

The replenishing amount of the developer is generally 470 mL or less, preferably 30–325 mL, per $m^2$ of the silver halide photographic light-sensitive material. The replenisher developer may have the same composition and/or concentration as the starter developer, or it may have a different composition and/or concentration from the starter developer.

Examples of the fixing agent in the fixing processing agent that can be used for the present invention include ammonium thiosulfate, sodium thiosulfate and ammonium sodium thiosulfate. The amount of the fixing agent may be varied appropriately, but it is generally about 0.7–3.0 mol/L.

The fixer that can be used for the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, aluminum lactate and so forth. These are preferably contained in an amount of 0.01–0.15 mol/L in terms of an aluminum ion concentration in the solution used.

When the fixer is stored as a concentrated solution or a solid agent, it may be constituted by a plurality of parts including a hardening agent or the like as a separate part, or it may be constituted as a one-part agent containing all components.

The fixing processing agent may contain, if desired, a preservative (e.g., sulfite, bisulfite, metabisulfite etc. in an amount of 0.015 mol/L or more, preferably 0.02–0.3 mol/L) pH buffer (e.g., acetic acid, sodium acetate, sodium carbonate, sodium hydrogen carbonate, phosphoric acid, succinic acid, adipic acid etc. in an amount of generally 0.1–1 mol/L, preferably 0.2–0.7 mol/L), and a compound having aluminum-stabilizing ability or hard water-softening ability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives and salts thereof, saccharides etc. in an amount of 0.001–0.5 mol/L, preferably 0.005–0.3 mol/L). However, in view of environmental protection recently concerned, it is preferred that a boron compound is not contained.

In addition, the fixing processing agent may contain the compound described in JP-A-62-78551, a pH adjusting agent (e.g. sodium hydroxide, ammonia, sulfuric acid etc.), a surfactant, a wetting agent, a fixing accelerator etc. Examples of the surfactant include anionic surfactants such as sulfated products and sulfonated products, polyethylene surfactants and amphoteric surfactants described in JP-A-57-6840. Known deforming agents may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535 and JP-B-58-122536; alcohols having a triple bond within the molecule; thioether compounds described in U.S. Pat. No. 4,126,459; mercapto compounds described in JP-A-64-4739, JP-A-1-4739, JP-A-1-159645 and JP-A-3-101728; mesoionic compounds and thiocyanate salts described in JP-A-4-170539. pH of the fixer used for the present invention is preferably 4.0 or more, more preferably 4.5–6.0. pH of the fixer may rise with processing by the contamination of a developer. In such a case, pH of a hardening fixer is preferably 6.0 or less, more preferably 5.7 or less, and that of a non-hardening fixer is preferably 7.0 or less, more preferably 6.7 or less.

The replenishing rate of the fixer is preferably 500 mL or less, more preferably 390 mL or less, still more preferably 80–325 mL, per $m^2$ of processed silver halide photographic light-sensitive material. The composition and/or the concentration of the replenisher fixer may be the same as or different from those of the starter fixer.

The fixer can be reclaimed for reuse according to known fixer reclaiming methods such as electrolytic silver recovery. As reclaiming apparatuses, there are FS-2000 produced by Fuji Photo Film Co., Ltd. and so forth.

Further, removal of dyes and so forth using an adsorptive filter such as those comprising activated carbon is also preferred.

When the developing and fixing processing chemicals used in the present invention are solutions, they are preferably preserved in packaging materials of low oxygen permeation as disclosed in JP-A-61-73147. Further, when these solutions are concentrated solutions, they are diluted with water to a predetermined concentration in the ratio of 0.2–3 parts of water to one part of the concentrated solutions.

Even if the developing processing chemicals and fixing processing chemicals used in the present invention are made as solids, the same effects as solutions can be obtained. Solid processing chemicals are described below.

Solid chemicals that can be used for the present invention may be made into known shapes such as powders, granular powders, granules, lumps, tablets, compactors, briquettes, plates, bars, paste or the like. These solid chemicals may be covered with water-soluble coating agents or films to separate components that react with each other on contact, or they may have a multilayer structure to separate components that react with each other, or both types may be used in combination.

Although known coating agents and auxiliary granulating agents can be used, polyvinylpyrrolidone, polyethylene glycol, polystyrenesulfonic acid and vinyl compounds are preferably used. Further, JP-A-5-45805, column 2, line 48 to column 3, line 13 can be referred to.

When a multilayer structure is used, components that do not react with each other on contact may be sandwiched with components that react with each other and made into tablets and briquettes, or components of known shapes may be made into a similar layer structure and packaged. Methods therefor are disclosed in JP-A-61-259921, JP-A-4-16841, JP-A-4-78848, JP-A-5-93991 and so forth.

The bulk density of the solid processing chemicals is preferably 0.5–6.0 g/$cm^3$, in particular, the bulk density of tablets is preferably 1.0–5.0 g/$cm^3$, and that of granules is preferably 0.5–1.5 g/$cm^3$.

Solid processing chemicals used for the present invention can be produced by using any known method, and one can refer to, for example, JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and so forth.

More specifically, the rolling granulating method, extrusion granulating method, compression granulating method, cracking granulating method, stirring granulating method, spray drying method, dissolution coagulation method, briquetting method, roller compacting method and so forth can be used.

The solubility of the solid chemicals used in the present invention can be adjusted by changing state of surface (smooth, porous etc.) or partially changing the thickness, or making the shape into a hollow doughnut type. Further, it is also possible to provide different solubilities to a plurality of granulated products, or it is also possible for materials having different solubilities to use various shapes to obtain the same solubilities. Multilayer granulated products having different compositions between the inside and the surface can also be used.

Packaging materials of solid chemicals preferably have low oxygen and water permeabilities, and those of known shapes such as bag-like, cylindrical and box-like shapes can be used. Packaging materials of foldable shapes are preferred for saving storage space of waste packaging materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of processing chemicals of these packaging materials may be provided with a screw cap, pull-top or aluminum seal, or packaging materials may be heat-sealed, or other known types may be used, and there are no particular limitations. Waste packaging materials are preferably recycled or reused in view of environmental protection.

Methods of dissolution and replenishment of the solid processing chemicals are not particularly limited, and known methods can be used. Examples of these known methods include a method in which a certain amount of processing chemicals are dissolved and replenished by a dissolving apparatus having a stirring function, a method in which processing chemicals are dissolved by a dissolving apparatus having a dissolving zone and a zone where a finished solution is stocked and the solution is replenished from the stock zone as disclosed in JP-A-9-80718, and methods in which processing chemicals are fed to a circulating system of an automatic processor and dissolved and replenished, or processing chemicals are fed to a dissolving tank provided in an automatic processor with progress of the processing of silver halide photographic light-sensitive materials as disclosed in JP-A-5-119454, JP-A-6-19102 and JP-A-7-261357. In addition to the above methods, any of known methods can be used. The charge of processing chemicals may be conducted manually, or automatic opening and automatic charge may be conducted by using a dissolving apparatus or an automatic processor provided with an opening mechanism as disclosed in JP-A-9-138495. The latter is preferred in view of the working environment. Specifically, there are methods of pushing through, unsealing, cutting off and bursting a takeout port of package, methods disclosed in JP-A-6-19102 and JP-A-6-95331 and so forth.

A silver halide photographic light-sensitive material is subjected to washing or stabilizing processing after being developed and fixed (hereinafter washing includes stabilization processing, and a solution used therefor is called water or washing water unless otherwise indicated). The water used for washing with water may be any of tap water, ion exchange water, distilled water and stabilized solution. The replenishing rate therefor is, in general, about 8–17 liters per $m^2$ of the silver halide photographic light-sensitive material, but washing can be carried out with a replenishing rate less than the above. In particular, with a replenishing rate of 3 liters or less (including zero, i.e., washing in a reservoir), not only water saving processing becomes possible but also piping for installation of an automatic processor becomes unnecessary. When washing is carried out with a reduced replenishing amount of water, it is more preferable to use a washing tank equipped with a squeegee roller or a crossover roller disclosed in JP-A-63-18350, JP-A-62-287252 or the like. The addition of various kinds of oxidizing agents (e.g., ozone, hydrogen peroxide, sodium hypochlorite, activated halogen, chlorine dioxide, sodium carbonate hydrogen peroxide salt etc.) and filtration through filters may be combined to reduce load on environmental pollution which becomes a problem when washing is carried out with a small amount of water and to prevent generation of scale.

As a method of reducing the replenishing amount of the washing water, a multistage countercurrent system (e.g., two stages or three stages) has been known for a long time. The replenishing amount of the washing water in this system is preferably 50–200 mL per $m^2$ of the silver halide photographic light-sensitive material. This effect can also similarly be obtained in an independent multistage system (a method in which a countercurrent is not used and fresh solution is separately replenished to multistage washing tanks).

Further, means for preventing generation of scale may be included in a washing process. Means for preventing generation of scale is not particularly limited, and known methods can be used. There are, for example, a method of adding an antifungal agent (so-called scale preventive), a method of using electroconduction, a method of irradiating ultraviolet ray, infrared ray or far infrared ray, a method of applying a magnetic field, a method of using ultrasonic wave processing, a method of applying heat, a method of emptying tanks when they are not used and so forth. These scale preventing means may be used with progress of the processing of silver halide photographic light-sensitive materials, may be used at regular intervals irrespective of usage conditions, or may be conducted only during the time when processing is not conducted, for example, during night. In addition, washing water previously subjected to a treatment with such means may be replenished. It is also preferable to use different scale preventing means for every given period of time for inhibiting proliferation of resistant fungi.

As a water-saving and scale-preventing apparatus, an apparatus AC-1000 produced by Fuji Photo Film Co., Ltd. and a scale-preventing agent AB-5 produced by Fuji Photo Film Co., Ltd. may be used, and the method disclosed in JP-A-11-231485 may also be used.

The antifungal agent is not particularly restricted, and a known antifungal agent may be used. Examples thereof include, in addition to the above-described oxidizing agents, glutaraldehyde, chelating agent such as aminopolycarboxylic acid, cationic surfactant, mercaptopyridine oxide (e.g., 2-mercaptopyridine-N-oxide) and so forth, and a sole antifungal agent may be used, or a plurality of antifungal agents may be used in combination.

The electricity may be applied according to the methods described in JP-A-3-224685, JP-A-3-224687, JP-A-4-16280, JP-A-4-18980 and so forth.

In addition, a known water-soluble surfactant or defoaming agent may be added so as to prevent uneven processing due to bubbling, or to prevent transfer of stains. Further, the dye adsorbent described in JP-A-63-163456 may be provided in the washing with water system, so as to prevent stains due to a dye dissolved out from the silver halide photographic light-sensitive material.

Overflow solution from the washing with water step may be partly or wholly used by mixing it with the processing solution having fixing ability, as described in JP-A-60-235133. It is also preferable, in view of protection of the natural environment, to reduce the biochemical oxygen demand (BOD), chemical oxygen demand (COD), iodine consumption or the like before discharge by subjecting the solution to microbial treatment (for example, sulfur-oxidizing bacteria treatment, activated sludge treatment, treatment with a filter comprising a porous carrier such as activated carbon or ceramic carrying microorganisms etc.) or oxidation treatment with electrification or an oxidizing agent, or to reduce the silver concentration in waste water by passing the solution through a filter using a polymer having affinity for silver, or by adding a compound that forms a hardly soluble silver complex, such as trimercaptotriazine, to precipitate silver, and then passing the solution through a filter.

In some cases, stabilization may be performed subsequent to the washing with water, and as an example thereof, a bath containing the compounds described in JP-A-2-201357, JP-A-2-132435, JP-A-1-102553 and JP-A-46-44446 may be used as a final bath of the silver halide photographic light-sensitive material. This stabilization bath may also contain, if desired, an ammonium compound, metal compound such as Bi or Al, fluorescent brightening agent, various chelating agents, layer pH-adjusting agent, hardening agent, bactericide, antifungal agent, alkanolamine or surfactant.

The additives such as antifungal agent and the stabilizing agent added to the washing with water or stabilization bath may be formed into a solid agent like the aforementioned development and fixing processing agents.

Waste solutions of the developer, fixer, washing water or stabilizing solution used for the present invention are preferably burned for disposal. The waste solutions can also be concentrated or solidified by a concentrating apparatus such as those described in JP-B-7-83867 and U.S. Pat. No. 5,439,560, and then disposed.

When the replenishing amounts of the processing agents are reduced, it is preferable to prevent evaporation or air oxidation of the solution by reducing the opening area of the processing tank. A roller transportation-type automatic developing machine is described in, for example, U.S. Pat. Nos. 3,025,779 and 3,545,971, and in the present specification, it is simply referred to as a roller transportation-type automatic processor. This automatic processor performs four steps of development, fixing, washing with water and drying, and it is most preferable to follow this four-step processing also in the present invention, although other steps (e.g., stopping step) are not excluded. Further, a rinsing bath, tank for washing with water or washing tank may be provided between development and fixing and/or between fixing and washing with water.

In the development of the silver halide photographic light-sensitive material of the present invention, the dry-to-dry time from the start of processing to finish of drying is preferably 25–160 seconds, the development time and the fixing time are each generally 40 seconds or less, preferably 6–35 seconds, and the temperature of each solution is preferably 25–50° C., more preferably 30–40° C. The temperature and the time of washing with water are preferably 0–50° C. and 40 seconds or less, respectively. According to such a method, the silver halide photographic light-sensitive material after development, fixing and washing with water may be passed through squeeze rollers, for squeezing washing water, and then dried. The drying is generally performed at a temperature of from about 40° C. to about 100° C. The drying time may be appropriately varied depending on the ambient conditions. The drying method is not particularly limited, and any known method may be used. Hot-air drying and drying by a heat roller or far infrared rays as described in JP-A-4-15534, JP-A-5-2256 and JP-A-5-289294 may be used, and a plurality of drying methods may also be used in combination.

The present invention will be specifically explained with reference to the following examples and comparative examples. The materials, amounts, ratios, types and procedures of processes and so forth shown in the following examples can be optionally changed so long as such change does not depart from the spirit of the present invention. Therefore, the scope of the present invention should not be construed in a limitative way based on the following examples.

PREPARATION EXAMPLE 1

Synthesis of Exemplary Compound II-2

In an amount of 2.56 g of 4-oxo-5-[3-[3-(3-sulfopropyl)-2(3H)-benzothiazolidene]-2-propenylethylidene]-2-thioxothia zolidin-3-ylacetic acid was mixed with 2.5 g of dimethyl sulfate and heated at 130° C. for 120 minutes with stirring. After returned to room temperature, the viscous reaction mixture was added with isopropyl ether, stirred and left standing, and the supernatant was removed by decantation. The residue was added with 1 g of 4-oxo-2-thioxothiazolidin-3-ylacetic acid, successively added with 10 ml of pyridine, mildly refluxed by heating for 20 minutes and then crystallized by cooling. The precipitates were taken by filtration and washed with an ethanol solvent. The obtained crude crystals were recrystallized from a methanol solvent to obtain 1.0 g of a dye that is Exemplary Compound II-2. The absorption maximum wavelength of the dye in a methanol solution was 644 nm.

PREPARATION EXAMPLE 2

Synthesis of Exemplary Compound II-4

In an amount of 2.48 g of 4-oxo-5-[2-[2-[3-(2-sulfoethyl)-2(3H)-benzoxazolidene]ethylidene]butylidene]-2-thiox othiazolidin-3-ylacetic acid was mixed with 2.5 g of dimethyl sulfate and heated at 130° C. for 60 minutes with stirring. After returned to room temperature, the viscous reaction mixture was added with isopropyl ether, stirred and left standing, and the supernatant was removed by decantation. The residue was added with 1 g of 4-oxo-2-thioxothiazolidin-3-ylacetic acid, successively added with 10 ml of pyridine and 1 ml of triethylamine, mildly refluxed by heating for 20 minutes and then crystallized by cooling. The precipitates were taken by filtration and washed with an ethanol solvent. The obtained crude crystals were recrystallized from a methanol solvent to obtain 0.8 g of a dye that is Exemplary Compound II-4. The absorption maximum wavelength of the dye in a methanol solution was 611 nm.

EXAMPLE 1

In this example, silver halide photographic light-sensitive materials satisfying the requirements of the present invention (Samples 3, 4, 6, 9, 10, 12 and 14 to 22) and comparative silver halide photographic light-sensitive materials (Samples 1, 2, 5, 7, 8, 11 and 13) were prepared and evaluated. Production methods of emulsions and non-photosensitive silver halide grains used for the production of those silver halide photographic light-sensitive materials will be explained first, and then the method for producing the silver halide photographic light-sensitive materials and evaluations of them will be explained.

<<Preparation of Emulsion A>>

| Solution 1 | |
|---|---|
| Water | 750 mL |
| Gelatin | 20 g |
| Sodium chloride | 3 g |
| 1,3-Dimethylimidazolidine-2-thione | 20 mg |
| Sodium benzenethiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 38 g |
| Potassium bromide | 32 g |
| $K_3IrCl_6$ (0.005% in 20% KCl aqueous solution) | Amount shown in Table 1 |
| $(NH_4)_3[RhCl_5(H_2O)]$ (0.001% in 20% NaCl aqueous solution) | Amount shown in Table 1 |

$K_3TrCl_6$ (0.005%) and $(NH_4)$ 3 $[RhCl_5(H_2O)]$ (0.001%) used for Solution 3 were prepared by dissolving powder of each in 20% aqueous solution of KCl or 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.21 μm. Subsequently, Solution 4 and Solution 5 shown below were added over 8 minutes. Further, the remaining 10% of Solution 2 and Solution 3 were added over 2 minutes to allow growth of the grains to a diameter of 0.23 μm. Further, 0.15 g of potassium iodide was added and ripening was allowed for 5 minutes to complete the grain formation.

| Solution 4 | |
|---|---|
| Water | 100 mL |
| Silver nitrate | 50 g |
| Solution 5 | |
| Water | 100 mL |
| Sodium chloride | 13 g |
| Potassium bromide | 11 g |
| $K_4[Fe(CN)_6].3H_2O$ (potassium ferrocyanide) | Amount shown in Table 1 |

Then, the resulting grains were washed according to a conventional flocculation method. Specifically, after the temperature of the mixture was lowered to 35° C., 3 g of Anionic precipitating agent 1 shown below was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In a volume of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg was adjusted to 7.5, added with 10 mg of sodium benzenethiosulfonate, 3 mg of sodium benzenethiosulfinate, 15 mg of sodium thiosulfate pentahydrate and 4.0 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI).

Finally, there was obtained an emulsion of cubic silver iodochlorobromide grains containing 30 mol % of silver bromide and 0.08 mol % of silver iodide and having an average grain size of 0.24 μm and a variation coefficient of 9%. The emulsion finally showed pH of 5.7, pAg of 7.5, electric conductivity of 40 μS/m, density of 1.2–1.25×$10^3$ kg/$m^3$ and viscosity of 50 mPa·s. The molar amount of silver in the inside containing the metal complex was 92.5% of the total silver amount.

Anionic precipitating agent 1

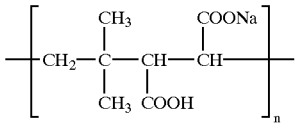

Average molecular weight: 120,000

<<Preparation of Emulsion B>>

| Solution 1 | |
|---|---|
| Water | 750 mL |
| Gelatin | 20 g |
| Sodium chloride | 1 g |
| 1,3-Dimethylimidazolidine-2-thione | 20 mg |
| Sodium benzenthiosulfonate | 10 mg |
| Citric acid | 0.7 g |
| Solution 2 | |
| Water | 300 mL |
| Silver nitrate | 150 g |
| Solution 3 | |
| Water | 300 mL |
| Sodium chloride | 38 g |
| Potassium bromide | 32 g |
| $K_3IrCl_6$ (0.005% in 20% KCl aqueous solution) | Amount shown in Table 1 |
| $(NH_4)_3[RhCl_5(H_2O)]$ (0.001% in 20% NaCl aqueous solution) | Amount shown in Table 1 |

$K_3IrCl_6$ (0.005%) and $(NH_4)_3[RhCl_5(H_2O)]$ (0.001%) used for Solution 3 were prepared by dissolving powder of each in 20% aqueous solution of KCl or 20% aqueous solution of NaCl and heating the solution at 40° C. for 120 minutes.

Solution 2 and Solution 3 in amounts corresponding to 90% of each were simultaneously added to Solution 1 maintained at 38° C. and pH 4.5 over 20 minutes with stirring to form nucleus grains having a diameter of 0.17 μm. Subsequently, 500 mg of 4-hydroxy-6-methyl-1,3,3a,7-tetrazaindene was added, and Solution 4 and Solution 5 shown below were further added over 8 minutes. Further, the remaining 10% of Solution 2 and Solution 3 were added over 2 minutes to allow growth of the grains to a diameter of 0.185 μm. Further, 0.15 g of potassium iodide was added and ripening was allowed for 5 minutes to complete the grain formation.

| Solution 4 | |
|---|---|
| Water | 100 mL |
| Silver nitrate | 50 g |
| Solution 5 | |
| Water | 100 mL |
| Sodium chloride | 13 g |
| Potassium bromide | 11 g |
| $K_4[Fe(CN)_6].3H_2O$ (potassium ferrocyanide) | Amount shown in Table 1 |

Then, the resulting grains were washed according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In an amount of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.6 and pAg was adjusted to 7.5, added with 10 mg of sodium benzenethiosulfonate, 3 mg of sodium benzenethiosulfinate, 2 mg of triphenylphosphine selenide and 4.0 mg of chloroauric acid to perform chemical sensitization at 55° C. for obtaining optimal sensitivity, and then added with 100 mg of 4-hydroxy-6-methyl-1,3,3a,7-tetrazaindene as a stabilizer and 100 mg of an antiseptic (Proxcel, ICI).

Finally, there was obtained an emulsion of cubic silver iodochlorobromide grains containing 30 mol % of silver bromide and 0.08 mol % of silver iodide and having an average grain size of 0.19 $\mu$m and a variation coefficient of 10%. The emulsion finally showed pH of 5.7, pAg of 7.5, electric conductivity of 40 $\mu$S/m, density of $1.2\times10^3$ kg/m$^3$ and viscosity of 50 mPa·s. The molar amount of silver in the inside containing the metal complex was 92.5% of the total silver amount.

<<Preparation of Emulsions C to G>>

These emulsions were prepared in the same manner as the preparation of Emulsion A except that the halogen compositions, grain sizes, kinds of doped heavy metals and addition amounts were changed as shown in Table 1. The halogen compositions were controlled by changing addition amounts of sodium chloride and potassium bromide in Solutions 3 and 5, and the grain sizes were controlled by changing addition amounts of sodium chloride and preparation temperatures for Solution 1.

<<Preparation of Emulsion H>>

This emulsion was prepared in the same manner as the preparation of Emulsion B except that the halogen composition, grain size, kind of doped heavy metal, addition amount thereof, kind of gold sulfide according to the present invention and addition amount thereof were changed as shown in Table 1. The halogen composition was controlled by changing addition amounts of sodium chloride and potassium bromide in Solutions 3 and 5, and the grain size was controlled by changing addition amount of sodium chloride and preparation temperature for Solution 1.

<<Preparation of Non-Photosensitive Silver Halide Grains (i)>>

| Solution 1 | |
|---|---|
| Water | 1 L |
| Gelatin | 20 g |
| Sodium chloride | 3.0 g |
| 1,3-Dimethylimidazolidine-2-thione | 20 mg |
| Sodium benzenethiosulfonate | 8 mg |
| Solution 2 | |
| Water | 400 mL |
| Silver nitrate | 100 g |
| Solution 3 | |
| Water | 400 mL |
| Sodium chloride | 13.5 g |
| Potassium bromide | 45.0 g |
| $(NH_4)_3[RhCl_5(H_2O)]$ (0.001% in 20% NaCl aqueous solution) | $4\times10^{-5}$ mol/Ag mol |

Solutions 1, 2 and 3 maintained at 70° C. and pH 4.5 were simultaneously added over 15 minutes with stirring to form nucleus grains. Subsequently, Solution 4 and Solution 5 shown below were added over 15 minutes, and 0.15 g of potassium iodide was added to complete the grain formation.

Then, the resulting grains were washed with water according to a conventional flocculation method. Specifically, after the temperature of the mixture was lowered to 35° C., 3 g of Anionic precipitating agent 1 was added to the mixture, and pH was lowered by using sulfuric acid until the silver halide was precipitated (lowered to the range of pH 3.2±0.2). Then, about 3 L of the supernatant was removed (first washing with water). Furthermore, the mixture was added with 3 L of distilled water and then with sulfuric acid until the silver halide was precipitated. In an amount of 3 L of the supernatant was removed again (second washing with water). The same procedure as the second washing with water was repeated once more (third washing with water) to complete the washing with water and desalting processes. The emulsion after the washing with water and desalting was added with 45 g of gelatin, and after pH was adjusted to 5.7 and pAg was adjusted to 7.5, added with phenoxyethanol as an antiseptic to finally obtain a dispersion of non-post ripened cubic silver chloroiodobromide grains (i) containing 30 mol % of silver chloride and 0.08 mol % of silver iodide in average and having an average grain size of 0.45 $\mu$m and a variation coefficient of 10%. The emulsion finally showed pH of 5.7, pAg of 7.5, electric conductivity of 40 $\mu$S/m, density of $1.3–1.35\times10^3$ kg/m$^3$ and viscosity of 50 mPa·s.

<<Preparation of Coating Solutions>>

The silver halide photographic light-sensitive materials prepared in this example had a structure where UL layer, emulsion layer, lower protective layer and upper protective layer were formed in this order on one surface of a polyethylene terephthalate film support mentioned below having moisture proof undercoat layers comprising vinylidene chloride on the both surfaces, and an electroconductive layer and back layer were formed in this order on the opposite surface.

Compositions of coating solutions used for forming the layers are shown below.

| Coating solution for UL layer | |
|---|---|
| Gelatin | 0.5 g/m$^2$ |
| Polyethyl acrylate latex | 150 mg/m$^2$ |
| Compound (Cpd-7) | 40 mg/m$^2$ |
| Compound (Cpd-14) | 10 mg/m$^2$ |
| 5-Methylbenzotriazole | 20 mg/m$^2$ |
| Antiseptic (Proxcel, ICI) | 1.5 mg/m$^2$ |
| **Coating solution for emulsion layer** | |
| Emulsion | Amount shown in Table 2 |
| Spectral sensitization dye (mentioned in Table 2) | 5.7 × 10$^{-4}$ mol/Ag mol |
| KBr | 3.4 × 10$^{-4}$ mol/Ag mol |
| Compound (Cpd-1) | 2.0 × 10$^{-4}$ mol/Ag mol |
| Compound (Cpd-2) | 2.0 × 10$^{-4}$ mol/Ag mol |
| Compound (Cpd-3) | 8.0 × 10$^{-4}$ mol/Ag mol |
| 4-Hydroxy-6-methyl-1,3,3a,7-tetrazaindene | 1.2 × 10$^{-4}$ mol/Ag mol |
| Hydroquinone | 1.2 × 10$^{-2}$ mol/Ag mol |
| Citric acid | 3.0 × 10$^{-4}$ mol/Ag mol |
| 5-Methylbenzotriazole | 20 mg/m$^2$ |
| Hydrazine compound (compound shown in Table 2) | Amount shown in Table 2 |
| Nucleation accelerator (compound shown in Table 2) | Amount shown in Table 2 |

-continued

| | |
|---|---|
| 2,4-Dichloro-6-hydroxy-1,3,5-triazine sodium salt | 90 mg/m$^2$ |
| Aqueous latex (Cpd-6) | 100 mg/m$^2$ |
| Polyethyl acrylate latex | 150 mg/m$^2$ |
| Colloidal silica (particle size: 10 nm) | 15 weight % as for gelatin |
| Compound (Cpd-7) | 4 weight % as for gelatin |
| Latex of copolymer of methyl acrylate, 2-acrylamido-2-methypropanesulfonic acid sodium salt and 2-acetoxyethyl methacrylate (weight ratio = 88:5:7) | 150 mg/m$^2$ |
| Core/shell type latex (core: styrene/butadiene copolymer (weight ratio = 37/63), shell: styrene/2-acetoxyethyl acrylate copolymer (weight ratio = 84/16), core/shell ratio = 50/50) | 150 mg/m$^2$ |

pH of the coating solution was adjusted to 5.6 by using citric acid.

The coating solution for emulsion layer prepared as described above was coated on the support mentioned below so that the coated silver amount and coated gelatin amount should become the amounts mentioned in Table 2.

Cpd-1

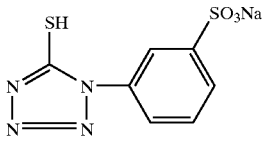

Cpd-2

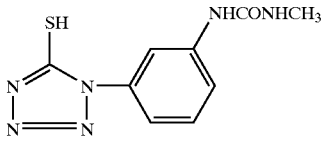

Cpd-3

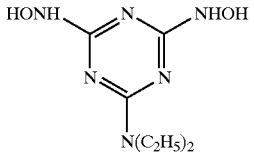

Cpd-4

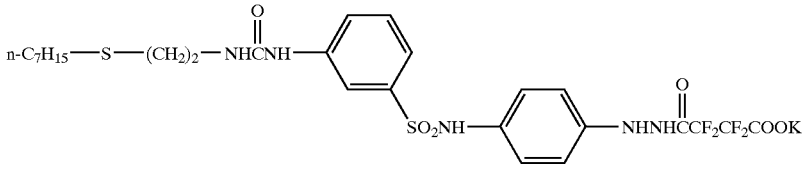

Cpd-5

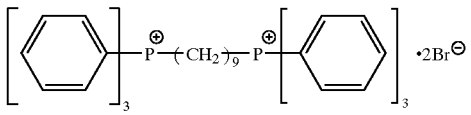

cpd-6

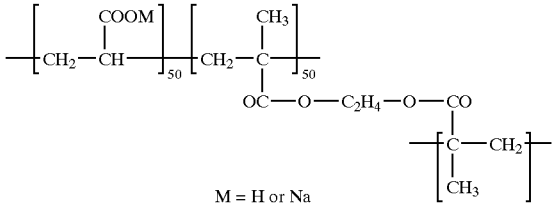

M = H or Na

Cpd-7

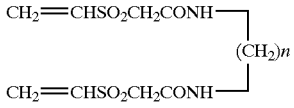

(n = 2):(n = 3) = 3:1

Coating Solution for Lower Protective Layer

| | |
|---|---|
| Gelatin | 0.5 g/m$^2$ |
| Non-photosensitive silver halide grains | 0.1 g/m$^2$ as silver amount |
| Compound (Cpd-12) | 15 mg/m$^2$ |
| 1,5-Dihydroxy-2-benzaldoxime | 10 mg/m$^2$ |
| Polyethyl acrylate latex | 150 mg/m$^2$ |
| Compound (Cpd-13) | 3 mg/m$^2$ |
| Compound (Cpd-20) | 5 mg/m$^2$ |
| Antiseptic (Proxcel, ICI) | 1.5 mg/m$^2$ |
| Coating solution for upper protective layer | |
| Gelatin | 0.3 g/m$^2$ |
| Amorphous silica matting agent (average particle size: 3.5 μm) | 25 mg/m$^2$ |
| Compound (Cpd-8) (gelatin dispersion) | 20 mg/m$^2$ |
| Colloidal silica (particle size: 10–20 nm, Snowtex C, Nissan Chemical) | 30 mg/m$^2$ |
| Compound (Cpd-9) | 50 mg/m$^2$ |
| Sodium dodecylbenzenesulfonate | 20 mg/m$^2$ |
| Compound (Cpd-10) | 20 mg/m$^2$ |
| Compound (Cpd-11) | 20 mg/m$^2$ |
| Antiseptic (Proxcel, ICI) | 1 mg/m$^2$ |

Viscosity of the coating solutions for the layers was adjusted by adding Thickener Z mentioned below.

Cpd-8

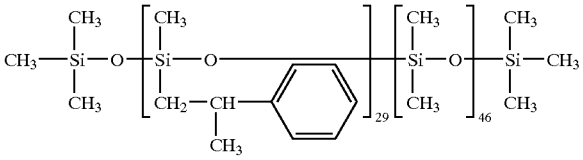

Cpd-9

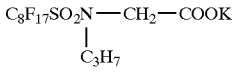

Cpd-10

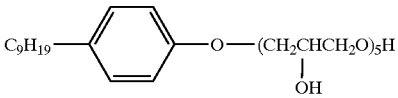

Cpd-11

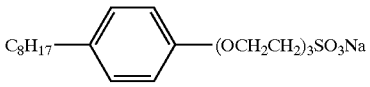

Cpd-12

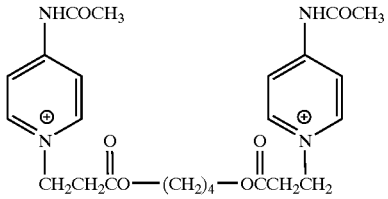

Cpd-13

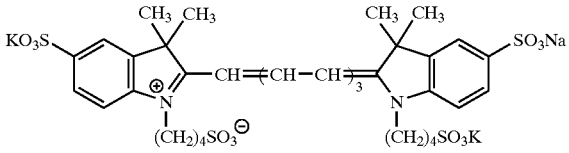

-continued

Cpd-14

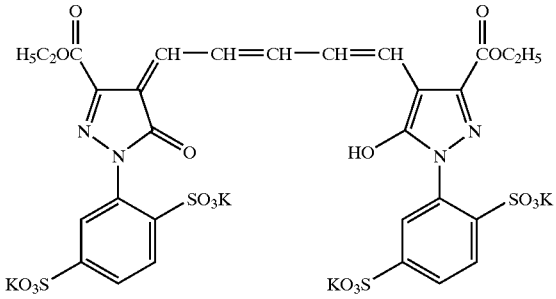

Thickener-Z

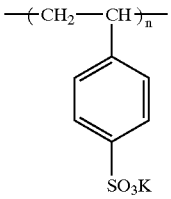

Coating Solution for Back Layer

| | |
|---|---|
| Gelatin | 3.3 g/m$^2$ |
| Compound (Cpd-15) | 40 mg/m$^2$ |
| Compound (Cpd-16) | 20 mg/m$^2$ |
| Compound (Cpd-17) | 90 mg/m$^2$ |
| Compound (Cpd-18) | 40 mg/m$^2$ |
| Compound (Cpd-19) | 26 mg/m$^2$ |
| 1,3-Divinylsulfonyl-2-propanol | 60 mg/m$^2$ |
| Polymethyl methacrylate microparticles (mean particle sizes: 6.5 μm) | 30 mg/m$^2$ |
| Liquid paraffin | 78 mg/m$^2$ |
| Compound (Cpd-7) | 120 mg/m$^2$ |
| Compound (Cpd-20) | 5 mg/m$^2$ |
| Colloidal silica (particle size: 10 μm) | 15 weight % as for gelatin |
| Calcium nitrate | 20 mg/m$^2$ |
| Antiseptic (Proxcel, ICI) | 12 mg/m$^2$ |
| Coating solution for electroconductive layer | |
| Gelatin | 0.1 g/m$^2$ |
| Sodium dodecylbenzenesulfonate | 20 mg/m$^2$ |
| $SnO_2$/Sb (weight ratio = 9:1, average particle size: 0.25 μm) | 200 mg/m$^2$ |
| Antiseptic (Proxcel, ICI) | 0.3 mg/m$^2$ |

Cpd-15

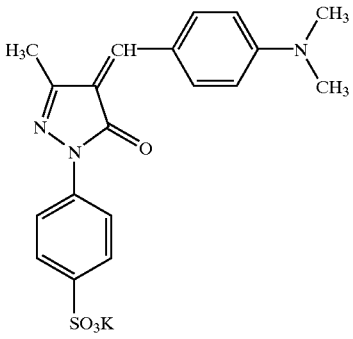

-continued

Cpd-16

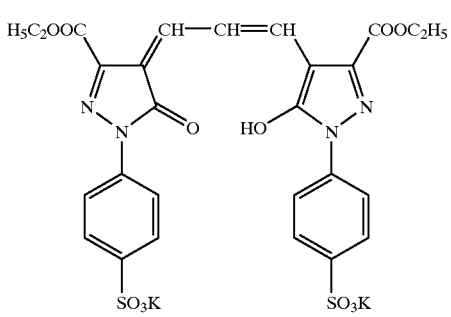

Cpd-17

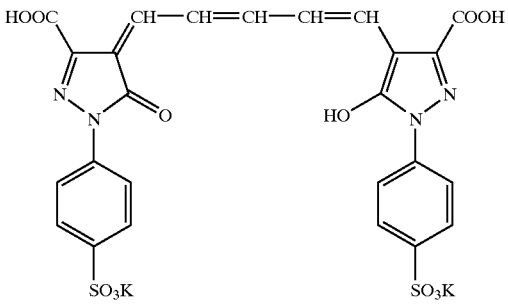

Cpd-18

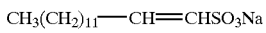

Cpd-19

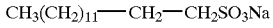

Cpd-20

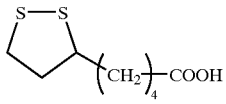

<<Support>>

On both surfaces of a biaxially stretched polyethylene terephthalate support (thickness: 100 μm), coating solutions for first undercoat layer and second undercoat layer having the following compositions were coated.

Coating Solution for First Undercoat Layer

| | |
|---|---|
| Core/shell type vinylidene chloride copolymer (i) | 15 g |
| 2,4-Dichloro-6-hydroxy-s-triazine | 0.25 g |
| Polystyrene microparticles (mean particle size: 3 μm) | 0.05 g |
| Compound (Cpd-21) | 0.20 g |
| Colloidal silica (particle size: 70–100 nm Snowtex ZL, Nissan Chemical,) | 0.12 g |
| Water | Amount making total amount 100 g |

The coating solution was adjusted to pH 6 by further addition of 10 weight % of KOH and coated so that a dry thickness of 0.9 μm should be obtained after drying at a drying temperature of 180° C. for 2 minutes.

Coating Solution for Second Undercoat Layer

| | |
|---|---|
| Gelatin | 1 g |
| Methylcellulose | 0.05 g |
| Compound (Cpd-22) | 0.02 g |
| $C_{12}H_{25}O(CH_2CH_2O)_{10}H$ | 0.03 g |
| Antiseptic (Proxcel, ICI) | $3.5 \times 10^{-3}$ g |
| Acetic acid | 0.2 g |

-continued

| | |
|---|---|
| Water | Amount making total amount 100 g |

This coating solution was coated so that a dry thickness of 0.1 μm should be obtained after drying at a drying temperature of 170° C. for 2 minutes.

Core/Shell Type Vinylidene Chloride Copolymer (i)

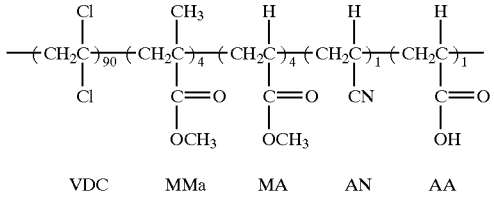

VDC MMa MA AN AA

Core: VDC/MMA/MA (80 weight %)

Shell: VDC/AN/AA (20 weight %)

Average particle size: 70 nm

Compound (Cpd-21)

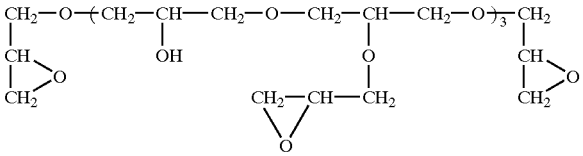

Compound (Cpd-22)

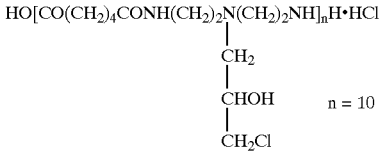

<<Method for Coating on Support>>

First, on the aforementioned support coated with the undercoat layers, as the emulsion layer side, four layers of UL layer, emulsion layer, lower protective layer and upper protective layer were simultaneously coated as stacked layers in this order from the support at 35° C. by the slide bead coating method while adding a hardening agent solution and passed through a cold wind setting zone (5° C.). Then, on the side opposite to the emulsion layer side, an electroconductive layer and a back layer were simultaneously coated as stacked layers in this order from the support by the curtain coating method while adding a hardening agent solution, and passed through a cold wind setting zone (5° C.). After the coated support was passed through each setting zone, the coating solutions showed sufficient setting. Subsequently, the support coated with the layers was dried for the both surfaces in a drying zone of the drying conditions mentioned below. The coated support was transported without any contact with rollers and the other members after the coating of the back surface until it was rolled up. The coating speed was 200 m/min.

<<Drying Conditions>>

After the setting, the coated layers were dried with a drying wind at 30° C. until the water/gelatin weight ratio became 800%, and then with a drying wind at 35° C. and relative humidity of 30% for the period where the ratio became 200% from 800%. The coated layers were further blown with the same wind, and 30 second after the point when the surface temperature became 34° C. (regarded as completion of drying), the layers were dried with air at 48° C. and relative humidity of 2% for 1 minute. In this operation, the drying time was 50 seconds from the start to the water/gelatin ratio of 800%, 35 seconds from 800% to 200% of the ratio, and 5 seconds from 200% of the ratio to the end of the drying.

This silver halide photographic light-sensitive material was rolled up at 25° C. and relative humidity of 55%, cut under the same environment, conditioned for moisture content at 25° C. and relative humidity of 50% for 8 hours and then sealed in a barrier bag conditioned for moisture content for 6 hours together with a cardboard conditioned for moisture content at 25° C. and relative humidity of 50% for 2 hours to prepare each of Sample 1 to 22 mentioned in Table 2.

Humidity in the barrier bag was measured and found to be 45%. The obtained samples had a film surface pH of 5.5–5.8 for the emulsion layer side and 6.0–6.5 for the back side. Absorption spectra of the emulsion layer side and back layer side are shown in FIG. 1.

<<Light Exposure and Development>>

Each of the obtained samples was exposed with xenon flash light for an emission time of $10^{-6}$ second through an interference filter having a peak at 667 nm and a step wedge.

Then, each sample was processed with development conditions of 35° C. for 30 seconds by using a developer (QR-D1, Fuji Photo Film Co., Ltd.), a fixer (NF-1, Fuji Photo Film Co., Ltd.) and an automatic developing machine (FG-680AG, Fuji Photo Film Co., Ltd.).

<<Evaluation>>

Sensitivity, gradation (gamma), practice density and processing property of the samples were measured by the methods described below.

(Sensitivity)

Sensitivity was represented with a reciprocal of exposure giving a density of fog +1.5 as a relative value based on the sensitivity of Sample No. 1, which was taken as 100. A larger value means higher sensitivity.

(Gamma)

A characteristic curve drawn in orthogonal coordinates of optical density (y-axis) and common logarithm of light exposure (x-axis) using equal unit lengths for the both axes is prepared, and inclination of a straight line connecting two points on the curve corresponding to optical densities of 0.1 and 1.5 was determined as gamma.

(Practice Density)

Test steps were outputted by using an image setter (RC5600V, Fuji Photo Film Co., Ltd.) at 175 lines/inch with changing the light quantity and developed under the conditions described above. The exposure was performed at an LV value giving 50% of medium half tone dots, and density of a Dmax portion was measured as practice density. The half tone % and the practice density were measured by using a densitometer (Macbeth TD904).

(Processing Stability of Silver Halide Photographic Light-Sensitive Material)

Twenty sheets per day of each sample prepared as shown in Table 2 in the Daizen size (50.8 cm×61.0 cm) blackened for 20% were processed by using the developer QR-D1 with replenishing the used solution in an amount of 100 mL per one sheet of Daizen size. This daily operation was performed for 6 days in a week, and this running was continued for 15 weeks. A small amount of films were processed as described above to obtain a developer undergone processing of a small amount of films.

Three hundreds sheets per day of each sample prepared as shown in Table 2 in the Daizen size (50.8 cm×61.0 cm) blackened for 80% were processed by using the developer QR-D1 with replenishing the used solution in an amount of 100 mL per one sheet of Daizen size. This daily operation was performed for continuous 4 days. A large amount of films were processed as described above to obtain a developer undergone processing of a large amount of films.

Evaluation of practice density was performed by using these developers to obtain a practice density obtained with the developer undergone processing of a small amount of films (Small amount) and a practice density obtained with the developer undergone processing of a large amount of films (Large amount). In view of processing stability, the practice density of 4 or more is preferred.

The results of these evaluations are summarized in Table 2. From the results shown in Table 2, it can be seen that the samples satisfying the requirements of the present invention showed high sensitivity, high practice density and superior processing stability.

TABLE 1

| | | Grain | Heavy metal | | | | | |
|---|---|---|---|---|---|---|---|---|
| Emulsion | Halogen composition | size (μm) | Type | Amount (mol/Ag mol) | Type | Amount (mol/Ag mol) | Type | Amount (mol/Ag mol) |
| A | $AgBr_{30}Cl_{69.9}I_{0.1}$ | 0.21 | $(NH_4)_3[RhCl_5(H_2O)]$ | $2.5 \times 10^{-7}$ | $K_3IrCl_6$ | $6 \times 10^{-7}$ | $K_4[Fe(CN)_6].3H_2O$ | $8 \times 10^{-7}$ |
| B | $AgBr_{30}Cl_{69.9}I_{0.1}$ | 0.17 | $(NH_4)_3[RhCl_5(H_2O)]$ | $6 \times 10^{-7}$ | $K_3IrCl_6$ | $6 \times 10^{-7}$ | $K_4[Fe(CN)_6].3H_2O$ | $8 \times 10^{-7}$ |
| C | $AgBr_{30}Cl_{69.9}I_{0.1}$ | 0.21 | $(NH_4)_3[RhCl_5(H_2O)]$ | $2.5 \times 10^{-7}$ | $K_3IrCl_6$ | $6 \times 10^{-7}$ | $K_4[Fe(CN)_6].3H_2O$ | $3 \times 10^{-5}$ |
| D | $AgBr_{45}Cl_{54.9}I_{0.1}$ | 0.21 | $(NH_4)_3[RhCl_5(H_2O)]$ | $3.4 \times 10^{-7}$ | $K_3IrCl_6$ | $6 \times 10^{-7}$ | $K_4[Fe(CN)_6].3H_2O$ | $3 \times 10^{-5}$ |
| E | $AgBr_{55}Cl_{44.9}I_{0.1}$ | 0.21 | $(NH_4)_3[RhCl_5(H_2O)]$ | $3.9 \times 10^{-7}$ | $K_3IrCl_6$ | $6 \times 10^{-7}$ | $K_4[Ru(CN)_6]$ | $3 \times 10^{-5}$ |
| F | $AgBr_{55}Cl_{44.9}I_{0.1}$ | 0.21 | $(NH_4)_3[RhCl_5(H_2O)]$ | $2.6 \times 10^{-7}$ | $K_3IrCl_6$ | $6 \times 10^{-7}$ | $K_4[Ru(CN)_6]$ | $8 \times 10^{-7}$ |
| G | $AgBr_{70}Cl_{29.9}I_{0.1}$ | 0.21 | $(NH_4)_3[RhCl_5(H_2O)]$ | $4.3 \times 10^{-7}$ | $K_3IrCl_6$ | $6 \times 10^{-7}$ | $K_4[Ru(CN)_6]$ | $3 \times 10^{-5}$ |
| H | $AgBr_{55}Cl_{44.9}I_{0.1}$ | 0.17 | $(NH_4)_3[RhCl_5(H_2O)]$ | $9.4 \times 10^{-7}$ | $K_3IrCl_6$ | $6 \times 10^{-7}$ | $K_4[Ru(CN)_6]$ | $3 \times 10^{-5}$ |

TABLE 2

| Sample No. | Emulsion | Emulsion layer: Silver amount ($g/m^3$) | Emulsion layer: Gelatin amount ($g/m^2$) | Hydrazine compound: Type | Hydrazine compound: Amount (mol/Agmol) | Nucleation accelerator: Type | Nucleation accelerator: Amount (mol/Agmol) | Spectral sensitization dye: Type | Spectral sensitization dye: Amount (mol/gmol) |
|---|---|---|---|---|---|---|---|---|---|
| 1 | A | 3.5 | 1.5 | — | — | — | — | III-3 | $5.7 \times 10^{-4}$ |
| 2 | C | 3.5 | 1.5 | — | — | — | — | III-3 | $5.7 \times 10^{-4}$ |
| 3 | D | 3.5 | 1.5 | — | — | — | — | III-3 | $5.7 \times 10^{-4}$ |
| 4 | E | 3.5 | 1.5 | — | — | — | — | III-3 | $5.7 \times 10^{-4}$ |
| 5 | F | 3.5 | 1.5 | — | — | — | — | III-3 | $5.7 \times 10^{-4}$ |
| 6 | G | 3.5 | 1.5 | — | — | — | — | III-3 | $5.7 \times 10^{-4}$ |
| 7 | A | 2.9 | 1.2 | cpd-4 | $6.0 \times 10^{-4}$ | — | — | III-3 | $5.7 \times 10^{-4}$ |
| 8 | C | 2.9 | 1.2 | cpd-4 | $6.0 \times 10^{-4}$ | — | — | III-3 | $5.7 \times 10^{-4}$ |
| 9 | D | 2.9 | 1.2 | cpd-4 | $6.0 \times 10^{-4}$ | — | — | III-3 | $5.7 \times 10^{-4}$ |
| 10 | E | 2.9 | 1.2 | cpd-4 | $6.0 \times 10^{-4}$ | — | — | III-3 | $5.7 \times 10^{-4}$ |
| 11 | F | 2.9 | 1.2 | cpd-4 | $6.0 \times 10^{-4}$ | — | — | III-3 | $5.7 \times 10^{-4}$ |
| 12 | G | 2.9 | 1.2 | cpd-4 | $6.0 \times 10^{-4}$ | — | — | III-3 | $5.7 \times 10^{-4}$ |
| 13 | A:B = 1:2 (molar ratio of silver) | 2.9 | 1.2 | cpd-4 | $7.2 \times 10^{-4}$ | — | — | III-3 | $5.7 \times 10^{-4}$ |
| 14 | F:I = 1:2 (molar ratio of silver) | 2.9 | 1.2 | cpd-4 | $7.2 \times 10^{-4}$ | — | — | III-3 | $5.7 \times 10^{-4}$ |
| 15 | E | 2.9 | 1.2 | cpd-4 | $7.2 \times 10^{-4}$ | — | — | I-2 | $6.0 \times 10^{-4}$ |
| 16 | E | 2.9 | 1.2 | cpd-4 | $7.2 \times 10^{-4}$ | — | — | I-27 | $5.5 \times 10^{-4}$ |
| 17 | E | 2.9 | 1.2 | cpd-4 | $7.2 \times 10^{-4}$ | — | — | II-2 | $6.2 \times 10^{-4}$ |
| 18 | E | 2.9 | 1.2 | cpd-4 | $7.2 \times 10^{-4}$ | — | — | II-25 | $5.9 \times 10^{-4}$ |
| 19 | E | 2.9 | 1.2 | cpd-4 | $7.2 \times 10^{-4}$ | — | — | III-20 | $5.8 \times 10^{-4}$ |
| 20 | E | 2.9 | 1.2 | cpd-4 | $7.2 \times 10^{-4}$ | — | — | IV-3 | $8.2 \times 10^{-4}$ |
| 21 | E | 2.9 | 1.2 | cpd-4 | $7.2 \times 10^{-4}$ | — | — | IV-6 | $7.4 \times 10^{-4}$ |
| 22 | E | 2.9 | 1.2 | cpd-4 | $7.2 \times 10^{-4}$ | Cpd-5 | $5.0 \times 10^{-4}$ | III-23 | $4.9 \times 10^{-4}$ |

| Sample No. | Emulsion | Photographic property: Sensitivity | Photographic property: Gradation (γ) | Processing property: Practice density | Practice density (small amount) | Practice density large amount) | Note |
|---|---|---|---|---|---|---|---|
| 1 | A | 100 | 5.0 | 3.8 | 3.9 | 3.6 | Comparative |
| 2 | C | 100 | 4.8 | 3.4 | 3.5 | 3.1 | Comparative |
| 3 | D | 102 | 5.4 | 4.2 | 4.4 | 4.2 | Invention |
| 4 | E | 105 | 5.6 | 4.4 | 4.5 | 4.4 | Invention |
| 5 | F | 104 | 3.9 | 3.2 | 3.3 | 2.8 | Comparative |
| 6 | G | 101 | 5.6 | 4.4 | 4.4 | 4.2 | Invention |
| 7 | A | 127 | 13.0 | 4.2 | 4.3 | 3.8 | Comparative |
| 8 | C | 128 | 11.2 | 4.0 | 4.2 | 3.6 | Comparative |
| 9 | D | 131 | 18.5 | 4.4 | 4.5 | 4.2 | Invention |
| 10 | E | 135 | 20.4 | 4.5 | 4.6 | 4.4 | Invention |
| 11 | F | 136 | 10.0 | 3.9 | 4.0 | 3.2 | Comparative |
| 12 | G | 128 | 17.0 | 4.3 | 4.3 | 4.1 | Invention |
| 13 | A:B = 1:2 (molar ratio of silver) | 124 | 11.0 | 4.4 | 4.6 | 3.9 | Comparative |
| 14 | F:I = 1:2 (molar ratio of silver) | 133 | 19.3 | 4.8 | 4.9 | 4.7 | Invention |
| 15 | E | 102 | 19.8 | 4.4 | 4.6 | 4.4 | Invention |
| 16 | E | 99 | 20.2 | 4.5 | 4.6 | 4.4 | Invention |
| 17 | E | 105 | 20.9 | 4.5 | 4.6 | 4.3 | Invention |
| 18 | E | 101 | 18.8 | 4.4 | 4.5 | 4.3 | Invention |
| 19 | E | 99 | 22.0 | 4.5 | 4.6 | 4.3 | Invention |
| 20 | E | 108 | 19.0 | 4.4 | 4.5 | 4.3 | Invention |
| 21 | E | 105 | 21.0 | 4.5 | 4.6 | 4.4 | Invention |
| 22 | E | 101 | 25.0 | 4.5 | 4.6 | 4.5 | Invention |

EXAMPLE 2

Samples were prepared in the same manner as in Example 1 except that carboxymethyltrimethythiourea compound or dicarboxymethyldimethylthiourea, which is a tetra-substituted thiourea compound, was used instead of the sodium thiosulfate used for chemical sensitization of Emulsion A in the same molar amount as sodium thiosulfate. The samples having the characteristics of the present invention showed good performances as in Example 1.

EXAMPLE 3

The same experiment as that of Example 1 was performed by using RA2000 produced by Kodak Polychrome Graphics (developer) and RA3000 produced by Kodak Polychrome Graphics (fixer). The samples having the characteristics of the present invention showed good performances as in Example 1.

EXAMPLE 4

The same experiment as that of Example 1 was performed by using G101C produced by Agfa-Gevaert AG (developer) and G333 produced by Agfa-Gevaert AG (fixer). The samples having the characteristics of the present invention showed good performances as in Example 1.

EXAMPLE 5

The same experiment as that of Example 1 was performed by using Type 681 produced by Konica Corporation (developer) and Type 881 produced by Konica Corporation (fixer). The samples having the characteristics of the present invention showed good performances as in Example 1.

EXAMPLE 6

The same experiment as that of Example 1 was performed by using QR-D1 PD produced by Fuji Photo Film Co., Ltd. (solid developer) and UR-F1 PD produced by Fuji Photo Film Co., Ltd. (solid fixer). The samples having the characteristics of the present invention showed good performances as in Example 1.

EXAMPLE 7

The same experiment as that of Example 1 was performed by using 681Z produced by Konica Corporation (solid developer) and 881Z produced by Konica Corporation (solid fixer). The samples having the characteristics of the present invention showed good performances as in Example 1.

EXAMPLE 8

The same experiment as that of Example 1 was performed by using 731G produced by Konica Corporation (solid developer) and 921G produced by Konica Corporation (solid fixer). The samples having the characteristics of the present invention showed good performances as in Example 1.

EXAMPLE 9

When the processing procedures of Examples 1 to 8 were performed at a development temperature of 38° C. and fixing temperature of 37° C. for development time of 20 seconds, results similar to those obtained in Examples 1 to 8 were obtained, and thus the effect of the present invention was not degraded.

EXAMPLE 10

Even when the processing procedures of Examples 1 to 9 were performed with a transportation speed of silver halide photographic light-sensitive materials of 1500 mm/minute as a line speed by using an automatic developing machine, FG-680AS (Fuji Photo Film Co., Ltd.), the samples having the characteristics of the present invention similarly showed good performances.

EXAMPLE 11

When the same evaluations were performed by using, instead of Lux Setter RC-5600V produced by Fuji Photo Film Co., Ltd, any one of Image setter FT-R$^{5055}$ produced by Dainippon Screen Mfg. Co., Ltd., Select Set 5000, Avantra 25 and Acuset 1000 produced by Agfa Gevaert AG, Dolev 450 and Dolev 800 produced by Scitex, Lino 630, Quasar, Herkules ELITE and Signasetter produced by Heidelberg, Lux Setters Luxel F-9000 and F-6000 produced by Fuji Photo Film Co., and Panther Pro 62 produced by PrePRESS Inc., the samples having the characteristics of the present invention showed good performances.

EXAMPLE 12

Samples were prepared in the same manner as in Example 1 except that Compound V-19, VIa-7 or VIb-9 was used instead of the spectral sensitization dyes mentioned in Table 2.

For each of the samples obtained as described above, the same evaluations as Examples 1 to 12 were performed except that the light exposure was performed through an interference filter having a peak at 780 nm instead of the interference filter having a peak at 667 nm and a step wedge. As a result, the samples having the characteristics of the present invention showed good performance.

As for evaluation of practice density, Image setter FT-R$^{3100}$ produced by Dainippon Screen Mfg. Co., Ltd. instead of Lux Setter RC-5600V produced by Fuji Photo Film Co.

What is claimed is:

1. A silver halide photographic light-sensitive material comprising at least one silver halide emulsion layer on a support, wherein 40 mol % or more of silver halide contained in the silver halide emulsion layer is silver bromide and the silver halide contains $1\times10^{-6}$ mole or more per mole of silver of a metal complex containing one or more cyanide ligands, and the silver halide photographic light-sensitive material has a characteristic curve drawn in orthogonal coordinates of logarithm of light exposure (x-axis) and optical density (y-axis) using equal unit lengths for the both axes, on which gamma is 4.0 or more for the optical density range of 0.1–1.5, and the silver halide photographic light-sensitive material comprises a hydrazine derivative.

2. The silver halide photographic light-sensitive material according to claim 1, wherein the metal complex containing one or more cyanide ligands exists in the inside of silver halide crystals, and 99 mol % or less of the total amount of silver contained in the silver halide crystals exists in the inside of the crystals.

3. The silver halide photographic light-sensitive material according to claim 1, wherein 45–75 mol % or more of silver halide contained in the silver halide emulsion layer is silver bromide.

4. The silver halide photographic light-sensitive material according to claim 1, wherein the silver halide contains $5\times10^{-6}$ mole to $5\times10^{-3}$ mole per mole of silver of a metal complex containing one or more cyanide ligands.

5. The silver halide photographic light-sensitive material according to claim 1, wherein the metal complex containing one or more cyanide ligands exists in the inside of silver halide crystals, and 95 mol % or less of the total amount of silver contained in the silver halide crystals is contained in the inside of the silver halide crystals.

6. The silver halide photographic light-sensitive material according to claim 1, wherein the silver halide crystals have an aspect ratio (diameter as circle/thickness) of 2 or less.

7. The silver halide photographic light-sensitive material according to claim 1, which has a characteristic curve drawn in orthogonal coordinates of logarithm of light exposure (x-axis) and optical density (y-axis) using equal unit lengths for the both axes, on which gamma is 5.0 or more for the optical density range of 0.1–1.5.

8. The silver halide photographic light-sensitive material according to claim 1, wherein at least one of silver halide emulsion contains at least one spectral sensitization dye represented by the following formula (I), (II), (III), (IV), (V), (VIa) or (VIb), Formula (I)

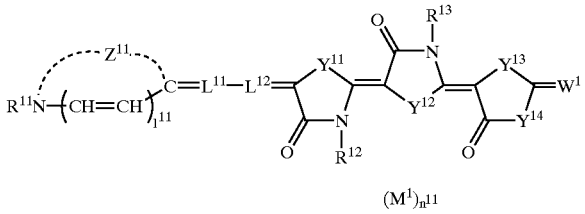

wherein $Y^{11}$, $Y^{12}$, $Y^{13}$ and $Y^{14}$ each independently represent $=N(R^1)$, an oxygen atom, a sulfur atom, a selenium atom or a tellurium atom, provided that either one of $Y^{13}$ and $Y^{14}$ is $=N(R^1)$, and $Y^{11}$, $Y^{12}$ and $Y^{13}$ or $Y^{11}$, $Y^{12}$ and $Y^{14}$ do not simultaneously represent a sulfur atom, $R^{11}$ represents an aliphatic group having a water-solubilizable group and 8 or less carbon atoms, and $R^1$, $R^{12}$ and $R^{13}$ each independently represent an aliphatic group, an aryl group or a heterocyclic group, at least two of $R^1$, $R^{12}$ and $R^{13}$ have a water-solubilizable group, $Z^{11}$ represents a nonmetallic atom group required to form a 5- or 6-membered nitrogen-containing heterocyclic ring, and the 5- or 6-membered nitrogen-containing heterocyclic ring formed with $Z^{11}$ may have a condensed ring, $W^1$ represents an oxygen atom, a sulfur atom, $=N(R^1)$ or $=C(E^{11})(E^{12})$, $E^{11}$ and $E^{12}$ each independently represent an electron-withdrawing group, which may bond to each other to form a keto ring or an acidic heterocyclic ring, $L^{11}$ and $L^{12}$ each independently represent a substituted or unsubstituted methine group, and $1^{11}$ represents 0 or 1, $M^1$ represents an ion required to offset the charge of the molecule, $n^{11}$ represents a number required to neutralize the total charge of the molecule, and when an intramolecular salt is formed, $n^{11}$ is 0, Formula (II)

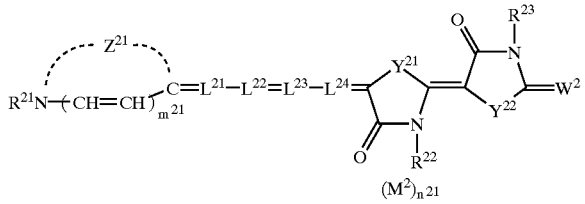

$Z^{21}$ represents a nonmetallic atom group required to form a 5- or 6-membered nitrogen-containing heterocyclic ring, and the 5- or 6-membered nitrogen-containing heterocyclic ring formed with $Z^{21}$ may have a condensed ring, $Y^{21}$ and $Y^{22}$ each independently represent $=N(R^2)$, an oxygen atom, a sulfur atom, a selenium atom or a tellurium atom, $W^2$ represents $=N(Ar)$, an oxygen atom, a sulfur atom or $=C(E^{21})(E^{22})$, $E^{21}$ and $E^{22}$ each independently represent an electron-withdrawing group or a nonmetallic atom group for forming an acidic heterocyclic ring when $E^{21}$ and $E^{22}$ bond to each other, and Ar represents an aromatic group or an aromatic heterocyclic group, $R^{21}$ represents an aliphatic group having 8 or less carbon atoms and a water-solubilizable group, and $R^2$, $R^{22}$ and $R^{23}$ each independently represent an aliphatic group, an aryl group or a heterocyclic group, at least two of $R^2$, $R^{22}$ and $R^{23}$ have a water-solubilizable group, $L^{21}$, $L^{22}$, $L^{23}$ and $L^{24}$ each independently represent a substituted or unsubstituted methine group, and $m^{21}$ represents 0 or 1, $M^2$ represents an ion required to offset the charge of the molecule, $n^{21}$ represents a number required to neutralize the total charge of the molecule, and when an intramolecular salt is formed, $n^{21}$ is 0, Formula (III)

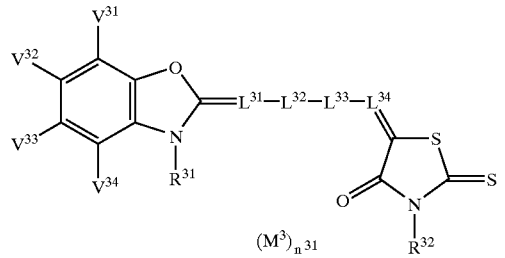

$R^{31}$ and $R^{32}$ each independently represent an alkyl group, at least one alkyl group has a water-soluble group, $V^{31}$, $V^{32}$, $V^{33}$ and $V^{34}$ represent a hydrogen atom or a monovalent substituent, the sum of the molecular weight of these substituents ($V^{31}$, $V^{32}$, $V^{33}$ and $V^{34}$) is 50 or less, $L^{31}$, $L^{32}$, $L^{33}$ and $L^{34}$ each independently represent a substituted or unsubstituted methane group, $M^3$ represents an ion required to offset the charge of the molecule, $n^{31}$ represents a number required to neutralize the total charge of the molecule, and when an intramolecular salt is formed, $n^{31}$ is 0, Formula (IV)

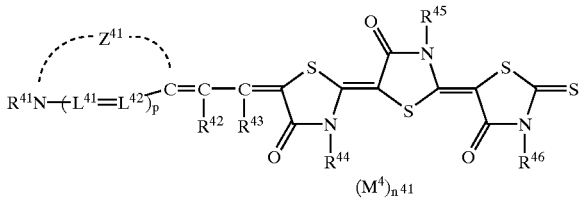

$R^{41}$ represents an alkyl group, an alkenyl group or an aryl group, $R^{42}$ and $R^{43}$ each independently represent a hydrogen atom, an alkyl group, an alkenyl group or an aryl group, and $R^{44}$, $R^{45}$ and $R^{46}$ each independently represent an alkyl group, an alkenyl group, an aryl group or a hydrogen atom, $L^{41}$ and $L^{42}$ each independently represent a substituted or unsubstituted methine group, and p represents 0 or 1, $Z^{41}$ represents an atomic group required to complete a 5- or 6-membered heterocyclic ring, and the 5- or 6-membered heterocyclic group formed with $Z^{41}$ may have a condensed ring, $M^4$ represents an ion required to offset the charge of the molecule, $n^{41}$ represents a number required to neutralize the total charge of the molecule, when an intramolecular salt is formed, $n^{41}$ is 0, and the spectral sensitization dye represented by the formula (IV) has at least three water-solubilizable groups, Formula (V)

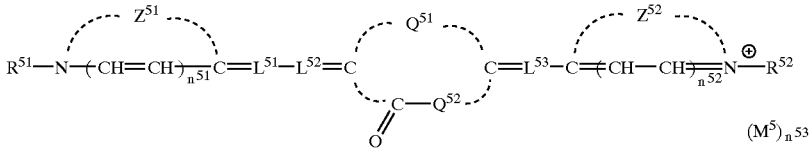

$Z^{51}$ and $Z^{52}$ each independently represent a nonmetallic atom group required to form a 5- or 6-membered nitrogen-containing heterocyclic ring, and the 5- or 6-membered nitrogen-containing heterocyclic ring formed with $Z^{51}$ or $Z^{52}$ may have a condensed ring, $R^{51}$ and $R^{52}$ each independently represent an alkyl group, a substituted alkyl group or an aryl group, $Q^{51}$ and $Q^{52}$ represent a nonmetallic atom group required to together form a thiazolidinone ring or an imidazolidinone ring, $L^{51}$, $L^{52}$ and $L^{53}$ each independently represent a methine group or a substituted methane group, $n^{51}$ and $n^{52}$ each independently represent 0 or 1, $M^5$ represents an ion required to offset the charge of the molecule, $n^{53}$ represents a number required to neutralize the total charge of the molecule, and when an intramolecular salt is formed, $n^{53}$ is 0, Formula (VIa)

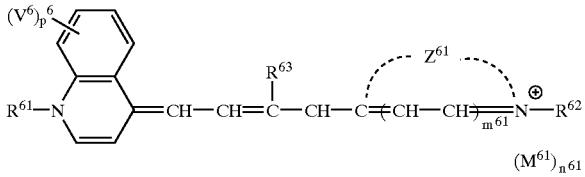

$R^{61}$ and $R^{62}$ each independently represent an alkyl group, $R^{63}$ represents a hydrogen atom, a lower alkyl group, a lower alkoxy group, a phenyl group, a benzyl group or a phenethyl group, $V^6$ represents a hydrogen atom, a lower alkyl group, an alkoxy group, a halogen atom or a substituted alkyl group, and $p^6$ represents 1 or 2, $Z^{61}$ represents a group required to form a 5- or 6-membered nitrogen-containing heterocyclic ring, and the 5- or 6-membered nitrogen-containing heterocyclic ring formed with $Z^{61}$ may have a condensed group, $m^{61}$ represents 0 or 1, $M^{61}$ represents an ion required to offset the charge of the molecule, $n^{61}$ represents a number required to neutralize the total charge of the molecule, and when an intramolecular salt is formed, $n^{61}$ is 0, Formula (VIb)

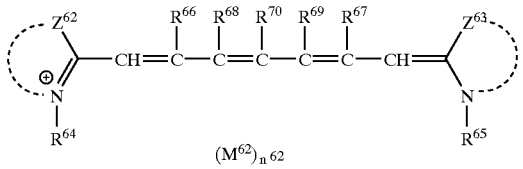

$R^{64}$ and $R^{65}$ each independently represent an alkyl group, $R^{66}$ and $R^{67}$ each independently represent a hydrogen atom, a lower alkyl group, a lower alkoxy group, a phenyl group, a benzyl group or a phenethyl group, $R^{68}$ and $R^{69}$ each represent a hydrogen atom, $R^{68}$ and $R^{69}$ may bond to each other to form an alkylene group, $R^{70}$ represents a hydrogen atom, a lower alkyl group, a lower alkoxy group, a phenyl group, a benzyl group or —N($W^{61}$) ($W^{62}$), wherein $W^{61}$ and $W^{62}$ each independently represent an alkyl group or an aryl group, or $W^{61}$ and $W^{62}$ may bond to each other to form a 5- or 6-membered nitrogen-containing heterocyclic ring, $R^{66}$ and $R^{70}$ or $R^{67}$ and $R^{70}$ may bond to each other, respectively, to form an alkylene group, $Z^{62}$ and $Z^{63}$ each independently represent a nonmetallic atom group required to form a 5- or 6-membered nitrogen-containing heterocyclic ring, and the 5- or 6-membered nitrogen-containing heterocyclic ring formed with $Z^{62}$ or $Z^{63}$ may have a condensed ring, $M^{62}$ represents an ion required to offset the charge of the molecule, $n^{62}$ represents a number required to neutralize the total charge of the molecule, and when an intramolecular salt is formed, $n^{62}$ is 0.

9. The silver halide photographic light-sensitive material according to claim 8, wherein at least one of silver halide emulsion contains at least one spectral sensitization dye represented by the formula (I).

10. The silver halide photographic light-sensitive material according to claim 8, wherein at least one of silver halide emulsion contains at least one spectral sensitization dye represented by the formula (II).

11. The silver halide photographic light-sensitive material according to claim 8, wherein at least one of silver halide emulsion contains at least one spectral sensitization dye represented by the formula (III).

12. The silver halide photographic light-sensitive material according to claim 8, wherein at least one of silver halide emulsion contains at least one spectral sensitization dye represented by the formula (IV).

13. The silver halide photographic light-sensitive material according to claim 8, wherein at least one of silver halide emulsion contains at least one spectral sensitization dye represented by the formula (V).

14. The silver halide photographic light-sensitive material according to claim 8, wherein at least one of silver halide emulsion contains at least one spectral sensitization dye represented by the formula (VIa).

15. The silver halide photographic light-sensitive material according to claim 8, wherein at least one of silver halide emulsion contains at least one spectral sensitization dye represented by the formula (VIb).

16. The silver halide photographic light-sensitive material according to claim 1, which has a membrane surface pH of 6.0 or less for the emulsion layer side.

17. The silver halide photographic light-sensitive material according to claim 1, the silver halide has a mean grain size of 0.1–0.5 $\mu$m.

18. The silver halide photographic light-sensitive material according to claim 1, the silver halide has a narrow grain size distribution in terms of a variation coefficient of 10% or less.

19. The silver halide photographic light-sensitive material according to claim 1, which is for being processed with a developer prepared by using a solid processing agent.

20. The silver halide photographic light-sensitive material according to claim 1, wherein gamma is 17 or more.

* * * * *